US006632594B2

(12) United States Patent
Nakai et al.

(10) Patent No.: US 6,632,594 B2
(45) Date of Patent: Oct. 14, 2003

(54) PHOTOGRAPHIC PROCESSING COMPOSITION CONTAINING A DIAMINOSTILBENE DERIVATIVE AND IMAGE FORMING METHOD USING THE SAME

(75) Inventors: Yasufumi Nakai, Kanagawa (JP); Keizo Kimura, Kanagawa (JP); Shigeaki Tanaka, Kanagawa (JP); Yoshiharu Yabuki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 72 days.

(21) Appl. No.: 09/770,283

(22) Filed: Jan. 29, 2001

(65) Prior Publication Data

US 2001/0031432 A1 Oct. 18, 2001

(30) Foreign Application Priority Data

Jan. 28, 2000 (JP) ..... P-2000-020775

(51) Int. Cl.[7] ..... G03C 5/305; G03C 7/413
(52) U.S. Cl. ..... 430/486; 430/933
(58) Field of Search ..... 430/486, 933

(56) References Cited

FOREIGN PATENT DOCUMENTS

| | | |
|---|---|---|
| JP | A-6-329936 | 11/1994 |
| JP | A-6-332127 | 12/1994 |
| JP | 09-211821 A | 8/1997 |
| JP | 11-194460 A | 7/1999 |

*Primary Examiner*—Hoa Van Le
(74) *Attorney, Agent, or Firm*—Sughrue Mion, PLLC

(57) ABSTRACT

A processing composition for a silver halide photographic material, which comprises at least one compound selected from the group consisting of compounds represented by the following general formulae (I) and (II):

(I)

(II)

10 Claims, No Drawings

PHOTOGRAPHIC PROCESSING COMPOSITION CONTAINING A DIAMINOSTILBENE DERIVATIVE AND IMAGE FORMING METHOD USING THE SAME

FIELD OF THE INVENTION

The present invention relates to processing compositions for silver halide photographic materials and image forming methods using the same, and, in particular, to such compositions and methods that can effectively suppress stain generation caused by spectral sensitizing dyes remaining in the photographic materials after processing, and that do not form precipitates even when the processing compositions are kept under low temperature storage conditions.

BACKGROUND OF THE INVENTION

In the rapid progress of digital still cameras as well as various color printers, the processing of silver halide color photographic materials are expected to provide customers with high quality images as quickly as possible. When the time of the conventional photographic processing is simply curtailed, spectral sensitizers used in photographic materials tend to remain after processing because the processing terminates before the sensitizers are completely washed out from the materials. In the case of color print, a noteciable amount of remaining sensitizers causes the background of the print images to assume color, thus deteriorating the print appearance to an unacceptable level. A similar problem takes place for the highlights of color reversal films with a simple curtailing of processing time. In color negative films, the minimum density levels tend to rise, causing color balance to collapse to such a degree that favorable prints cannot be obtained.

Research Disclosure (RD) 20733 describes a method using bis(triazinylamino)stilbene disulfonic acid compounds to effectively remove stains caused by spectral sensitizers. This method is now in a wide use for the processing of color photographic materials. JP-A-6-329936 (the term "JP-A" as used herein means an "unexamined published Japanese patent application") discloses bis-triazynyldiaminostilbene disulfonic acid compounds that can suppress stains even in rapid processing.

Recently, however, a still more concentrated processing compositions are strongly demanded to reduce container waste, improve container recyclability, reduce transportation and storage costs, etc. There have been no compounds that stably dissolve at a high salt concentration and that, when used in their solubility limit, exhibit a sufficient effect at rapid processing.

SUMMARY OF THE INVENTION

The purpose of the present invention is to provide processing compositions for silver halide color photographic materials, wherein the compositions can effectively prevent stain formation caused by residual spectral sensitizers and the compositions do not form precipitate under low temperature storage conditions.

Another purpose of the present invention is to provide methods of forming photographic images which can suppress stain generation by using processing compositions that do not form precipitate under low temperature storage conditions.

The above-mentioned problems have been solved by the following present invention.

(1) A processing composition for a silver halide photographic material, which comprises at least one compound selected from the group consisting of compounds represented by the following general formulae (I) and (II):

(I)

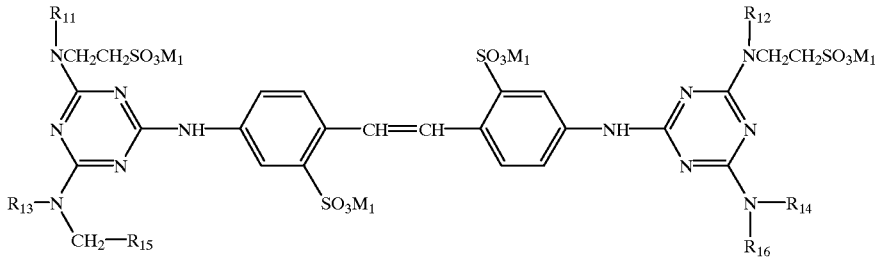

wherein $R_{11}$ and $R_{12}$ each independently represents a hydrogen atom or an alkyl group; $R_{13}$ and $R_{14}$ each independently represents a hydrogen atom, an alkyl group or an aryl group; $R_{15}$ represents an alkyl group having at least one asymmetric carbon atom or a group represented by the following general formula (I-a):

$$—CH_2O(CH_2CH_2O)n_{11}H \quad \text{(I-a)}$$

wherein $n_{11}$ represents an integer of from 1 to 3; $R_{16}$ represents an alkyl group having at least one asymmetric carbon atom or a group represented by the following general formula (I-b):

$$—(CH_2CH_2O)n_{12}H \quad \text{(I-b)}$$

wherein $n_{12}$ represents an integer of from 2 to 4; and $M_1$ represents a hydrogen atom, an alkali metal atom, an alkaline earth metal atom, an ammonium group or a pyridinium group, $R_{13}$ may complete a ring together with $R_{15}$, and $R_{14}$ may complete a ring together with $R_{16}$, respectively:

(II)

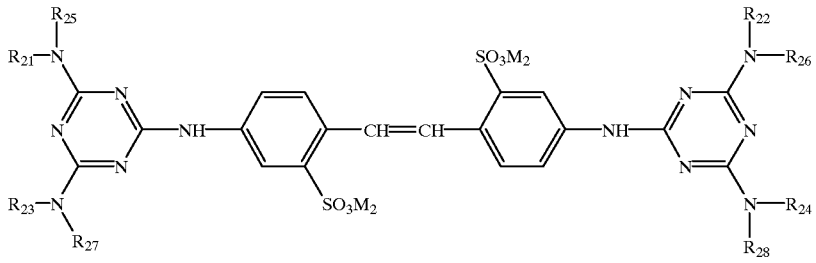

wherein $R_{21}$, $R_{22}$, $R_{23}$ and $R_{24}$ each independently represents a hydrogen atom, an alkyl group or an aryl group; $R_{25}$ and $R_{26}$ each independently represents an alkyl group having at least one asymmetric carbon atom or a group-represented by the following general formula (II-a):

$$—(CH_2CH_2O)n_{21}H \quad \text{(II-a)}$$

wherein $n_{21}$ represents an integer of from 2 to 4; $R_{27}$ and $R_{28}$ each independently represents an alkyl group having at least one asymmetric carbon; and $M_2$ represents a hydrogen atom, an alkali metal atom, an alkaline earth metal atom, an ammonium group or a pyridinium group; and $R_{21}$ and $R_{25}$, $R_{22}$ and $R_{26}$, $R_{23}$ and $R_{27}$, and $R_{24}$ and $R_{28}$, each pair may be bonded together to form a ring.

(2) The processing composition described in (1) above, wherein the composition contains at least one of the compound represented by general formula (I) in which $R_{15}$ and/or $R_{16}$ contains at least one hydroxyl group and the compound represented by general formula (II) in which at least one group chosen from $R_{25}$, $R_{26}$, $R_{27}$ and $R_{28}$ contains at least one hydroxyl group.

(3) The processing composition described in (2) above, wherein the at least one of the compound represented by general formula (I) and the compound represented by general formula (II) has 2 to 8 hydroxyl groups.

(4) The processing composition described in (3) above, wherein $R_{11}$, $R_{12}$, $R_{13}$ and $R_{14}$ in general formula (I) and/or $R_{21}$, $R_{22}$, $R_{23}$ and $R_{24}$ in general formula (II) each is a hydrogen atom.

(5) The processing composition described in (1) above, wherein the compound represented by general formula (I) is selected from the group consisting of the following compounds:

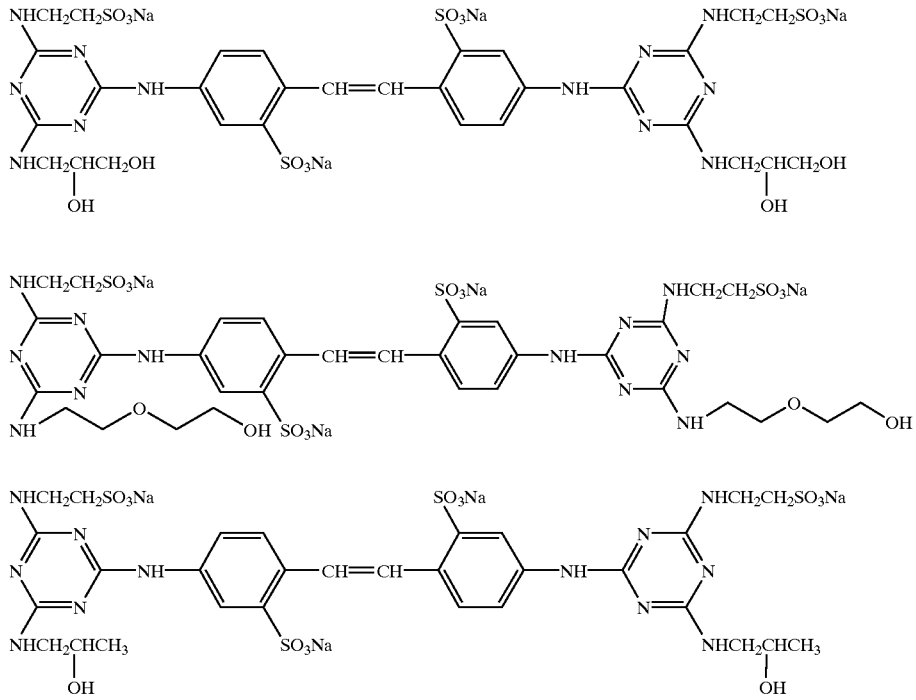

and the compound represented by general formula (II) is selected from the group consisting of the following compounds:

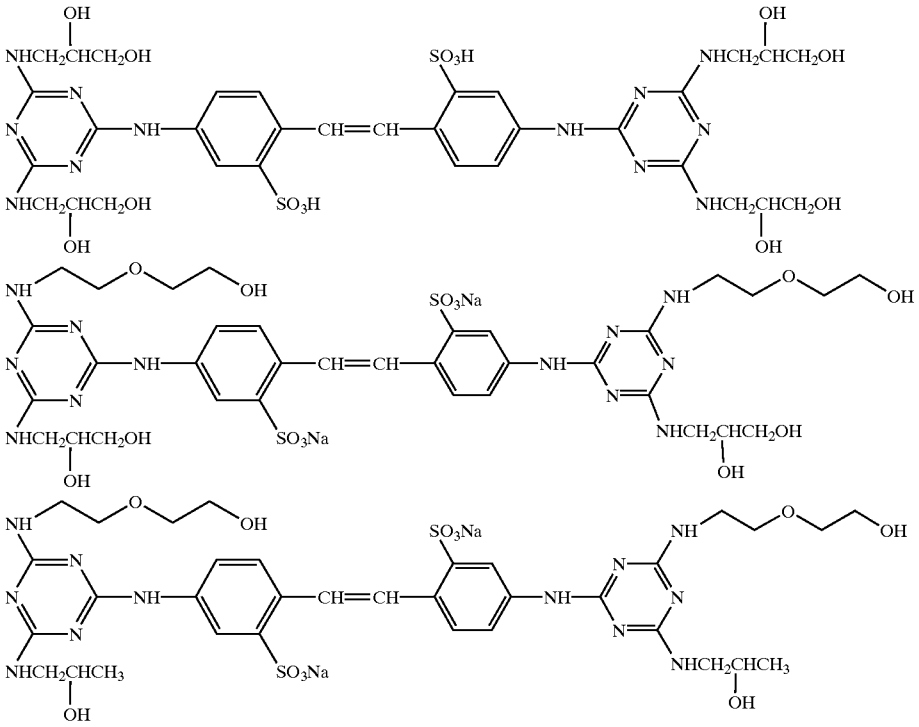

(6) The processing composition described in any one of (1) to (5) above, that is a color developer composition.

(7) The processing composition described in any one of (1) to (6) above, that has a pH of from 12 to 13.5.

(8) The processing composition described in any one of (1) to (7) above, that is a one-part color developer composition.

(9) An image forming method comprising using the processing composition described in any one of (1) to (8) above.

(10) A method for reducing stain caused by residual sensitizing dyes in silver halide photographic materials, which comprises using the processing composition described in any one of (1) to (8) above.

Among the compounds of the present invention, the structure represented by general formula (I) is involved in the claims of JP-A-6-332127, JP-A-7-140625 and JP-A-10-104809. However, these specifications do not specify the specific compounds corresponding to those of the present invention at all. Therefore, it is impossible to predict the structures and properties of the compounds of the present invention from these patent documents.

DETAILED DESCRIPTION OF THE INVENTION

General formulae (I) and (II) will be explained more in detail.

The alkyl groups represented by $R_{11}$ and $R_{12}$ are preferably of $C_{1-20}$, more preferably of $C_{1-8}$, and still more preferably of $C_{1-4}$; they may be substituted or unsubstituted. The substituents include a hydroxyl group, an alkoxy group (e.g., methoxy, ethoxy, etc.), a sulfonic acid group, an ethyleneoxy group, etc. These groups may be further substituted with the groups mentioned above. Practical examples of the alkyl groups represented by $R_{11}$ and $R_{12}$ are methyl, ethyl, n-propyl, iso-propyl, n-octyl, 2-hydroxyethyl, 3-hydroxypropyl, 2-hydroxypropyl, 2-sulfoethyl, 2-methoxyethyl, 2-(2-hydroxyethoxy)ethyl, and 2-[2-(2-hydroxyethoxy)ethoxy]ethyl, and 2-(2-[2-(2-hydroxyethoxy)ethoxy]ethoxy)ethyl. Preferable examples of $R_{11}$ and $R_{12}$ are hydrogen, methyl, ethyl, n-propyl, n-butyl and 2-sulfoethyl, and more preferable ones are hydrogen, methyl, ethyl, and 2-sulfoethyl while the most preferable ones are hydrogen and methyl.

The preferable numbers of carbon atom, the preferable substituents, the practical examples for the alkyl groups represented by $R_{13}$, $R_{14}$, $R_{21}$, $R_{22}$, $R_{23}$ and $R_{24}$ are all common to those for the groups represented as $R_{11}$ and $R_{12}$, except that $R_{21}$ and $R_{22}$ each never represents $—CH_2CH_2SO_3M_1$ in which $M_1$ has the same meaning as in general formula (I). The aryl groups represented by $R_{13}$, $R_{14}$, $R_{21}$, $R_{22}$, $R_{23}$ and $R_{24}$ are preferably of $C_{6-20}$, more preferably of $C_{6-10}$, still more preferably of $C_{6-8}$: they may be substituted or unsubstituted. The substituents include hydroxy, alkoxy (e.g., methoxy, ethoxy, etc.), carboxy, alkyl (e.g., methyl, ethyl, propyl, etc.), sulfonyl, amino, carbamoyl, etc. These substituents may further be substituted with the same groups cited above. Practical examples of the aryl groups represented by $R_{13}$, $R_{14}$, $R_{21}$, $R_{22}$, $R_{23}$ and $R_{24}$ include phenyl, naphthyl, 3, 5-dicarboxyphenyl, 4-methoxyphenyl and 3-isopropylphenyl. More preferable groups are hydrogen, methyl, ethyl, n-propyl, 2-hydroxyethyl, 3-hydroxypropyl, 2-hydroxypropyl, 2-sulfoethyl, 2-(2-hydroxyethoxy)ethyl or 2-[2-(2-hydroxyethoxy) ethoxy]ethyl, and still more preferably they are hydrogen, methyl, ethyl, 2-hydroxyethyl, 2-hydroxypropyl or 2-(2-hydroxyethoxy)ethyl. The most preferable examples are hydrogen and methyl.

The alkyl group represented by $R_{15}$ having at least one asymmetric carbon atom is preferably of $C_{1-20}$, more preferably of $C_{1-8}$ and particularly preferably of $C_{1-4}$ with straight, branched or circular chains. The preferable substituents include hydroxy, amino, carboxyl, etc., the most preferable one being hydroxy. Some practical examples for the alkyl group represented by $R_{15}$ having at least one asymmetric carbon atom are shown below.

1)

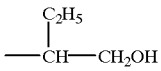

2)

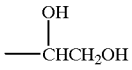

3)

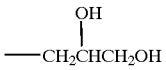

4)

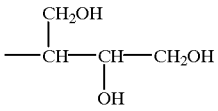

5)

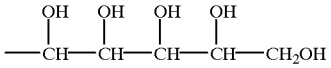

6)

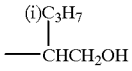

7)

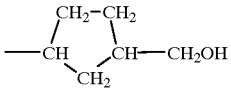

8)

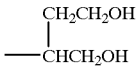

9)

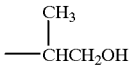

10)

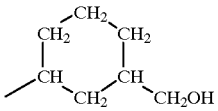

11)

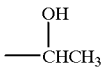

12)

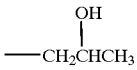

13)

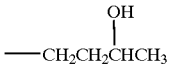

14)

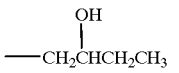

15)

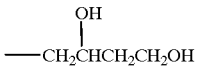

Among these formulae, preferable alkyl groups represented by $R_{15}$ having at least one asymmetric carbon are 2), 3), 5) 8), 9) and 11), and more preferable ones are 2), 5) and 11). Further, when $R_{15}$ is represented by the following general formula (I-a), $n_{11}$ is preferably 1 or 2 and more preferably 1.

$$—CH_2O(CH_2CH_2O)n_{11}H \qquad \text{(I-a)}$$

The alkyl groups represented by $R_{16}$, $R_{25}$, $R_{26}$, $R_{27}$ and $R_{28}$ having at least one asymmetric carbon are preferably of $C_{1-20}$, more preferably of $C_{1-9}$, and still more preferably of $C_{1-5}$; their chain structures may be straight, branched or circular. Preferable substituents are common to those mentioned for $R_{15}$; one of the preferable groups being hydroxy. Some practical examples of the alkyl groups represented by $R_{16}$, $R_{25}$, $R_{26}$, $R_{27}$ and $R_{28}$ having at least one asymmetric carbon are shown below.

16)

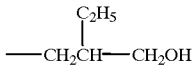

17)

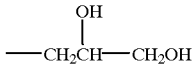

18)

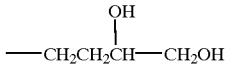

19)

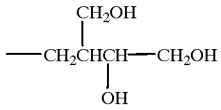

20)

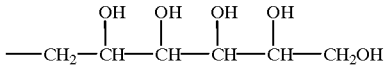

21)

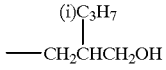

22)

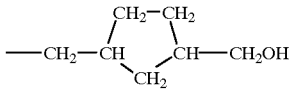

23)

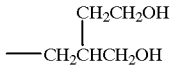

24)

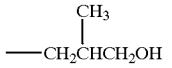

25)

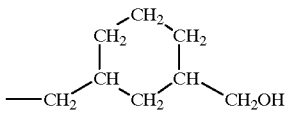

26)

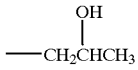

-continued

27)

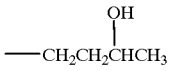

28)

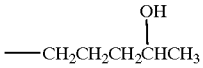

29)

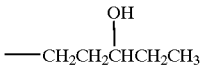

30)

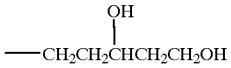

Among these alkyl groups represented by $R_{16}$, $R_{25}$, $R_{26}$, $R_{27}$ and $R_{28}$ having at least one asymmetric carbon, preferable ones are 17), 18), 20), 23), 24) and 26), and more preferable ones are 17), 20) and 26). When $R_{16}$ is represented by the following general formula (I-b), $n_{12}$ is preferably 2 or 3, and is more preferably 2.

$$—(CH_2CH_2O)n_{12}H \quad \text{(I-b)}$$

When $R_{25}$ and $R_{26}$ are those represented by the following general formula (II-a) $n_{21}$ is preferably 2 or 3, and more preferably 2.

$$—(CH_2CH_2O)n_{21}H \quad \text{(II-a)}$$

Among the alkali and alkaline earth metal atoms represented by $M_1$ and $M_2$, particularly preferable ones are Na and K. Tetra-alkyl ammonium such as tetraethyl ammonium and tetrabutyl ammonium is preferred as ammonium group. The most preferable metals for $M_1$ and $M_2$ are Na and K.

Among the compounds represented by general formula (I) those in which at least either of $R_{15}$ and $R_{16}$ includes at least one hydroxyl group are preferred. In general formula (II), at least one group among $R_{25}$ to $R_{28}$ should preferably have at least one hydroxyl group, too.

The most preferable compounds represented by general formula (I) are those as follows; each of $R_{11}$, $R_{12}$, $R_{13}$ and $R_{14}$ is hydrogen or methyl, $R_{15}$ is an alkyl represented by 2), 5) or 11) mentioned above, nil in formula (I-a) is one, $R_{16}$ is an alkyl shown in 17), 20) or 26) mentioned above, $n_{12}$ in formula (I-b) is 2, and $M_1$ is Na or K. On the other hand, the most preferable compounds represented by general formula (II) are the following ones; each of $R_{21}$, $R_{22}$, $R_{23}$ and $R_{24}$ is hydrogen or methyl, $R_{25}$ and $R_{26}$ each is alkyl shown in 17), 20) or 26) cited above, $n_{21}$ in formula (II-a) is 2, $R_{27}$ and $R_{28}$ each is alkyl shown in 17), 20) or 26), and $M_2$ is Na or K.

As the compounds used in the present invention contain plural asymmetric carbon atoms in the molecular structure, a number of steric isomers exist for a structural formula. The present invention covers every possible steric isomer. Only one isomer or mixtures of existing steric ones may be used.

In the present invention, together with the compounds represented by general formulae (I) and (II), plural kinds of additional diaminostilbene compounds may be used. As such additional compounds, the diaminostilbenes represented by general formula [III] disclosed in JP-A-6-329936 are preferred.

Further, diaminostilbene compounds additionally used in the present invention include known or commercially available diaminostilbene type fluorescent whitening agents. Some commercially available compounds are described in, for example, pp. 165 to 168 of Senshoku Note (Dyeing Note), 19$^{th}$ Edition (Shikisensya Co., Ltd.). Among those described there, Blankophor BSU liq and Hakkol BRK (both being product names) are preferred.

In the following, representative examples of the compounds represented by general formulae (I) and (II) that are suited for the present invention are listed where Me and Et mean methyl and ethyl group, respectively.

I-1)

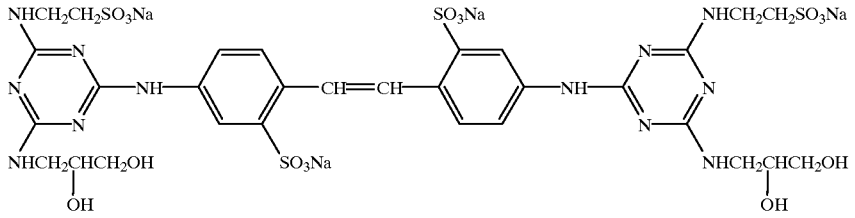

I-2)

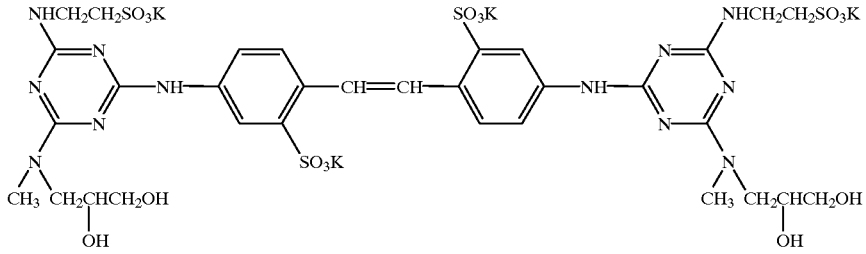

-continued
I-3)
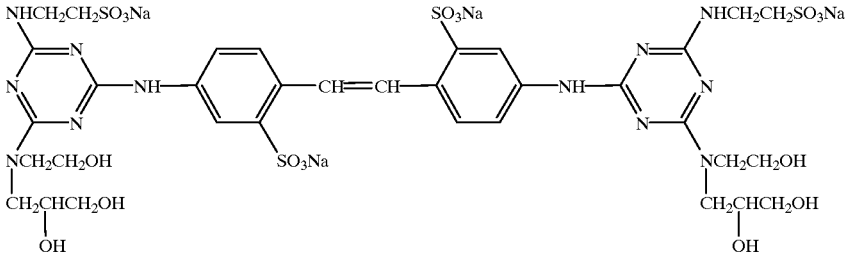
I-4)
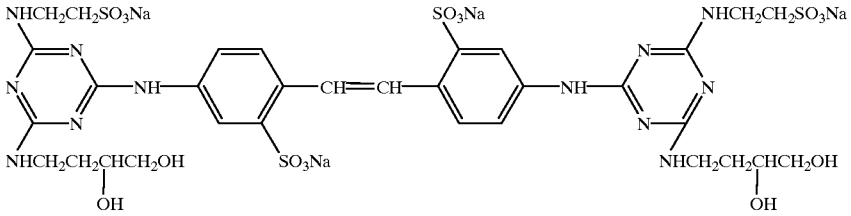
I-5)
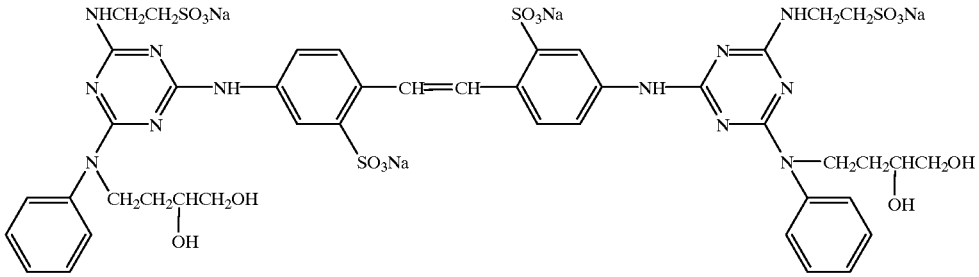
I-6)
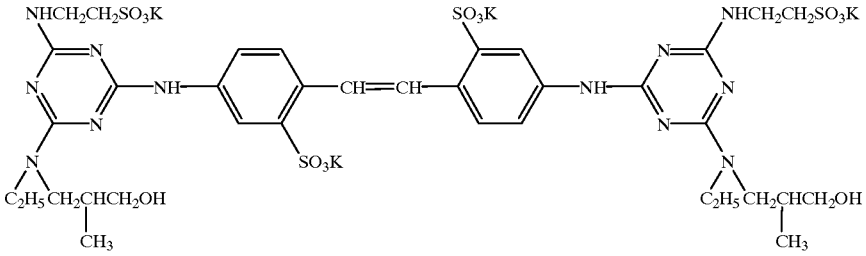
I-7)
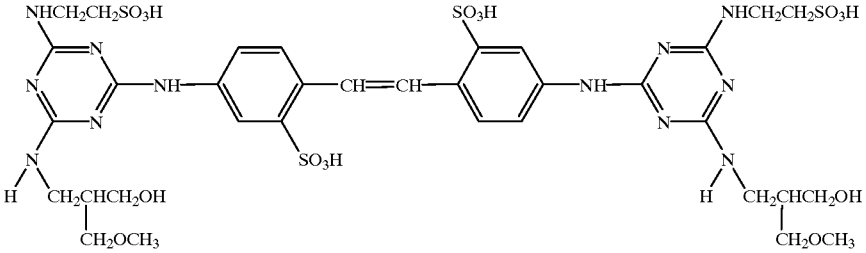
I-8)
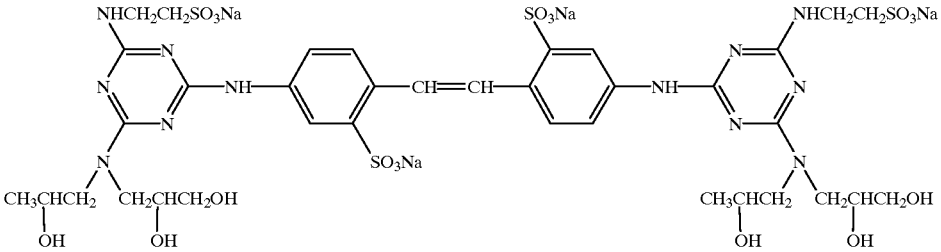

-continued
I-9)
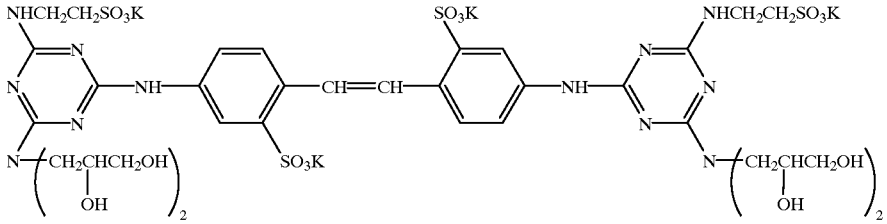
I-10)
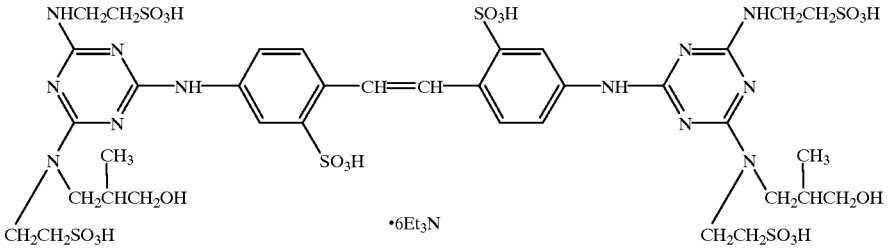
I-11)
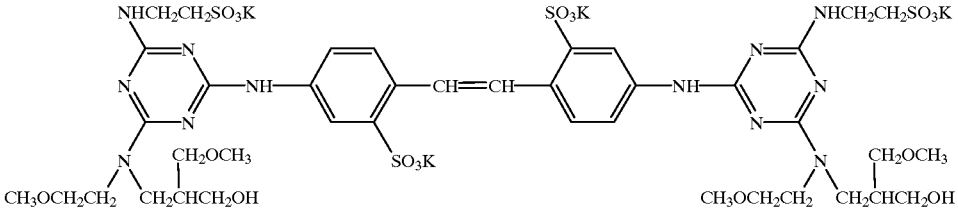
I-12)
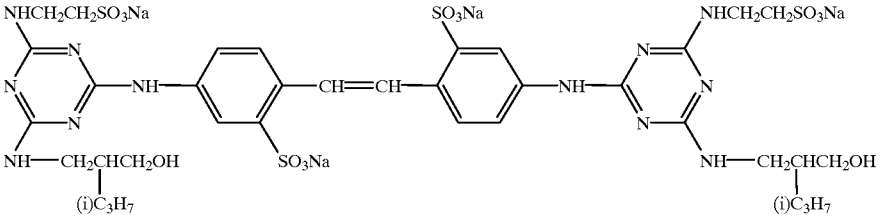
I-13)
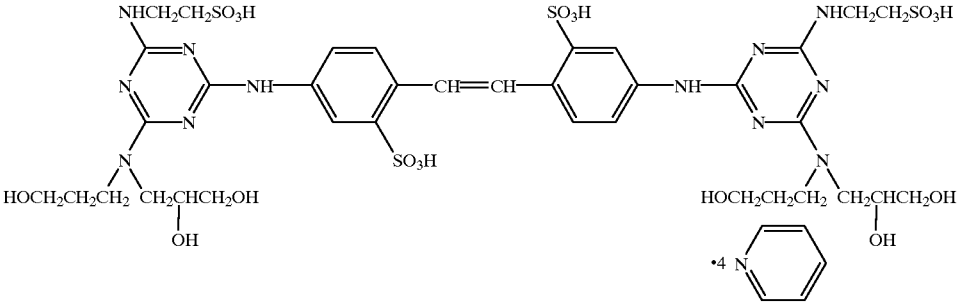
I-14)
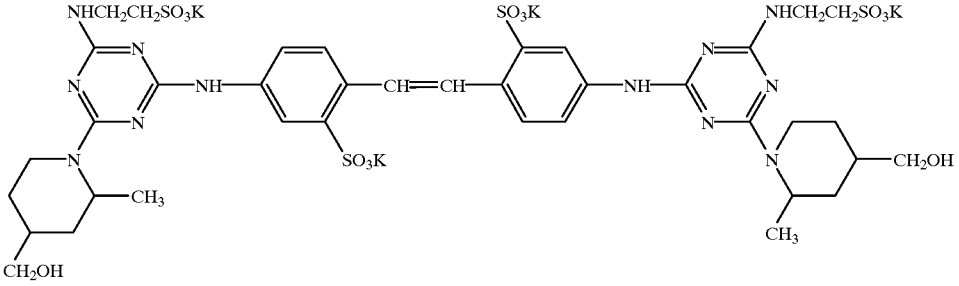

-continued
I-15)
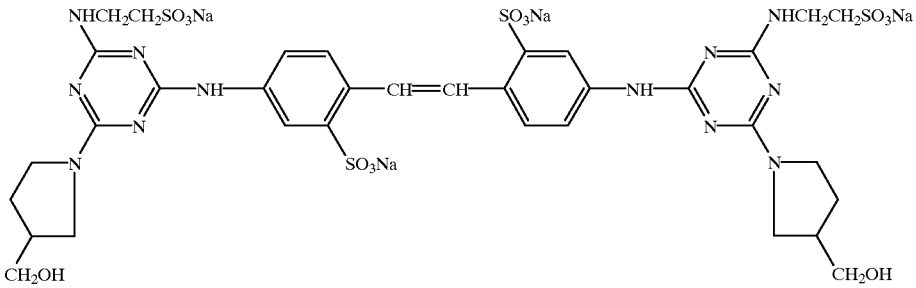
I-16)
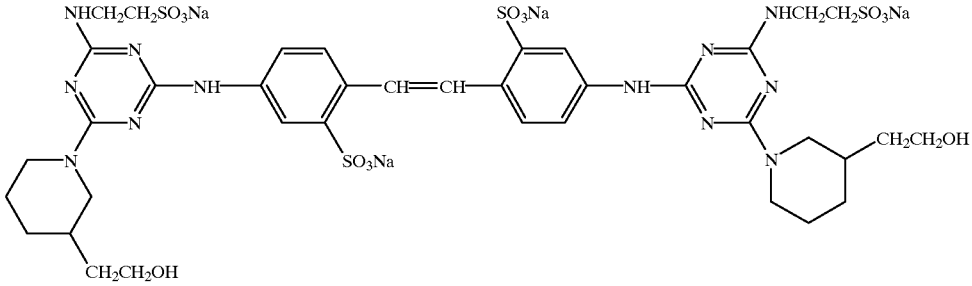
I-17)
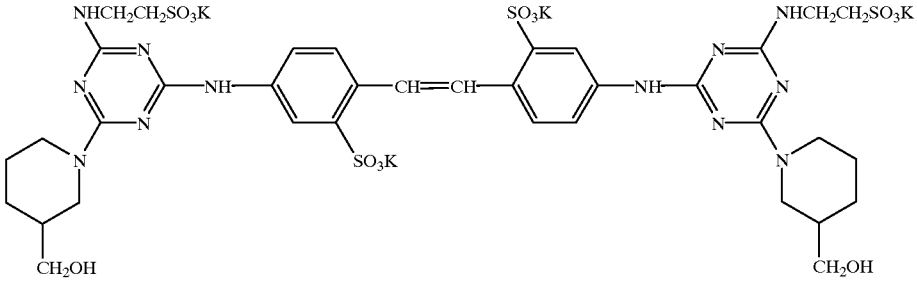
I-18)
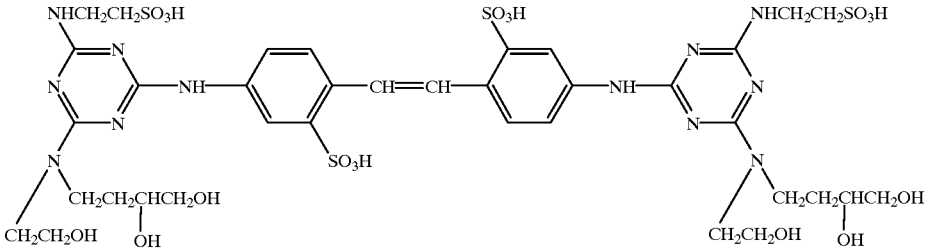
I-19)
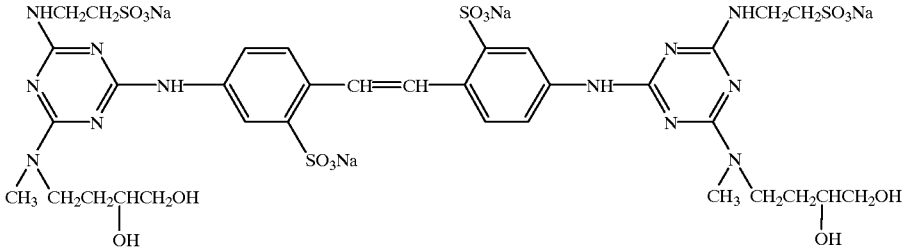
I-20)
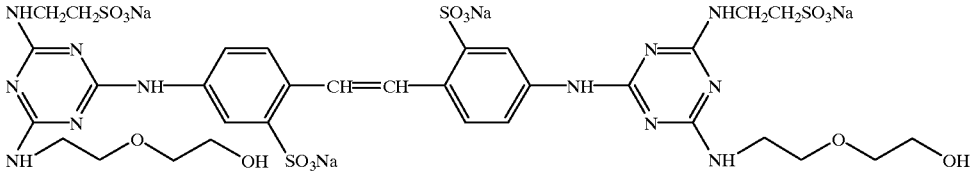

-continued
I-21)
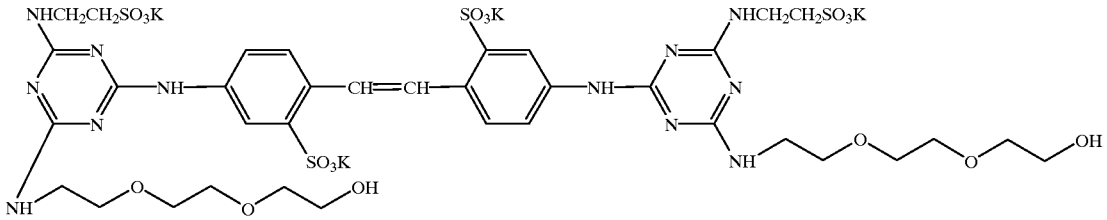
I-22)
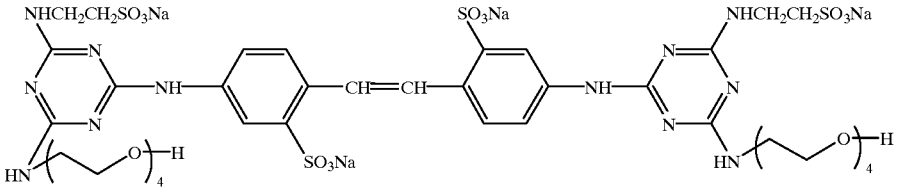
I-23)
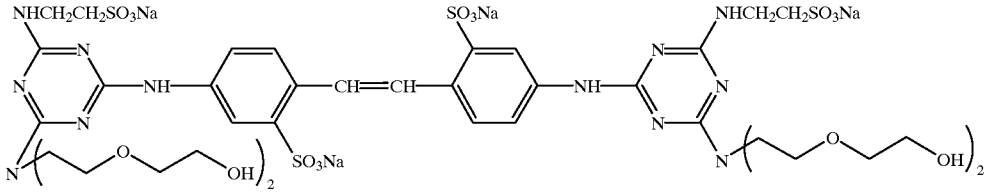
I-24)
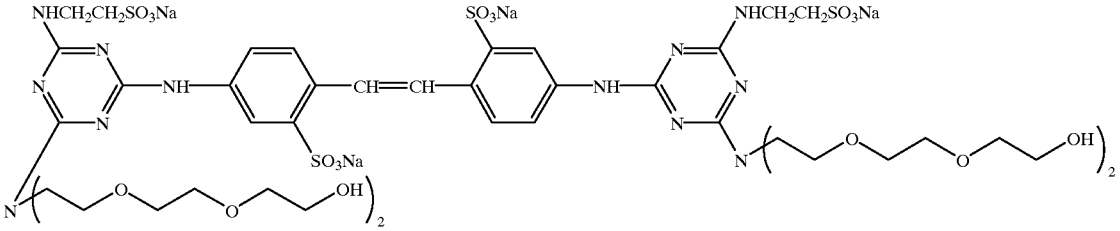
I-25)
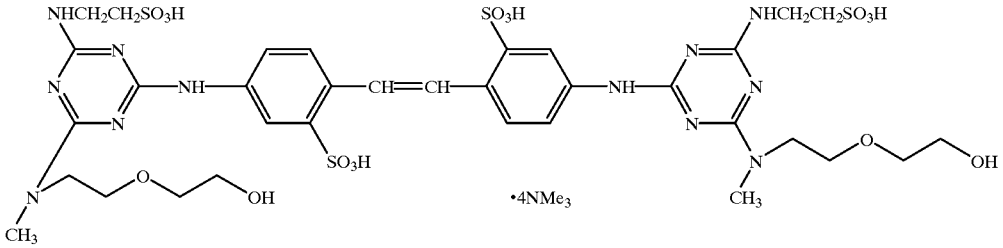
I-26)
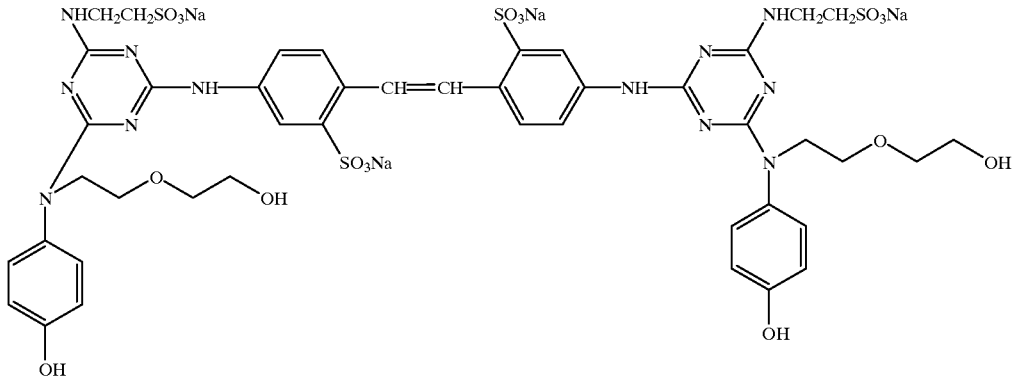

-continued
I-27)
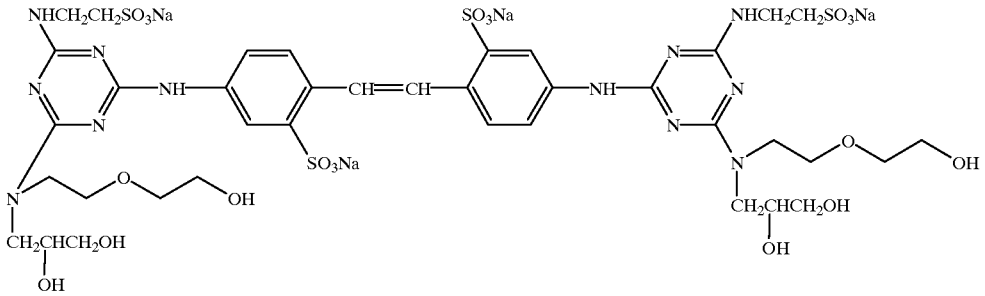
I-28)
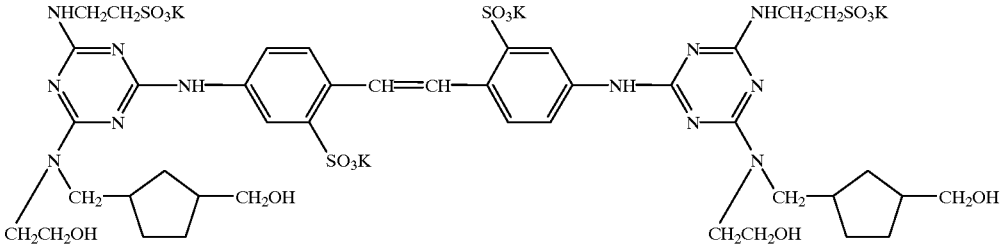
I-29)
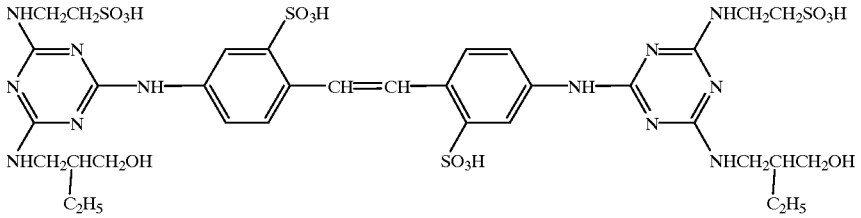
I-30)
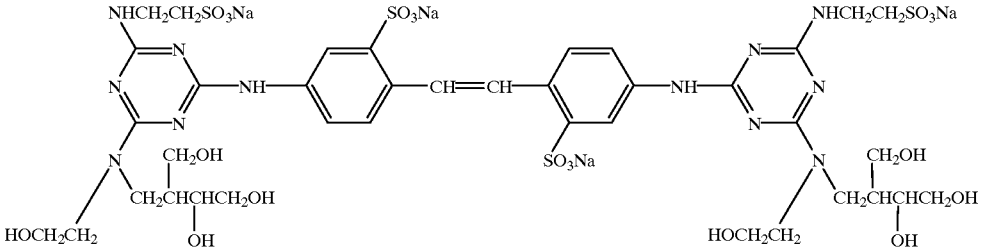
I-31)
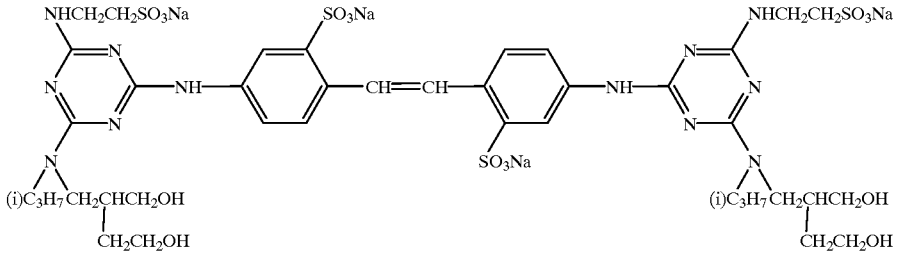
I-32)
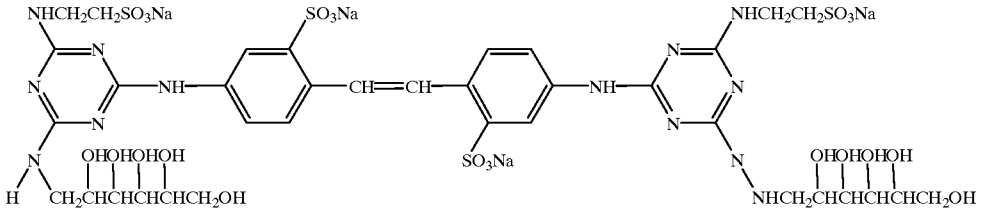

-continued
I-33)
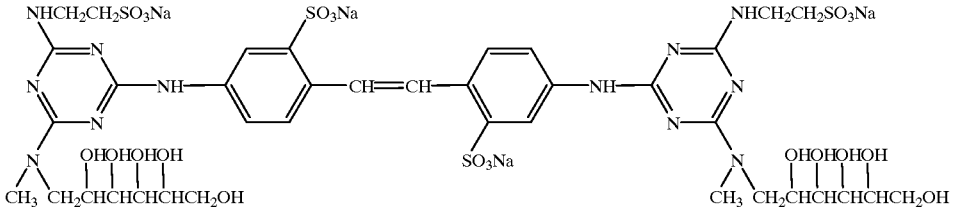
I-34)
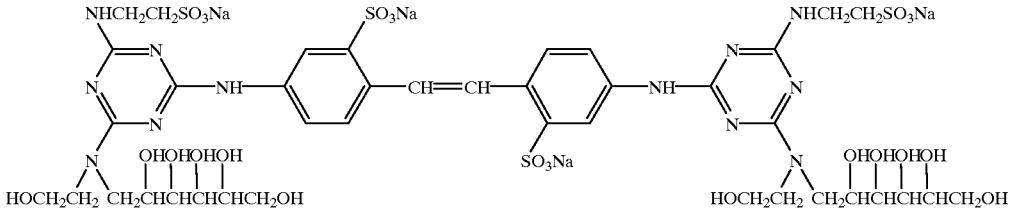
I-35)
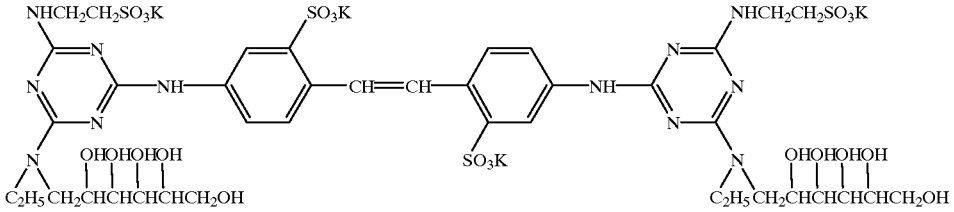
I-36)
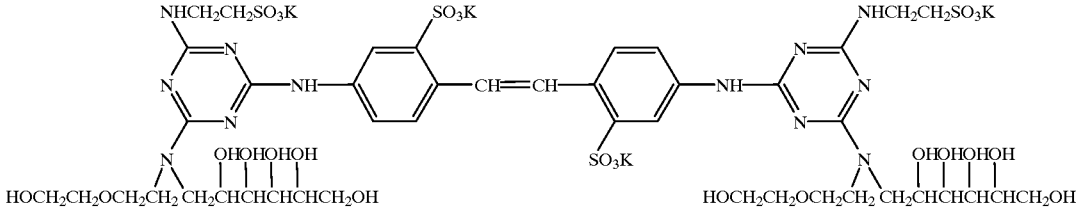
I-37)
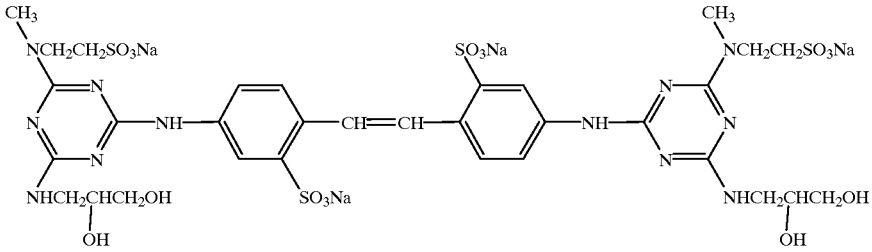
I-38)
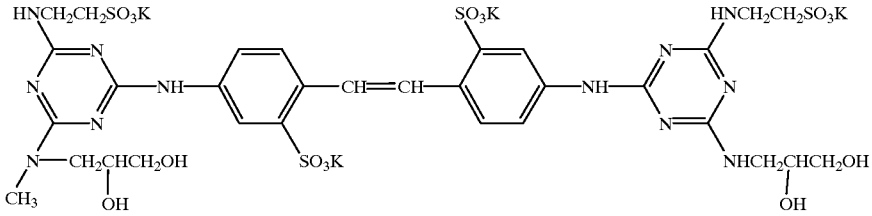

-continued
I-39)
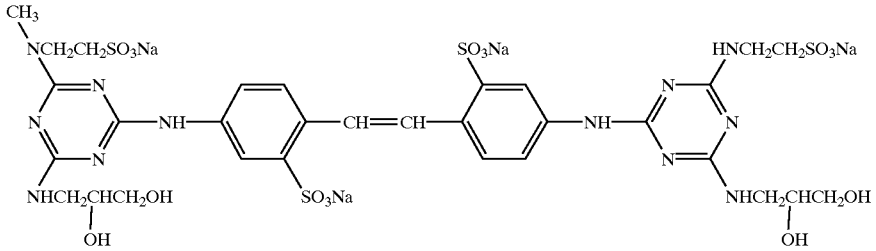
I-40)
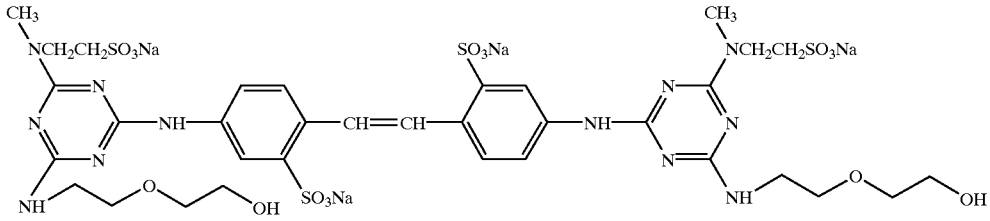
I-41)
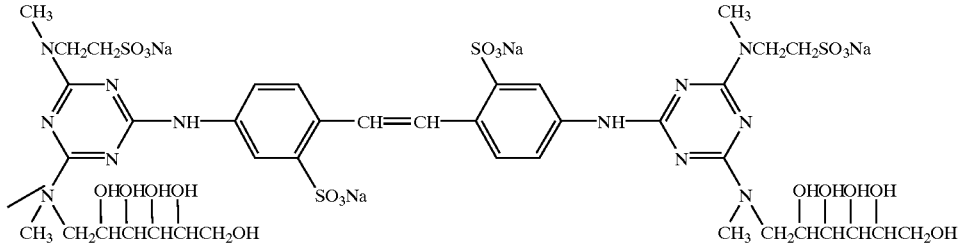
I-42)
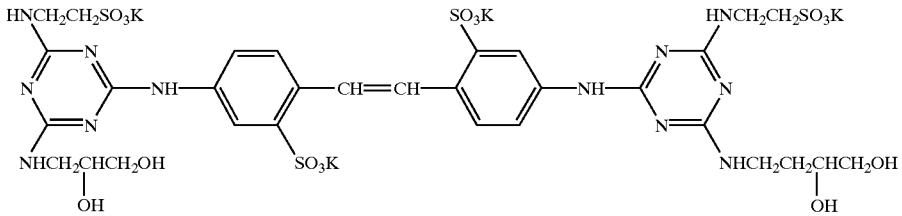
I-43)
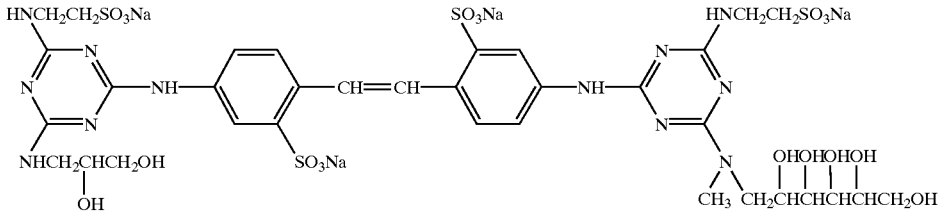
I-44)
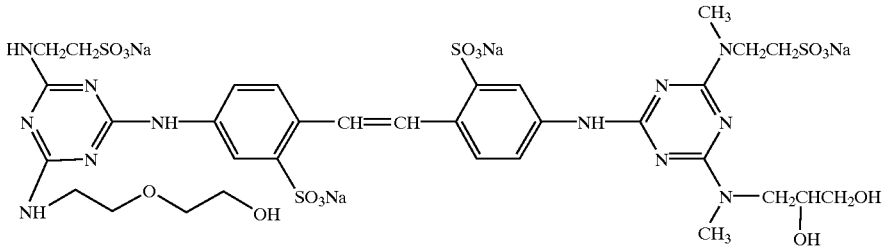

-continued
I-45)
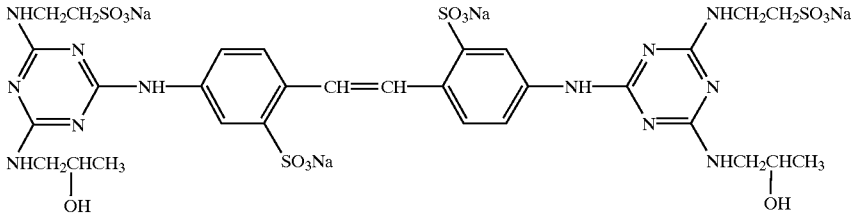
I-46)
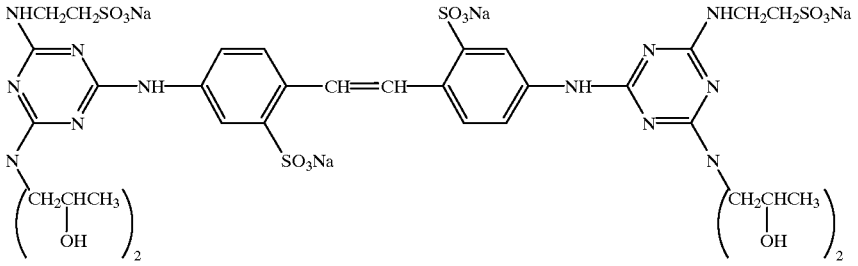
I-47)
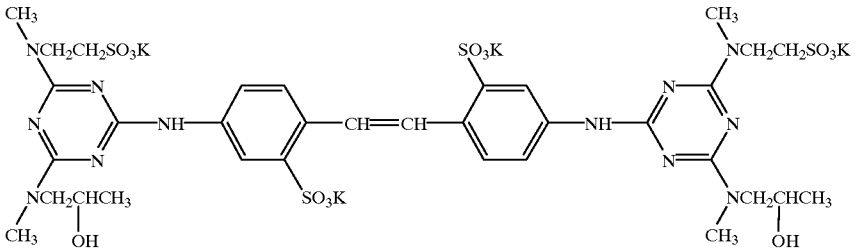
I-48)
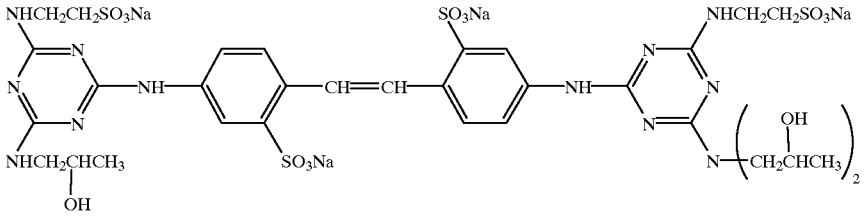
II-1)
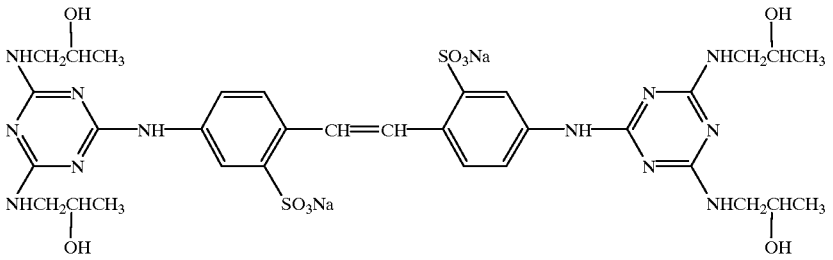
II-2)
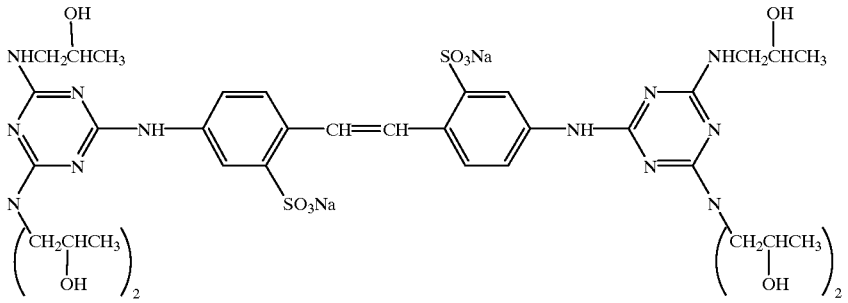

-continued
II-3)
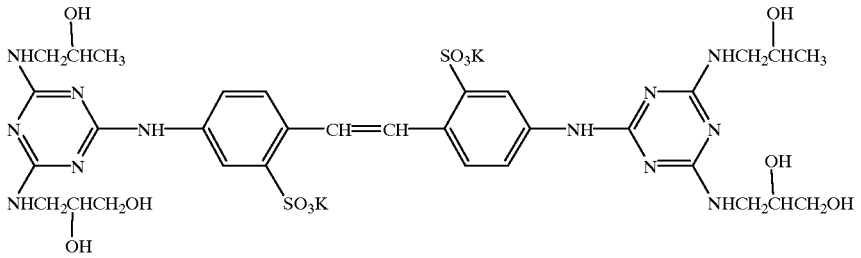
II-4)
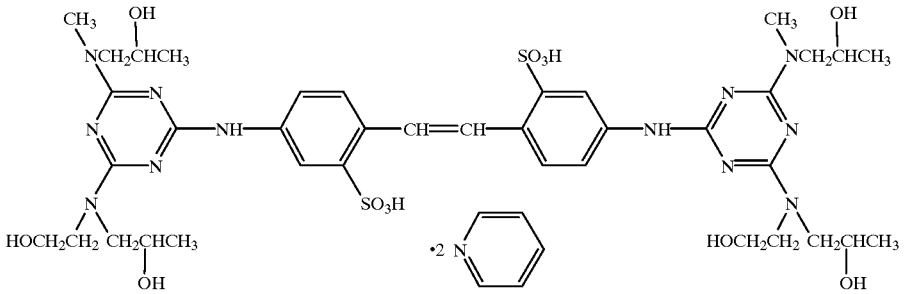
II-5)
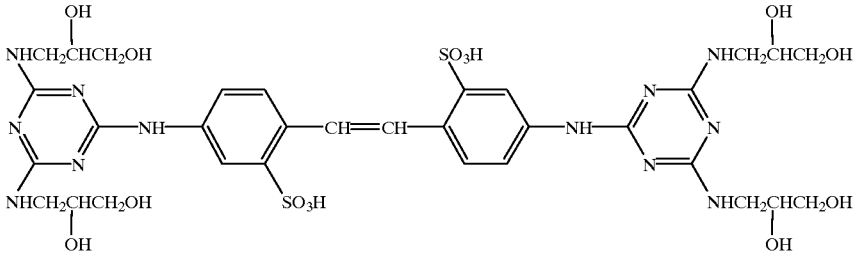
II-6)
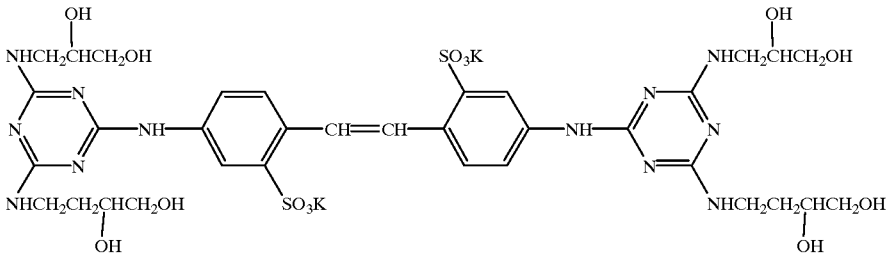
II-7)
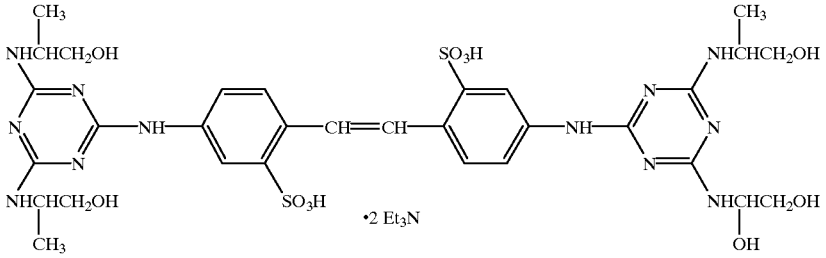

-continued
II-8)
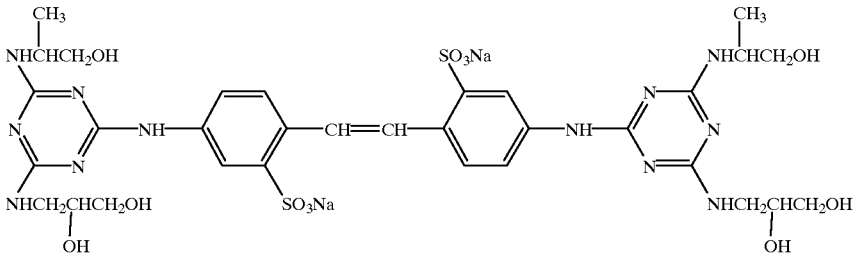
II-9)
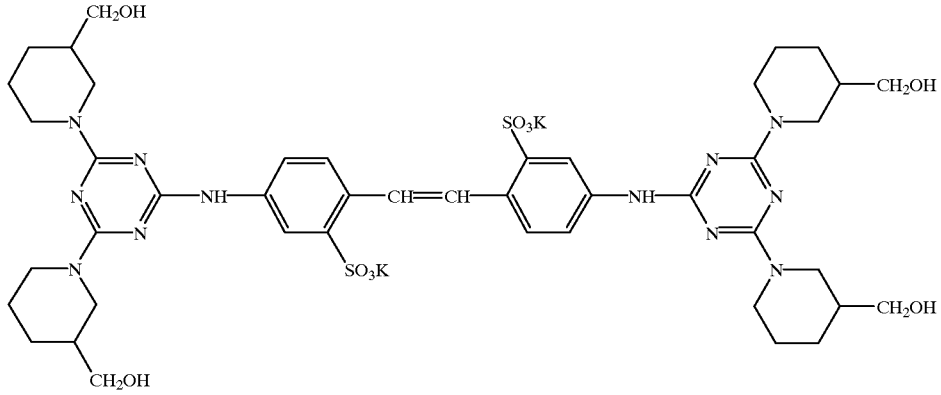
II-10)
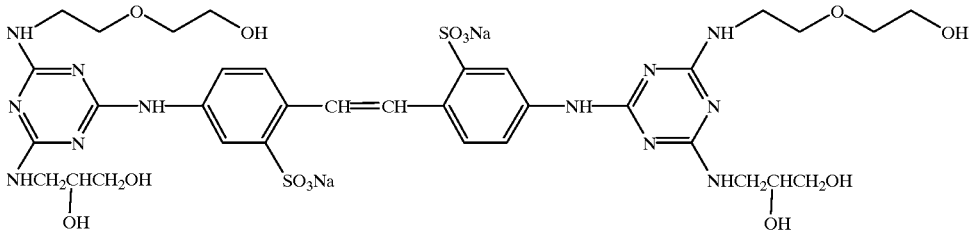
II-11)
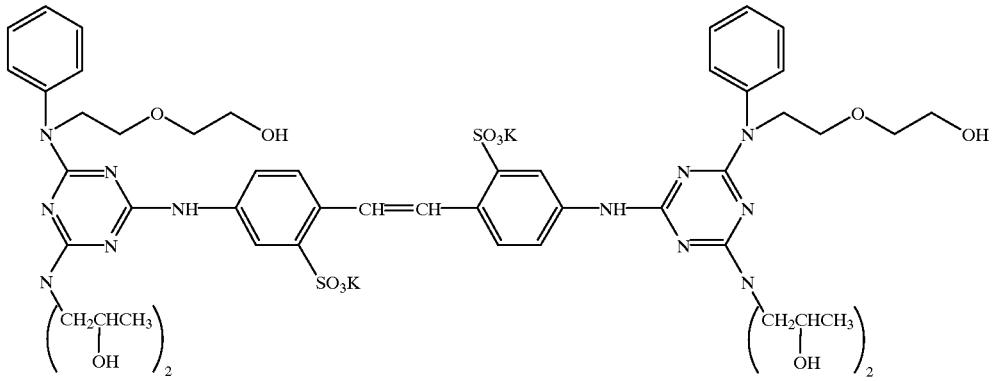
II-12)
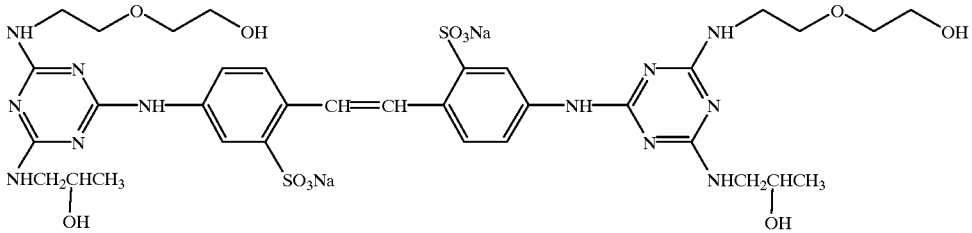

-continued

II-13)

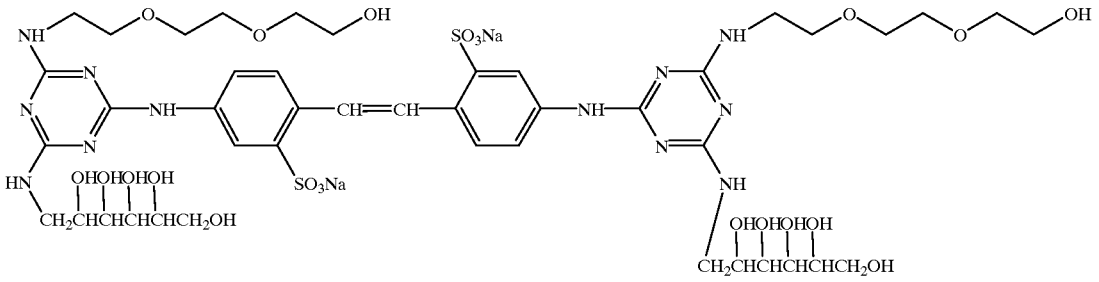

II-14)

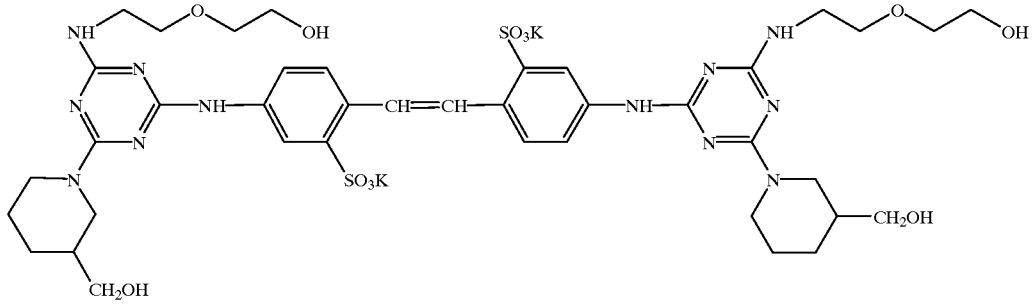

II-15)

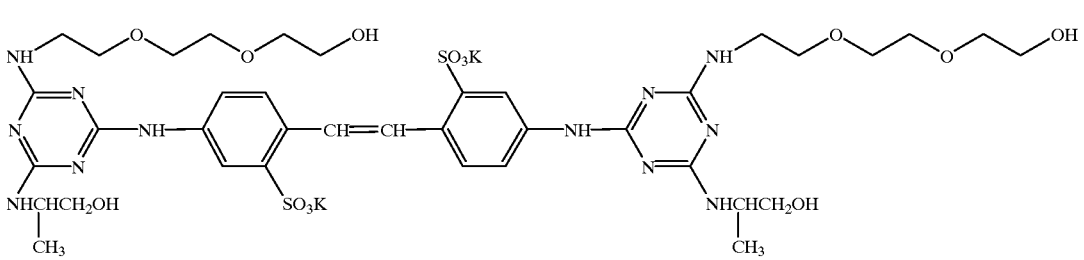

II-16)

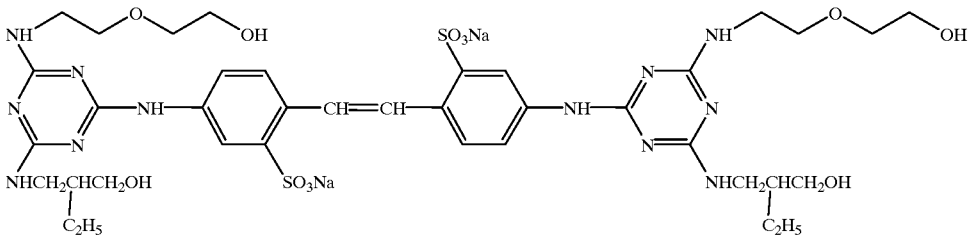

The compounds represented by general formula (I) or (II) can be synthesized by referring to the descriptions in the paper by Koji Matsui, published in *Yuki Gosei Kagaku Kyokai-shi* (*The Bulletin of Organic Synthesis Association*), Vol. 17, p. 528 (1959), and U.S. Pat. No. 2,618,748. Preferably, a diaminostilbene derivative is reacted first with cyanuryl chloride and then with an amine. Alternatively, it is desirable to make the dialkylaminostilbene derivative react finally. The solvent used for such reactions includes water and organic solvents such as alcohols, ketones, ethers, amides, etc. In particular, water, water-soluble organic solvents and their mixtures are preferred. The most preferable are mixed solvents of water and acetone. The base used for the synthesis include organic bases such as triethylamine, pyridine, 1,8-diazabicyclo[5,4,0]-7-undecene, etc., and inorganic bases such as sodium hydroxide, potassium hydroxide, sodium carbonate, potassium carbonate, sodium bicarbonate, sodium hydride, etc. Among them, inorganic bases, in particular, sodium hydroxide, potassium hydroxide, sodium carbonate and potassium carbonate are preferred. The reaction temperature can be set between −20 and 120° C. A preferable range is −10 to 90° C. In more detail, the preferable range is −10 to 10° C. for the first step, 0 to 40° C. for the second step, and 50 to 90° C. for the third step, respectively.

SYNTHESIS EXAMPLE 1

By following the reaction sequence described by the following chemical reactions, an exemplified compound (I-1) for the present invention was synthesized.

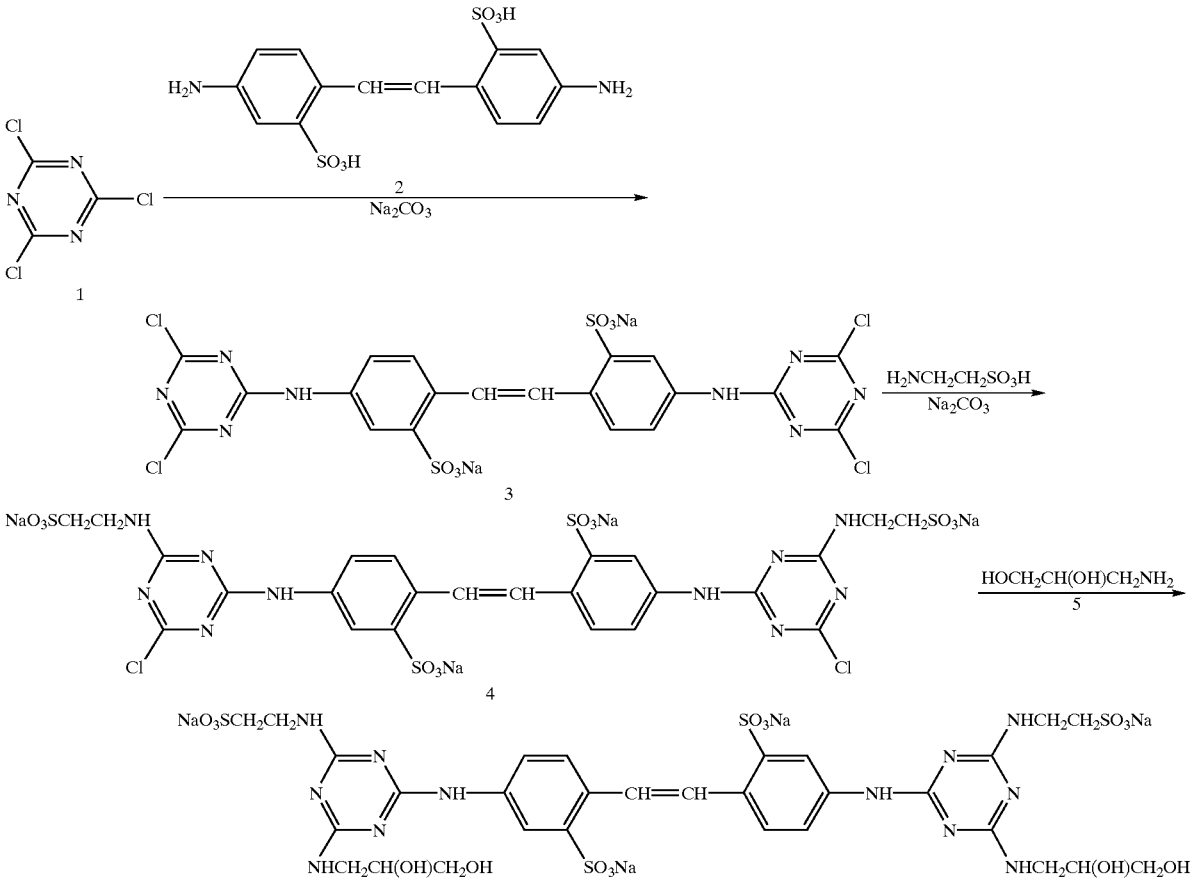

Exemplified Compound (I-1)

(Synthesis of Compound (3))

In a three neck flask, 103.5 g of compound (1) and 680 ml of acetone were charged. The system was cooled with an ice-acetone bath until the temperature of the content became −5° C. when a aqueous solution comprising 101.9 g of compound (2), 58.3 g of sodium carbonate and 960 ml of water was added drop-wise under stirring over the period of an hour. Then the temperature of the content was increased to −1° C. After the addition, the content was stirred for another hour with the ice-acetone bath removed to give rise to a crystalline deposit, which was filtered by suction to obtain the target-compound (3). The filtered product was used for the next procedure without drying and purification.

(Synthesis of Compound (4))

The compound (3) thus obtained and 1.9 liters of water were charged in a three neck flask placed in a water bath, to which 68.8 g of taurine was first added under stirring. Then, 58.3 g of sodium carbonate dissolved in 275 mL water was added drop-wise over the period of one hour. After the addition, the water bath was removed and stirring was continued for 3 hours. Then, 550 g of sodium chloride was added, and stirring was extended for another hour to form a crystalline deposit, which was filtered by suction to obtain the target compound (4). The filtered product was used for the next procedure without drying and purification.

(Synthesis of Exemplified Compound (I-1))

A three neck flask was charged with compound (4) obtained by the previous step and 825 ml of water. At room temperature, 125.3 g of compound (5) was added drop-wise in 10 min. After the addition, with keeping the inner temperature of the flask at 85° C., stirring was continued for 3 hours, and the resulting reaction mixture was concentrated with a rotary evaporator. At the point where the residual volume became about 800 mL, crystals began to deposit. The rotary evaporation was stopped, and the content was cooled by ice and subjected to stirring. The crystalline deposit was filtered by suction, and then dissolved in 1.5 L methanol. The solution was stirred for one hour under heat refluxing. When the solution was cooled to room temperature, the target exemplified compound (I-1) separated, which was filtered by suction to give 206.0 g of the target exemplified compound (I-1) (yield: 72%).

$\lambda_{max}(H_2O)=346.3\ nm\ (\epsilon=4.83\times10^4)$

The purity of the resulting product investigated with liquid chromatography proved to be 96.0%. The detailed conditions for liquid chromatography were as follows:

Column: TSK-gel ODS-80TM (a product of Tosoh Corporation)

Eluent: Liquid A To 1 L water, 20 mL PIC A reagent (a product of Waters Co.) was added.

Liquid B To the mixture of 800 mL methanol and 200 mL water, 20 mL PIC A reagent was added.

A gradient was applied so that Liquid A/Liquid B=50/50 (0 min.) 0/100 (35 min.)

Detection wavelength: 346 nm

The purity was calculated from the peak area recorded on the chart under the above conditions.

SYNTHESIS EXAMPLE 2

By following the reaction sequence described by the following chemical reactions, an exemplified compound (I-20) for the present invention was synthesized.

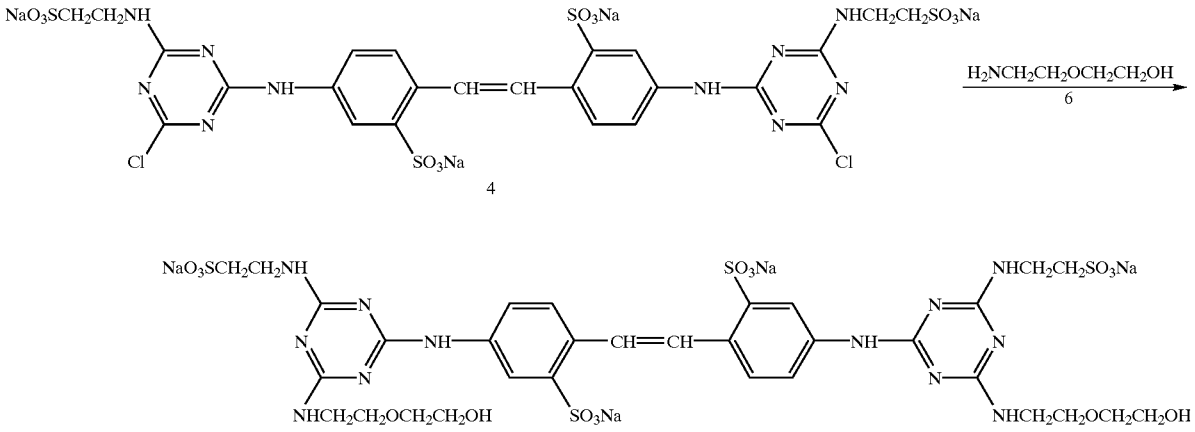

Exemplified Compound (I-20)

(Synthesis of Exemplified compound (I-20))

A three neck flask was charged with compound (4) that had been prepared in the same scale via the same procedures as those described in Synthesis Example 1 and 825 mL water. To the flask, 144.4 g of compound (6) was added dropwise in 10 min under stirring at room temperature. The content was stirred for 3 hours at 85° C. after the addition, and then condensed with a rotary evaporator until the volume be about 800 mL. Stirring was continued under ice cooling to cause crystals to separate. The crystalline deposit filtered by suction was dissolved in 1.5 L methanol and stirred for an hour under heat reflux. The solution was cooled to room temperature, and filtered by suction to obtain 249.7 g of the target exemplified compound (1–20) (yield: 85%).

$\lambda_{max}(H_2O)=354.5\ nm\ (\epsilon=4.92\times10^4)$

The purity of the target compound proved to be 97.3% with liquid chromatography carried out under the same conditions as in Synthesis Example 1.

SYNTHESIS EXAMPLE 3

By following the reaction scheme below, an exemplified compound (I-33) for the present invention was synthesized.

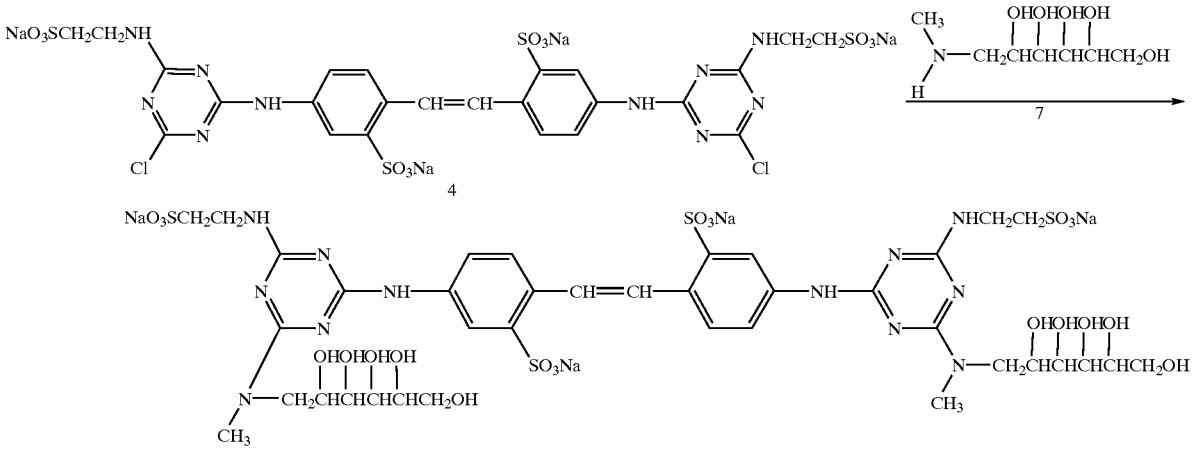

Exemplified Compound (I-33)

(Synthesis of Exemplified compound (I-33))

A three neck flask was charged with compound (4) that had been prepared in the same scale via the same procedures as those described in Synthesis Example 1 and 825 mL of water. To the flask, 268.5 g of compound (7) was added dropwise in 10 min under stirring at room temperature. The content was stirred for 3 hours at 85° C. after the addition, and then condensed with a rotary evaporator until the volume was reduced to about 900 mL. Stirring was continued under ice cooling to cause crystals to separate. The crystalline deposit filtered by suction was dissolved in 1.5 L methanol and stirred for an hour under heat reflux. The solution was cooled to room temperature, and then filtered by suction to obtain 302.4 g of the target exemplified compound (1–33) (yield: 88%).

$\lambda_{max}(H_2O)=348.6\ nm\ (\epsilon=4.36\times10^4)$

The purity of the target compound proved to be 96.1% with liquid chromatography carried out under the same conditions as in Synthesis Example 1.

SYNTHESIS EXAMPLE 4

By following the reaction scheme below, an exemplified compound (II-5) for the present invention was synthesized.

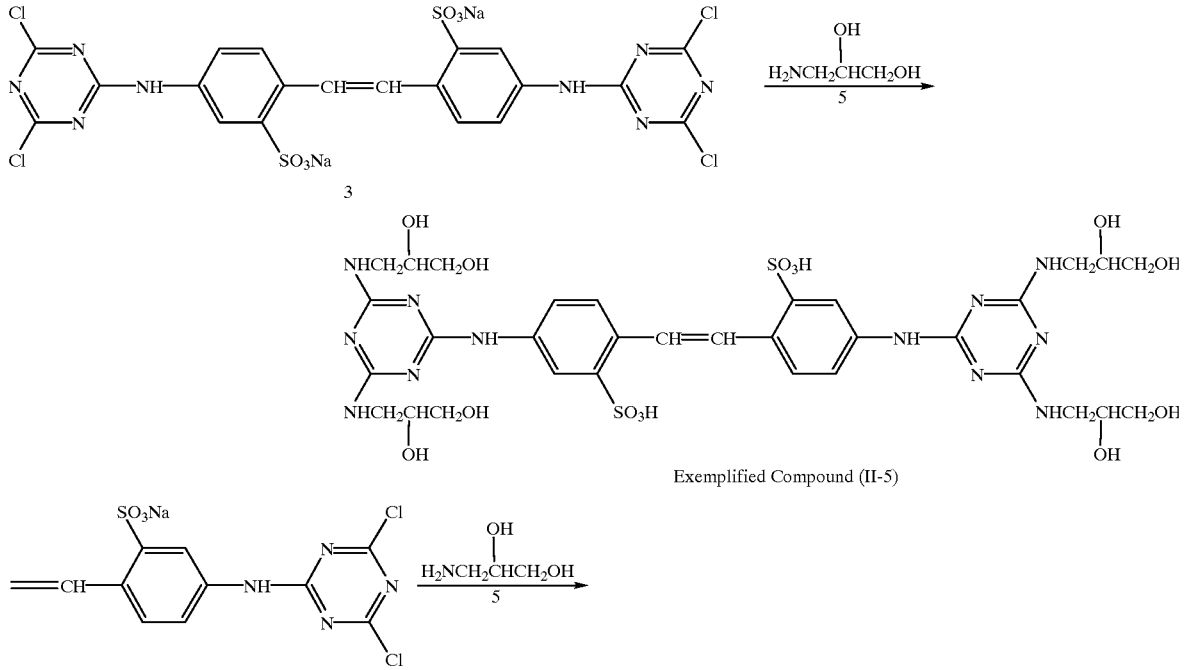

(Synthesis of Exemplified compound (II-5))

A three neck flask was charged with compound (3) that had been prepared in the same scale via the same procedures as those described in Synthesis Example 1 and 825 mL of water. To the flask, 256.0 g of compound (5) was added dropwise in 30 min under stirring and water cooling. The content was stirred at 85° C. for 5 hours after the addition, then cooled with ice below 15° C., and added with 500 mL conc. hydrochloric acid. Further, with the addition of 2 L acetone, ice cooling was stopped Two hours stirring gave rise to a crystalline precipitate, which was filtered with suction. The crystalline precipitate was dissolved in 1 L methanol and stirred for an hour under heat reflux. The solution was cooled to 30° C., and then filtered by suction to obtain 216 g of the target exemplified compound (II-5) (yield: 87%).

$\lambda_{max}(H_2O)=346.3\ nm\ (\epsilon=4.86\times10^4)$

The purity of the target compound proved to be 93.5% with liquid chromatography carried out under the same conditions as in Synthesis Example 1.

Now, compositions for processing silver halide photographic materials, which will be referred to as processing compositions hereinafter, of the present invention will be described in detail. The term "processing composition" implies such that is used to process silver halide photographic materials in order to accomplish image formation, more concretely, means those for color development, bleaching, bleach-fix (blix), fixing, washing and stabilization. It can also include compositions for black-and-white development, reversal materials and for pre-bleaching. Those compositions may be in the form of solutions at working concentration as processing liquids for tank charging or for replenishing, or in the form of condensed solution. In the case where the processing compositions of the present invention are in the form of condensed liquid, they are diluted with a pre-determined amount of water prior to usage as tank liquid or replenisher. Though the compounds characterizing the present invention, when they are in solution form, have an excellent stability against precipitation formation, they can also be used in compositions in the form of granule, tablet, powder or slurry.

In the processing composition of the present invention, the concentration of the compounds represented by general formula (I) and/or (II) lies between 0.05 and 20 mmole/L at the working condition, preferably between 0.15 and 15 mmole/L, and more preferably between 0.2 and 10 mmole/L. In the form of condensed solution, which needs be diluted prior to usage, the concentration of the compounds cited above increases by the ratio of condensation.

The image forming method of the present invention uses the present processing composition in at least one processing step, or it can use the present processing compositions in two or more, or all the processing steps involved in the image forming method.

Among various methods of preparing the present processing composition, the following three methods give desirable results. However, in practicing the present invention, the preparation of the processing composition are not to be limited to those three methods at all.

[Method A] To a mixing tank charged with a small amount of water, component chemicals for the composition are added in turn under stirring.

[Method B] Firstly, component chemicals are blended, then the mixture is placed in a mixing tank, to which a small amount of water is added all at once.

[Method C] Necessary chemicals are first divided appropriately into sub-groups. Each group is separately dissolved in water or a water-miscible organic solvent to form a condensed solution, and then all the condensed solutions are mixed together.

Further, a method comprising each of the above methods partly is also practicable.

The processing composition of the present invention may be any of a color developer composition, a bleaching composition, a bleach-fix (blix) composition, a fixing composition, a rinse composition and a stabilizing composition.

The color developer compositions of the present invention include color developing agents. The well-known aromatic primary amine color developing agents are preferred;, in particular, p-phenylenediamine derivatives are most preferred. Some representative examples are listed below not with the purpose of limiting the scope of the invention to them. Some recent black-and-white photographic materials contain couplers that develop a neutral black dye image when processed with a general-purpose color developer. The processing composition of the present invention can be applied to such a type of photographic material, too.

N-1) N,N-diethyl-p-phenylenediamine

N-2) 4-amino-N,N-diethyl-3-methylaniline

-N-3) 4-amino-N-(β-hydroxyethyl)-N-methylaniline

N-4) 4-amino-N-ethyl-N-(β-hydroxyethyl)aniline

N-5) 4-amino-N-ethyl-N-(β-hydroxyethyl)-3-methylaniline

N-6) 4-amino-N-ethyl-N-(3-hydroxypropyl)-3-methylaniline

N-7) 4-amino-N-ethyl-N-(4-hydroxybutyl)-3-methylaniline

N-8) 4-amino-N-ethyl-N-(β-methane sulfonamidoethyl)-3-methylaniline

N-9) 4-amino-N,N-diethyl-3-(β-hydroxyethyl)aniline

N-10) 4-amino-N-ethyl-N-(β-methoxyethyl)-3-methylaniline

N-11) 4-amino-N-(β-ethoxyethyl)-N-ethyl-3-methylaniline

N-12) 4-amino-N-ethyl-N-(3-carbamoylpropyl)-N-n-propyl-3-methylaniline

N-13) 4-amino-N-(4-carbamoylbutyl)-N-n-propyl-3-methylaniline

N-14) N-(4-amino-3-methylphenyl)-3-hydroxypyrrolidine

N-15) N-(4-amino-3-methylphenyl)-3-hydroxymethylpyrolidine

N-16) N-(4-amino-3-methylphenyl)-3-pyrolidine carboxamide

Among the p-phenylenediamine derivatives cited above, N-5), N-6), N-7), N-8) and N-12) and particularly N-5) and N-8) are preferred. These p-phenylenediamine derivatives are available in the form of sulfuric acid salt, hydrochloric acid salt, p-toluenesulfonicacid salt, naphthalene disulfonic acid salt, N,N-bis (sulfonylethyl)hydroxylamine salt, etc. They may be used in the composition in their free form.

The concentration of the aromatic primary amine developing agent described above in the working solution is generally from 4 to 100 mmole/L, preferably from 6 to 50 mmole/L, and more preferably from 8 to 25 mmole/L.

The color developer composition of the present invention can contain a compound which prevents the deposition of a color developing agent. Such typical compounds are poly (ethylene glycol)s, arylsulfonic acids, alkylsulfonic acids, or urea compounds described in JP-A-11-174643. Among these, particularly preferable ones that exert least adverse effects on photographic characteristics and are effective in deposition prevention are diethylene glycol, polyethylene glycol 300, p-toluenesulfonic acid and its salts, n-alkylsulfonic acids having 5 to 9 carbon atoms and their salts, or ethylene urea.

The color developer composition of the present invention can preferably contain compounds or preservatives that prevent the aerial oxidation of the color developing agent. Preferable inorganic preservatives include sulfite salts and hydroxylamine. They exhibit a marked preserving capability, which can be enhanced by a combined use of organic preservatives. Since sulfite salts and hydroxylamine exert undesirable effects on the photographic characteristics of certain types of materials during color development, the combined use of these two types are sometimes avoided or only organic preservatives are used.

Effective organic preservatives include hydroxyamine derivatives, hydroxysamic acids, hydrazides, phenols, α-hydroxyketones, α-aminoketones, saccharides, monoamines, diamines, polyamines, quarternary ammonium salts, nitroxy radicals, alcohols, oximes, diamides, condensed ring amines, cyclic amides, salycilic acid, polyethylenimines, alkanolamines and aromatic polyhydroxy compounds.

Of the organic preservatives, hydroxylamine derivatives described in JP-A-3-56456 and JP-A-3-33845 and compounds described in JP-A-3-33846 and JP-A-6-148841 are particularly preferred.

It is desirable to use hydroxylamine derivatives together with alkanolamines from the viewpoint of stability improvement of color developer in continuous processing. Particularly preferred compounds which are used in combination with hydroxylamines are triisopropanolamine and triethanolamine. Cyclic amide compounds can also be combined with hydroxylamine derivatives, among which ε-caprolactam is particularly suited.

The pH value of the color developer composition of the present invention is preferably 9.5 to 13.5, more preferably 12.0 to 13.5, and that of the color developer prepared therefrom is 9.0 to 12.2, and more preferably 9.9 to 11.2. Buffer agents are usually used to stabilize the pH of the developer. Preferable buffer agents include inorganic potassium or sodium salts such as carbonates, bicarbonates, phosphates, borates and tetraborates. Organic compounds such as 5-sulfosalycilic acid, β-alanine, proline, tris-hydroxyaminomethane, etc. can also be preferably used. These compounds are mentioned not to limit the scope of the invention. The concentration of these buffer agents is not lower than 0.1 mole/L and more preferably between 0.1 and 0.4 mole/L as the color developer replenisher.

To the color developer composition of the present invention, various chelating agents can be added for preventing precipitation of calcium, magnesium, etc. One or more kinds of chelating agents can be used. Preferable compounds as the chelating agents include nitrilotriacetic acid, diethylenetriaminepentaacetic acid, ethylenediamine teteraacetic acid, N,N,N-trimethylene phosphonic acid, ethylenediamine-N,N,N',N'-tetramethylene sulfonic acid, ethylenediaminesuccinic acid (s,s-isomer), 2-phosphobutane-1,2,4-tricarboxylic acid, 1-hydroxyethylidene-1,1-diphosphonic acid, 1,2-dihydroxybenzene-4,6-disulfonic acid, etc. The amount of chelating agent is determined so as to be sufficient to mask the metallic ion present in the color developer, being usually 0.1 g/L to 10 g/L.

Any of known development accelerators may be used in the color developer composition of the present invention when needed. Typical compounds include polyalkylene oxide, 1-phenyl-3-pyrazolidones, alcohols, carboxylic acids, etc.

Any of known anti-fogging agents may be used in the color developer composition of the present invention when needed. Typical anti-fogging agents include metal halides such as sodium chloride, potassium bromide, potassium iodide, etc., and organic compounds represented by nitrogen-containing heterocyclic compounds. Such organic anti-fogging agents include, for example, benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, adenine, etc. Further, alkylcarboxylic acids, arylcarboxylic acids or saccharides may be added to the composition.

When the present invention is applied to the color development of color print photographic materials, the processing temperature is set preferably at 30 to 55° C., more preferably at 35 to 50° C., and still more preferably at 38 to 45° C. The developing period is 5 to 90 seconds, preferably 8 to 60 seconds, and more preferably 10 to 45 seconds. The smaller replenishing amount is considered the better, and is appropriately 15 to 200 mL, preferably 20 to 120 mL and more preferably 30 to 60 mL, per 1 $m^2$ of the photographic material to be processed.

In the case of color negative film, the processing temperature is 30 to 55° C., more preferably 35 to 50° C., and still more preferably 38 to 45° C. The development period is usually 45 seconds to 5 minutes, preferably 60 seconds to 4 minutes, and more preferably 90 seconds to 3 minutes 15 seconds. The smaller replenishing amount is considered the better, and is appropriately 10 to 200 mL, preferably 12 to 60 mL and more preferably 15 to 30 mL, per one film roll for taking 24 pictures.

The color developer compositions in which the replenisher is condensed as disclosed in JP-A-11-174643, JP-A-11-194461 and JP-A-11-194462 are examples of preferred embodiments.

The bleaching and beach-fix compositions of the present invention can contain any known bleaching agents. Particularly, organic complex salts of Fe(III) exemplified by the complex salts of organic acids such as aminopolycarboxylic acids, citric acid, tartaric acid, malic acid, etc., persulfate salts, hydrogen peroxide, etc. are preferred. Two or more kinds of bleaching agent may be used together.

Among the compounds cited above, the organic complex salts of Fe(III) are particularly suited from the viewpoint of rapid working and protection of environment pollution. Favorable aminopolycarboxylic acids and their salts used to form complex salts with Fe(III) include ethylenediaminesuccinic acid (s, s isomer), N-(2-carboxylato ethyl)-L-aspartic acid, β-alaninediacetic acid, methyliminodiacetic acid, ethylenediaminetetraacetic acid, diethylenetriaminepentaacetic acid, 1,3-propylenediaminetetraacetic acid, nitrilotriacetic acid, cyclohexanediaminetetraacetic acid, iminodiacetic acid, glycol ether diamine tetraacetic acid, etc. and their sodium, potassium, lithium or ammonium salts. Among these compounds, the following are preferred due to the good photographic characteristics of their Fe (III) salts; ethylenediaminesuccinic acid (s, s isomer), N-(2-carboxylate ethyl)-L-aspartic acid, β-alanine diacetic acid, methyliminodiacetic acid, ethylenediamine tetraacetic acid, diethylenetriaminepentaacetic acid, and 1,3-propylenediaminetetraacetic acid. They may be added as Fe (III) complex salts, or Fe complex salts may be formed in the bleaching solution by using a ferric salt such as sulfate, chloride, nitrate, ammonium nitrate, phosphate, etc. with a chelating agent such as aminopolycarboxylic acid. The chelating agent may be used in excess of the amount required to form its ferric complex salt. The working concentration of the bleaching agent in the bleaching or blix solution is from 0.01 to 1.0 mole/L, preferably from 0.05 to 0.5 mole/L and more preferably from 0.1 to 0.5 mole/L.

Buffer agents are preferably used in bleaching or blix solutions. Suitable buffer agents are chosen depending on the target pH value; suitable compounds include organic acid such as succinic acid, maleic acid, glycolic acid, malonic acid, fumaric acid, sulfosuccinic acid, acetic acid, etc., organic base such as imidazole, dimethylimidazole, etc. or those represented by general formulae (A-a) and (B-b) of JP-A-9-211819. The preferred range of the working concentration of buffer agent is 0.005 to 30 mole/L, and more preferably 0.05 to 1.5 mole/L. The pH range of bleaching solution is preferably from 2 to 7, a more preferable one being from 4 to 7. The pH range of blix bath is preferably from 3 to 8, and more preferably from 4 to 7.

The processing temperature for bleaching and fixing of photographic color print materials is preferably 35 to 55° C., more preferably 35 to 50° C., and still more preferably 38 to 45° C. The processing time is usually 5 to 90 seconds, preferably 8 to 60 seconds, and more preferably 10 to 45 seconds. Generally speaking, the smaller replenishing amounts are the more desirable, but 20 to 200 mL per 1 $m^2$ photographic material are appropriate. A more preferable range for this amount is 25 to 120 mL, still more preferable one being 30 to 50 mL.

In the bleaching of color negative films, the processing temperature is preferably 30 to 55° C., more preferably 35 to 50° C., and still more preferably 38 to 45° C. The period of bleaching is preferably 12 seconds to 2 minutes, more preferably 15 seconds to 1 minute 15 seconds, and still more preferably 18 to 60 seconds. In general, the smaller replenishing amounts are the more desirable, but 2.5 to 50 mL per single 35-mm film roll for taking 24 pictures is considered appropriate. A more preferable range for this amount is 3 to 25 mL, still more preferable one being 4 to 12 mL.

The fixing agent used in the blix and fixing compositions of the present invention include known ones, i.e., thiosaulfate salts such as sodium thiosulfate and ammonium thiosulfate, etc., thiocyanate salts such as sodium thiosulfate and ammonium thiocyanate, ethylene bisglycolic acid, 3,6-dithia-1,8-octandiol, thioether compounds or thioureas both described in JP-A-4-317055, and water-soluble solvents for silver halide such as meso-ionic compounds described in JP-A-4-143757 and JP-A-4-230749. These compounds may be used solely or in combination. Preferable fixing agents are thiosulfate salts, among which ammonium thiosulfate is particularly preferred. The fixing agent concentration in the fixing or blix bath is preferably 0.3 to 2 mole/L, more preferably being 0.5 to 1.5 mole/L.

Buffer agents should be added to blix or fixing solutions. Suitable buffer agents include heterocyclic organic bases such as imidazole, dimethylimidazole, etc., aminoalkylene sulfonic acid such as taurine, or dibasic acids such as succinic acid, maleic acid and malonic acid. The pH value preferably lies between 3 and 8, and more preferably between 4 and 7.

The present blix and fixing compositions can preferably contain compounds that, as preservative, release sulfite ion such as sulfite salts, bisulfite salts, meta-bisulfite salts, etc. They may be in the form of potassium salt, sodium salt or ammonium salt. Further, arylsulfinic acid can also be used in the compositions such as p-toluenesulfinic acid, m-carboxybenzenesulfinic acid, p-aminobenzenesulfinic acid, etc. The concentration of these compounds in the working solutions is preferably 0.02 to 1.0 mole/L. Other useful preservatives include ascorbic acid, carbonyl bisulfite adduct and carbonyl compounds.

The blix and fixing compositions of the present invention can preferably contain compounds which improve image stability by forming stable silver ion, exemplified by mercapto nitrogen-containing heterocyclic compounds such as mercaptotriazole, aminomercaptotriazole, N-methylmercaptoimidazole, etc., or those which promote the wash-out of developing agent, exemplified by bis-amidines, bis-guanidines or monoamidines all disclosed in JP-A-5-303185. Furthermore, the blix and fixing compositions of the present invention can contain polymers such as polyethylene glycol, polyvinylpyrrolidone, etc., chelating agent, defoaming agent, fungicide, etc., depending on specific needs of the compositions.

The processing composition of the present invention can advantageously take the form of single package whereby all the components for the working solution are packed together for storage. However, in cases where a prolonged contact of certain components in color developer or blix compositions are not desirable, the compositions can take the form of two or three packages by dividing the components into appropriate parts. According to International Standard ISO5989, such forms are referred to as 1, 2 and 3 part constitutions. The present processing compositions do not lose their advantageous features and effects with any constitution. As for color developer compositions, particularly one-part constitution is most preferred.

The containers for the present processing composition may be made of various known materials depending on the properties of the contents. They may be made of a single material or of composite materials exemplified by one consisting of a highly air permeable material and an alkali-resistant one. From the viewpoint of reuse or recycling, the containers are preferably made of a single material. Suitable materials include polyester resins, polyolefin resins, acrylic resins, ABS resins, epoxy resins, polyamide resins such as nylon, polyurethane resins, polystyrene resins, polycarbonate resins, PVA, poly(vinyl chloride), poly(vinylidene chloride) and polyethylene resins. Among them, polyester resins such as poly (ethylene terephthalate), poly (ethylene naphthalate), etc, polyolefin resins such as polyethylene, polypropylene, etc. are preferably used for the present container as single material The most preferable material is polyethylene, and, in particular, high density one (HDPE).

The container materials used in the present invention may contain various pigments such as carbon black, titanium dioxide, calcium carbonate, etc, plasticizers compatible with the main plastic material, etc. Practically preferable container materials are those in which polyethylene occupies not less than 85% of the entire formulation and in which no plasticizer is added, and more preferable ones are those in which polyethylene occupies not less than 95% and in which no plasticizer is added.

The shape and structure of the container for the present processing composition can be arbitrarily designed to meet individual purposes. In addition to standard bottles, elastic type vessels disclosed in JP-A-1-235950, vessels having flexible dividing walls disclosed in JP-A-62-134626 can also be used. Those disclosed in JP-A-11-282148 are particularly suited for the present processing compositions as regards volume, space efficiency, self-standing nature, shape conservation and reuse/recyclability. Processing kits comprising a single cartridge in which multiple processing compositions all based on the present invention are charged in multiple containers all made of common materials and having a common shape and size are preferable embodiments of the invention. Such cartridges are disclosed in JP-A-2000-3014. The combination of the processing compositions is arbitrary for such cartridges. In the cartridges disclosed in JP-A-11-295858 and JP-A-11-288068, a developing composition, a blix one, and a fix one are combined, forming a practically desirable embodiment.

In the blix of color print materials to be applied to the present invention, the processing temperature, the blix period and the replenishing rate have already been described. In the fixing of color negative materials, the processing temperature is preferably 30 to 55° C., more preferably 35 to 50° C., and still more preferably 38 to 45° C. The period of bleaching is preferably 20 seconds to 2 minutes, more preferably 30 seconds to 1 minute 40 seconds, and still more preferably 35 seconds to 1 minute 20 seconds. In general, the smaller replenishing amounts are the more desirable, but 4 to 60 mL per one 35-mm film roll for taking 24 pictures is considered appropriate. A more preferable range for this amount is 5 to 40 mL, still more preferable one being 6 to 30 mL.

To the rinse and stabilizing compositions of the present invention, compounds that prevent dye fading and stain formation caused by remaining magenta couplers can be added. Some examples of such compounds are formaldehyde, acetaldehyde, pyruvinaldehyde, formaldehyde-bisulfite adduct disclosed in U.S. Pat. No. 4,921,779, or N-methylol compounds disclosed in JP-A-5-34889. Further, arylsulfinic acid such as p-toluenesulfinic acid, m-carboxybenzenesulfinic acid, p-aminobenzenesulfinic acid, etc. Moreover, surfactants to promote water draining, chelating agents to soften hard water, buffer agents for pH adjustment, defoaming agent, fungicides, disinfectant, etc. may also be added depending on necessity.

The pH is preferably between 4 and 10, and more preferably between 5 and 8. Washing temperature, which can change depending on the applications and characteristics of the photographic materials, is usually set to 20 to 50° C., and preferably 25 to 45° C.

Photographic elements processed according to the present invention can contain ordinary silver halide as photosensitive material, including silver chloride, silver bromide, silver bromoiodide, silver chlorobromide, silver chloroiodide, and mixtures of those. As an embodiment, a photographic element contains a high chloride content silver halide that consists of at least not less than 50 mole % and more preferably not less than 90 mole % of silver chloride. Such an element is often used as photographic color print material.

In another embodiment, at least one emulsion in the photographic element mainly consists of silver bromide (not less than 50 mole % being bromide). Most preferably, in such an embodiment, the photographic element contains at least one silver bromide emulsion that is used to record at least one color image as in color negative or color reversal films. Photographic elements that are processed according to the present invention can record monochromatic information or plural color information, and can have a magnetic recording layer that is already well known in the art.

Individual photographic elements are described in, for example, many Research Disclosures (RDs) including RD17643, pp.23–27, RD18716, pp.647–650. RD307105, pp.866–868 and pp.873–879 and RD36544,pp.501–541. These RDs describe useful silver halide emulsions (negative and positive types) and their preparing methods, various sensitizers, dye-forming couplers, dye image stabilizers, dyes, UV absorbers, filters, binders, hardening agents, plasticizers, lubricants, coating aids, surfactants, anti-static agents, matting agents, paper and film substrates, or image forming methods using negative and positive color image forming elements.

EXAMPLES

In the following, some examples will be shown to explain the advantageous features of the present invention as for the stability against precipitation deposition and photographic characteristics, but not with a purpose of limit the scope of the present invention.

Example 1

(1) Preparation of color developer composition Samples 1 to 18 having the following formulations were prepared.

| | |
|---|---|
| A compound represented by general formula (I) or (II), or a comparative compound | See Table 1 |
| Triisopropanolamine | 34.0 g |
| Etylenediaminetetraacetic acid | 15.0 g |
| Sodium sulfite | 0.8 g |
| Polyethylene glycol (average molecular weight = 300) | 40.0 g |
| Sodium 4,5-dihydoxybenzene-1,3-disulfonate | 2.0 g |
| Disodium-N,N-bis-(sulfonato ethyl) hydroxylamine | 55.0 g |
| 4-amino-3-metyl-N-ethyl-N- (β-methanesulfonamideethyl) aniline · 3/2 sulfate · monohydrate | 55.0 g |
| Potassium hydroxide | 19.0 g |
| Sodium hydroxide | 24.0 g |
| Potassium carbonate | 100.0 g |
| Water to make | 1000 ml |
| pH | 13.2 |

(2) Preparation of photographic material

The surface of a substrate made of base paper the both surface of which was laminated with a polyethylene resin was subjected to corona discharge, then coated with a gelatin subbing layer containing sodium dodecylbenzenesulfonate, and then further coated with seven photographic layers in turn. The coating mixture for each layer was prepared as described below. Thus, a silver halide color photographic material was obtained. Preparation of the coating mixture for the fifth layer The following components were dissolved in the mixture of a solvent (Solv-6) 230 g and ethyl acetate 350 ml.

| | |
|---|---|
| Cyan coupler (ExC-1) | 300 g |
| Dye image stabilizers (Cpd-1) | 250 g |
| Dye image stabilizers (Cpd-9) | 10 g |

-continued

| | |
|---|---|
| Dye image stabilizers (Cpd-10) | 10 g |
| Dye image stabilizers (Cpd-12) | 8 g |
| UV absorber (UV-1) | 14 g |
| UV absorber (UV-2) | 50 g |
| UV absorber (UV-3) | 40 g |
| UV absorber (UV-4) | 60 g |

The solution thus obtained was emulsified in 6500 g of a 10% aqueous gelatin solution containing 25 g of sodium dodecylbenzenesulfonate to give an emulsified dispersion C.

Separately, a silver chlorobromide emulsion C (a mixture of a coarse grain emulsion C containing 0.40 μm average size, cubic grains and a fine grain emulsion C containing 0.30 μm average size, cubic grains with a mixing ratio of 5:5 in terms of Ag mole. Each fluctuation factor for grain size distribution was 0.09 and 0.11, respectively. In both of the emulsions, 0.5 mole % silver bromide was localized at a part of the surface of grains consisting of silver chloride.)

This emulsion had been added with two kinds of red sensitizers G and H by $9.0\times10^{-5}$ mole per mole silver of the coarse grain emulsion and by $12.0\times10^{-5}$ mole per mole silver of the fine grain emulsion, respectively. Further, the two emulsions were subjected to an optimal chemical ripening with the addition of sulfur and gold sensitizers.

The coating mixture for the fifth layer was prepared by mixing the emulsified dispersion C and the silver chlorobromide emulsion C so as to have the following formulation. The coated amount of emulsion is expressed in terms of the coated density of silver.

The coating mixtures for other layers, i.e., a first to fourth and sixth and seventh, were similarly prepared to that for the fifth. For each mixture, 1-oxy-3,5-dichloro-s-triazine sodium salt was used as gelatin hardener. Moreover, the following antiseptics were added by the following amounts.

| | |
|---|---|
| Ab-1 | 15.0 mg/m$^2$ |
| Ab-1 | 60.0 mg/m$^2$ |
| Ab-1 | 5.0 mg/m$^2$ |
| Ab-1 | 10.0 mg/m$^2$ |

(Ab-1) Anticeptic

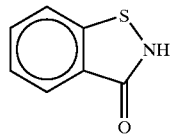

(Ab-2) Anticeptic

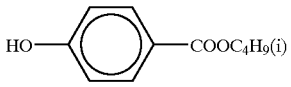

(Ab-3) Anticeptic

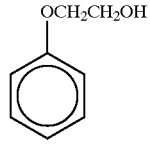

(Ab-4) Anticeptic, comprising a 1:1:1:1 mixture (molar ratio) of a, b, c and d.

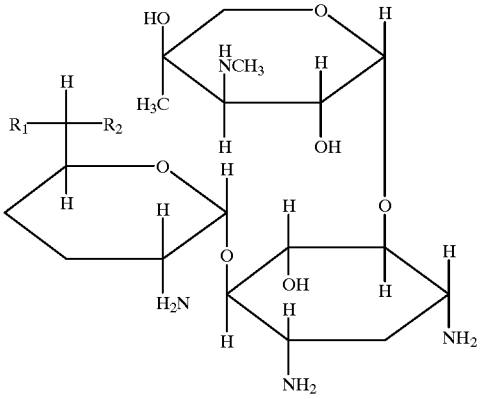

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

Each silver chlorobromide emulsion for each layer was incorporated with the following spectral sensitizers. Blue sensitive emulsion layer (Spectral sensitizer A)

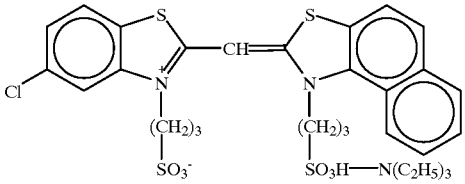

-continued (Spectral sensitizer B)

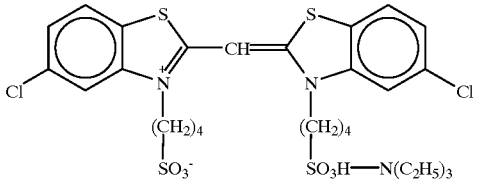

(Spectral sensitizer C)

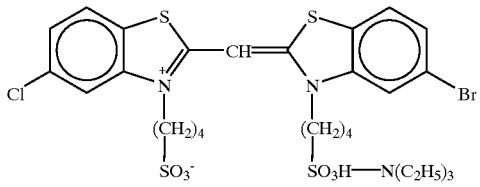

(Each of sensitizers A and C was added by $0.42\times10^{-4}$ mole per mole silver halide of the coarse grain emulsion and by $0.50\times10^{-4}$ mole per mole silver halide of the fine grain emulsion. Sensitizer B was similarly added by $3.4\times10^{-4}$ to the coarse and by $4.1\times10^{-4}$ to the fine grain emulsion, respectively.)

Green sensitive emulsion layer (Spectral sensitizer D)

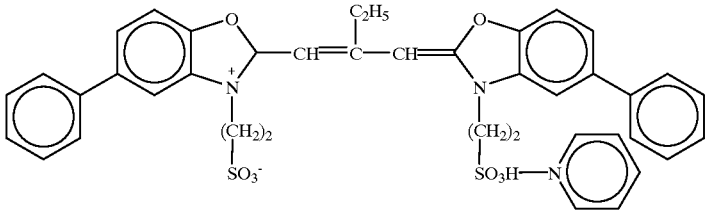

(Spectral sensitizer E)

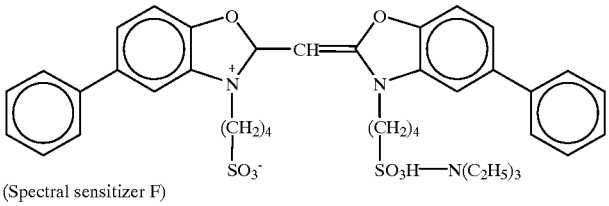

(Spectral sensitizer F)

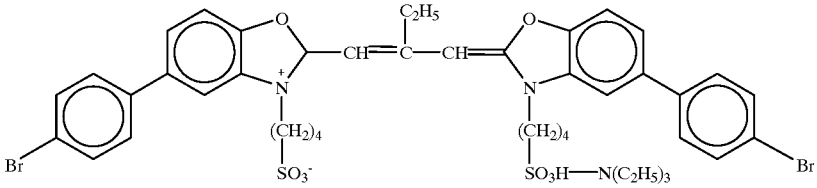

(Sensitizers D wad added by $3.0\times10^{-4}$ mole per mole silver halide of the coarse grain emulsion and by $3.6\times10^{-4}$ mole per mole silver halide of the fine grain-emulsion. Sensitizer E was added by $4.0\times10^{-4}$ mole per mole silver halide of the coarse grain emulsion and by $7.0\times10^{-5}$ mole per mole silver halide of the fine grain emulsion. And, sensitizer F was similarly added by $2.0\times10^{-4}$ mole to the coarse and by $2.8\times10^{-4}$ mole to the fine grain emulsion, respectively.)

Red sensitive emulsion layer (Spectral sensitizer G)

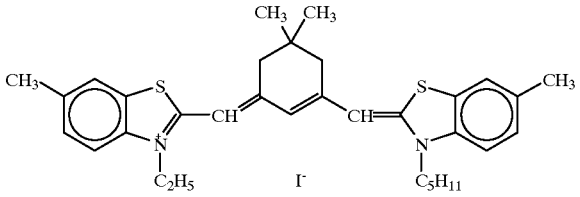

(Spectral sensitizer H)

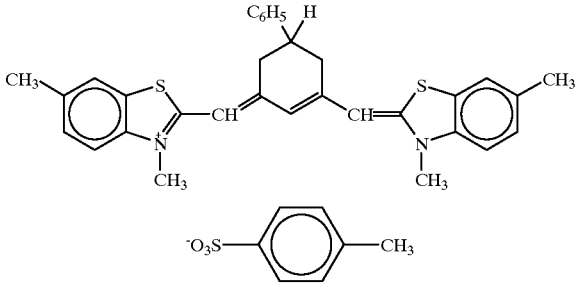

(Each of sensitizers G and H was added by $8.0\times10^{-5}$ mole per mole silver halide of the coarse grain emulsion and by $10.7\times10^{-5}$ mole per mole silver halide of the fine grain emulsion. Further, the following compound I was added to the red sensitive emulsion layer by $3.0\times10^{-3}$ mole per mole silver halide.)

(Compound I)

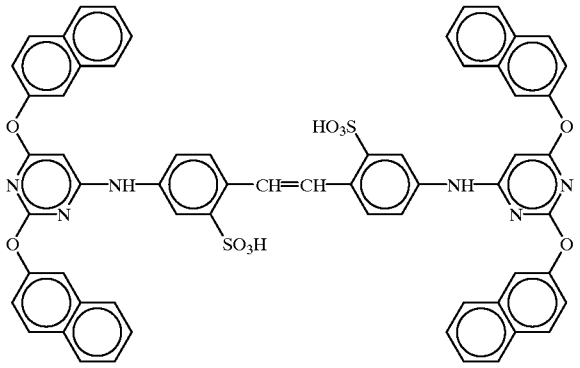

To the blue, green and red sensitive emulsion layers, 1-(3-methylureidophenyl)-5-mercaptotetrazole was added by $3.3\times10^{-4}$, $1.0\times10^{-3}$ and $5.9\times10^{-4}$ mole per mole silver halide, respectively.

To the second, fourth, sixth and seventh layers, the same compound was added at the levels of 0.2, 0.2, 0.6 and 0.1 mg/m$^2$, respectively.

To the blue and red sensitive emulsion layers, 4-hydroxy-6-methyl-1,3,3a,7-tetraindene was added by $1\times10^{-4}$ and $2\times10^{-4}$ per mole silver halide, respectively.

The red sensitive emulsion layer was incorporated with 0.05 g/m$^2$ of a methacrylic acid/butyl acrylate copolymer latex (copolymerization ratio=1:1 by weight, average molecular weight=200,000–400,000).

To the second, fourth and six th layers, di-sodium catecol-3,5-disulfonate was added at a level of 6,6 and 18 mg/m$^2$, respectively.

The following dyes were added for irradiation suppression. The numerals in the parenthesis imply coated density.

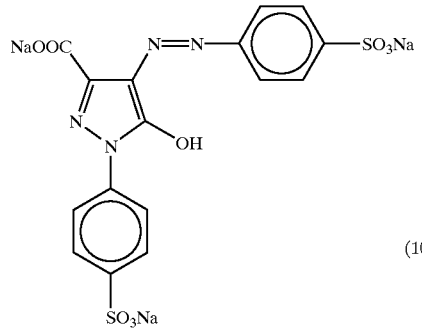

(10 mg/m$^2$)

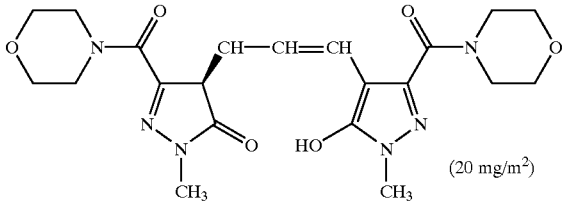

(20 mg/m$^2$)

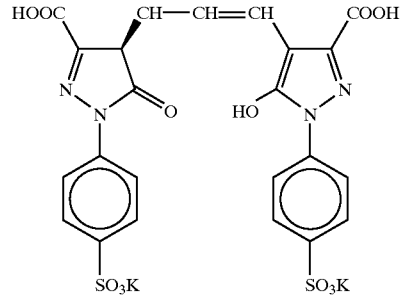

(5 mg/m$^2$)

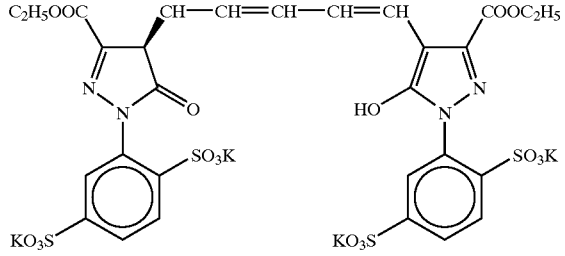

(20 mg/m$^2$)

-continued

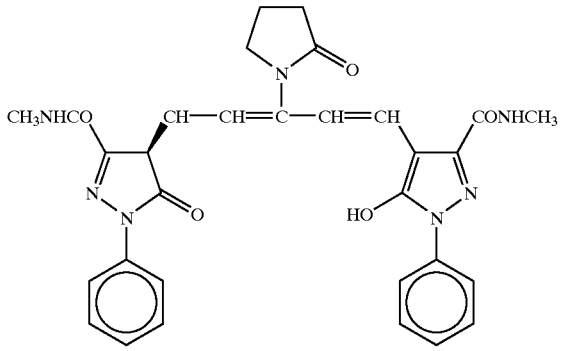

(20 mg/m$^2$)

(Layer structure)

In the following, the formulation of each layer will be given. The numerical values indicate coating density in g/m$^2$. In the case of silver halide emulsion, the values are represented by the coated amount of silver.

Support

Polyethylene resin laminated paper

[At the surface adjacent to the first layer is provided a polyethylene film layer containing a white pigment comprising 16% by weight $TiO_2$ and 4% by weight ZnO, a fluorescent whitening agent (4,4'-bis(5-methylbenzoxazolyl)stilbene, 0.03% by weight) and a bluing dye (ultramarine)]

| | |
|---|---|
| First layer (Blue sensitive emulsion layer) | |
| Silver chlorobromide emulsion A (A mixture of a coarse grain) emulsion A containing 0.74 μm average size, cubic grains and a fine grain emulsion A containing 0.65 μm average size, cubic grains in a mixing ratio of 5:5 in terms of Ag mole. Each flunctuation factor for grain size distribution was 0.08 and 0.10. In both of the emulsions, 0.3 mole % silver bromide was localized at the surface of grains consisting of silver chloride.) | 0.24 |
| Gelatin | 1.25 |
| Yellow coupler (ExY) | 0.57 |
| Dye image stabilizer (Cpd-1) | 0.07 |
| Dye image stabilizer (Cpd-2) | 0.04 |
| Dye image stabilizer (Cpd-3) | 0.07 |
| Solvent (Solv-1) | 0.21 |
| Second layer (Color contamination preventing layer) | |
| Gelatin | 0.99 |
| Color contamination preventing agent (Cpd-4) | 0.09 |
| Color contamination preventing co-agent (Cpd-5) | 0.018 |
| Stabilizer (Cpd-6) | 0.13 |
| Color contamination preventing agent (Cpd-7) | 0.01 |
| Solvent (Solv-1) | 0.06 |
| Solvent (Solv-2) | 0.22 |
| Third layer (Green sensitive emulsion layer) | |
| Silver chlorobromide emulsion B (A mixture of a coarse grain emulsion B containing 0.45 μm average size, cubic grains and a fine grain emulsion B containing 0.35 μm average size, cubic grains in a mixing ratio of 1:3 in terms of Ag mole. Each flunctuation factor for grain size distribution was 0.10 and 0.08, respectively. In both of the emulsions, 0.4 mole % silver bromide was localized at the surface of grains consisting of silver chloride.) | 0.14 |
| Gelatin | 1.36 |
| Magenta coupler (ExM) | 0.15 |
| UV absorber (UV-1) | 0.05 |
| UV absorber (UV-2) | 0.03 |
| UV absorber (UV-3) | 0.02 |
| UV absorber (UV-4) | 0.04 |

-continued

| | |
|---|---|
| Dye image stabilizer (Cpd-2) | 0.02 |
| Color contamination preventing agent (Cpd-4) | 0.002 |
| Stabilizer (Cpd-6) | 0.09 |
| Dye image stabilizer (Cpd-8) | 0.02 |
| Dye image stabilizer (Cpd-9) | 0.03 |
| Dye image stabilizer (Cpd-10) | 0.01 |
| Dye image stabilizer (Cpd-11) | 0.0001 |
| Solvent (Solv-3) | 0.11 |
| Solvent (Solv-4) | 0.22 |
| Solvent (Solv-5) | 0.20 |
| Forth layer (Color contamination preventing layer) | |
| Gelatin | 0.71 |
| Color contamination preventing agent (Cpd-4) | 0.06 |
| Color contamination preventing co-agent (Cpd-5) | 0.013 |
| Stabilizer (Cpd-6) | 0.10 |
| Color contamination preventing agent (Cpd-7) | 0.007 |
| Solvent (Solv-1) | 0.04 |
| Solvent (Solv-2) | 0.16 |
| Fifth layer (Red sensitive emulsion layer) | |
| Silver chlorobromide emulsion C (A mixture of a coarse grain emulsion A containing 0.40 μm average size, cubic grains and a fine grain emulsion A containing 0.30 μm average size, cubic grains in a mixing ratio of 5:5 in terms of Ag mole. Each flunctuation factor for grain size distribution was 0.09 and 0.11. In both of the emulsions, 0.5 mole % silver bromide was localized at the surface of grains consisting of silver chloride.) | 0.20 |
| Gelatin | 1.11 |
| Cyan coupler (ExC-1) | 0.15 |
| Cyan coupler (ExC-2) | 0.10 |
| Dye image stabilizer (Cpd-1) | 0.25 |
| Dye image stabilizer (Cpd-14) | 0.03 |
| Dye image stabilizer (Cpd-15) | 0.10 |
| Dye image stabilizer (Cpd-16) | 0.08 |
| Dye image stabilizer (Cpd-17) | 0.05 |
| Dye image stabilizer (Cpd-18) | 0.01 |
| Solvent (Solv-5) | 0.23 |
| Sixth layer (UV absorbing layer) | |
| Gelatin | 0.46 |
| UV absorber (UV-1) | 0.14 |
| UV absorber (UV-2) | 0.05 |
| UV absorber (UV-3) | 0.04 |
| UV absorber (UV-4) | 0.06 |
| Solvent (Solv-5) | 0.25 |
| Seventh layer (Protective layer) | |
| Gelatin | 1.00 |
| Acrylic modified polyvinyl alcohol copolymer (modified ratio 17%) | 0.04 |
| Liquid paraffin | 0.02 |
| Surfactant (Cpd-13) | 0.01 |

(ExY) Yellow coupler

A mixture of

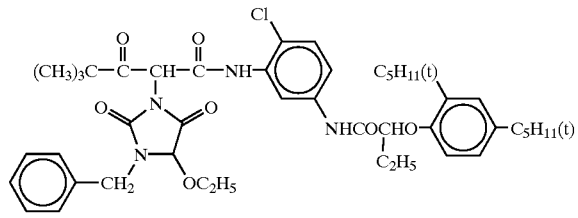

and

-continued
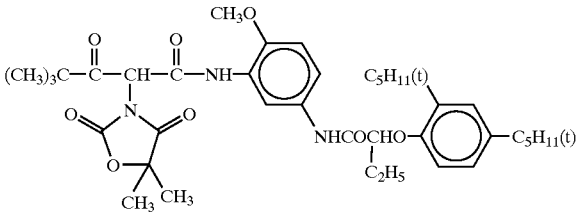
at a molar ratio of 60:40.
(ExM) Magenta coupler
A mixture of
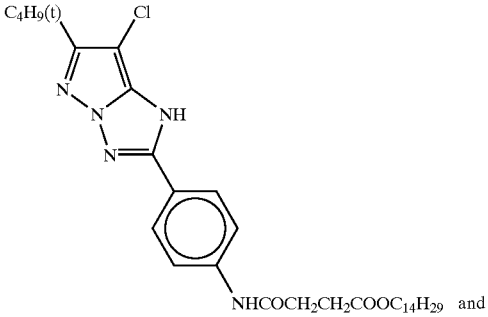
and
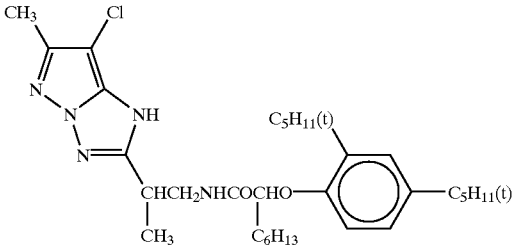
at a molar ratio of 60:40.
(ExC-1) Cyan coupler
A mixture of
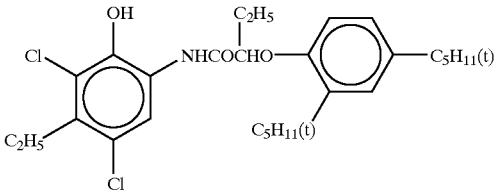
and
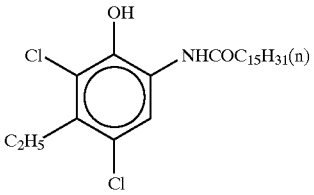
at a molar ratio of 15:85.
-continued
(ExM) Magenta coupler
A mixture of
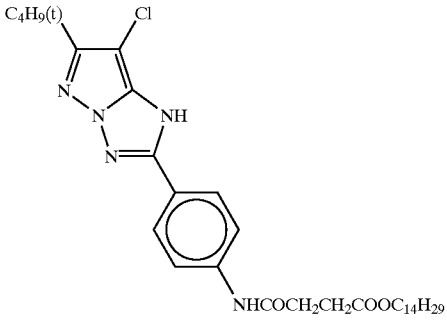
and
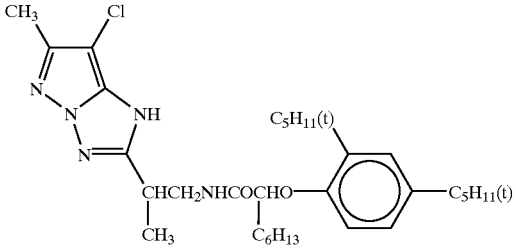
(ExC-1) Cyan coupler
A mixture of
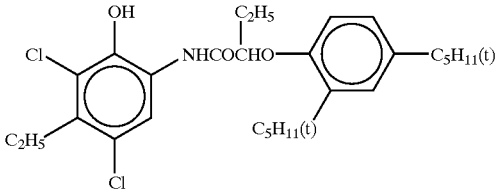
and
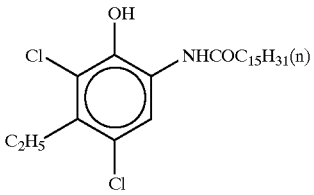
(ExC-2) Cyan coupler
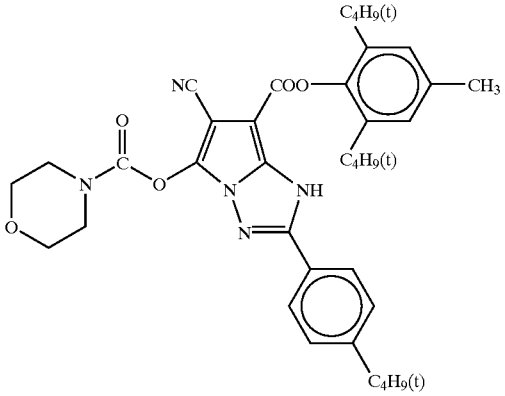
(Cpd-1) Dye image stabilizer
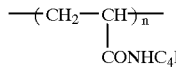
Number-average molecular weight = 60,000

-continued (Cpd-2) Dye image stabilizer

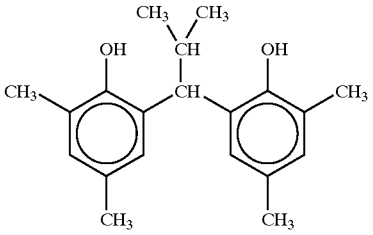

(Cpd-3) Dye image stabilizer

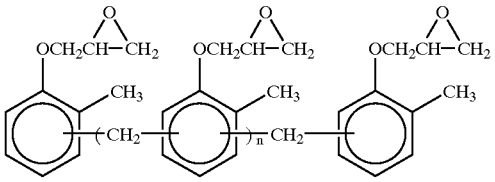

n = 7–8 (average value)

(Cpd-4) Color contamination preventing agent
A mixture of

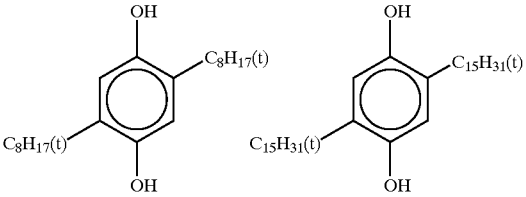

and

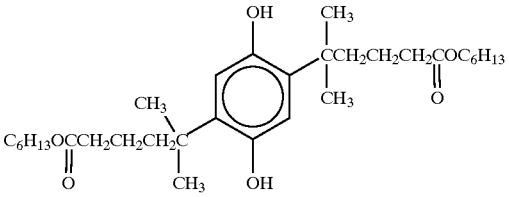

at a molar ratio of 1:1:1.

(Cpd-5) Color contamination preventing co-agent

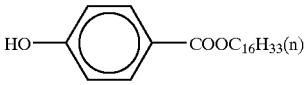

(Cpd-6) Dye image stabilizer

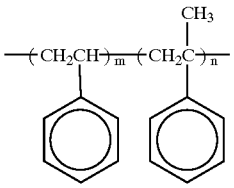

Number average molecular weight = 600, m/n = 1/9

(Cpd-7) Color contamination preventing agent

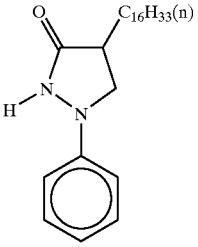

-continued (Cpd-8) Dye image stabilizer

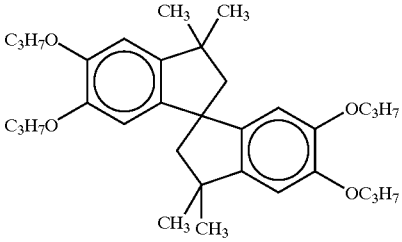

(Cpd-9) Dye image stabilizer

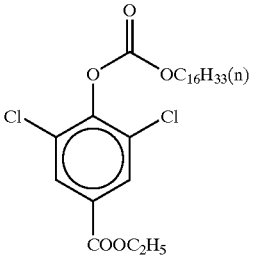

(Cpd-10) Dye image stabilizer

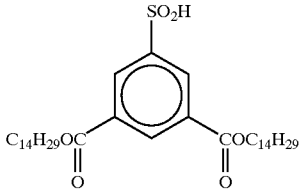

(Cpd-11) Dye image stabilizer

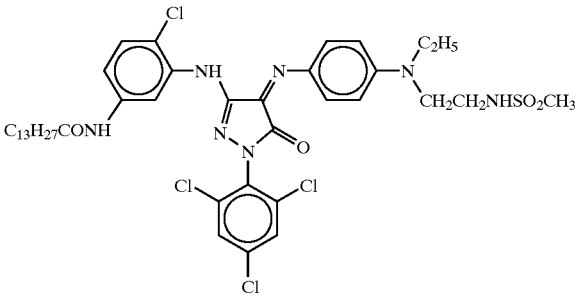

(Cpd-12) Dye image stabilizer

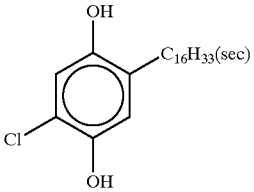

(Cpd-13) Surfactant
A mixture of

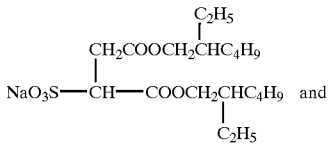

and

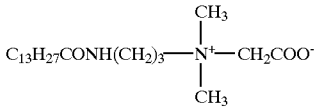

at a molar ratio of 7:3.

-continued
(Cpd-14) Dye image stabilizer
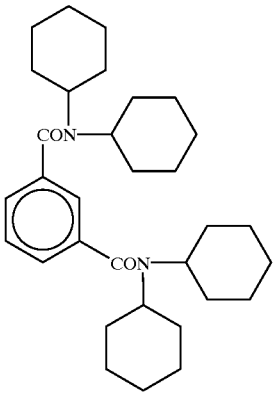
(Cpd-15) Dye image stabilizer
A mixture of
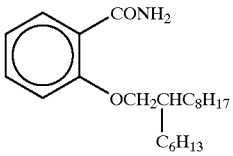
and
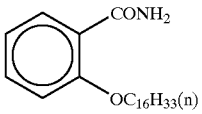
at a molar ratio of 1:1.
(Cpd-16) Dye image stabilizer
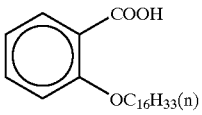
(Cpd-17) Dye image stabilizer
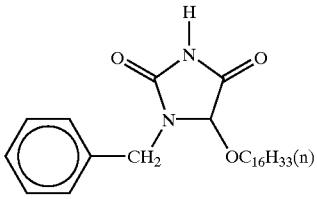
(Cpd-18) Dye image stabilizer
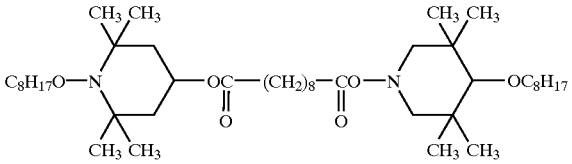
(UV-1) UV absorber
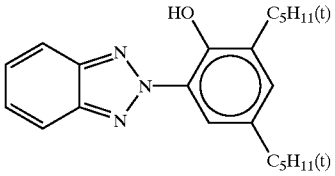
-continued
(UV-2) UV absorber
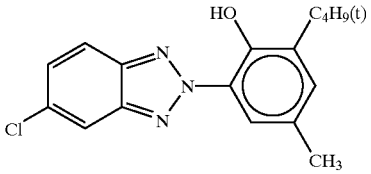
(UV-3) UV absorber
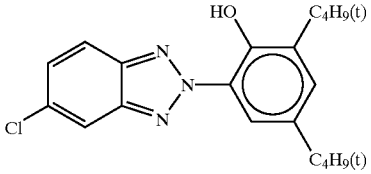
(UV-4) UV absorber
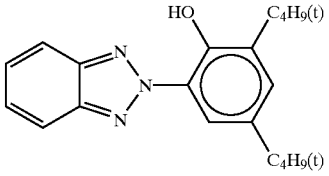
(Solv-1)
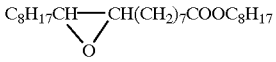
(Solv-2)
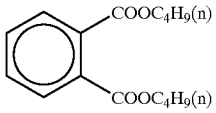
(Solv-3)
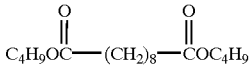
(Solv-4)
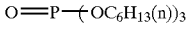
(Solv-5)
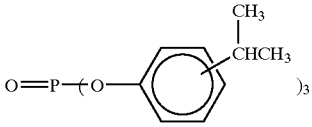
(Solv-6)
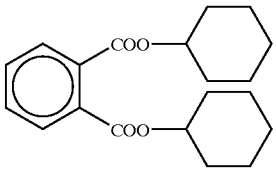

-continued (Solv-7)

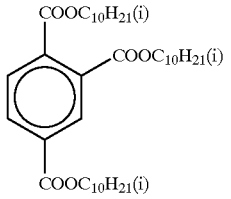

(3) Photographic processing

The photographic material prepared above was fabricated to rolls with 127 mm width, exposed to a negative film image by using Minilab Printer/Processor PP350, a product of Fuji Photo Film Co., Ltd., and the apparatus was operated continuously (running test), carrying out the following procedures until the volume of the replenisher for the color developer became 0.5 time that of the developer tank.

| Processing steps | Temperature | Time | Replenished volume |
|---|---|---|---|
| Color development | 38.5° C. | 45 seconds | 45 mL |
| Blix | 38.0° C. | 45 seconds | 35 mL |
| Rinse 1 | 38.0° C. | 20 seconds | — |
| Rinse 2 | 38.0° C. | 20 seconds | — |
| Rinse 3 | 38.0° C. | 20 seconds | — |
| Rinse 4 | 38.0° C. | 20 seconds | 121 mL |
| Drying | 80° C. | | |

(Notes)

*"Replenished volume" is the value per 1 $m^2$ of the processed material.

**By connecting a rinse/cleaning system unit RC50D (a product of Fuji Photo Film Co., Ltd.) to Rinse (3) bath, the rinse liquid was sent to a reverse osmosis module (RC50D) by a pump. The liquid having passed through the module was supplied to Rinse (4) while the condensed part was returned to Rinse (3). The pump pressure was adjusted so as to keep the amount of water passing the module to be 50 to 300 ml/min, and the whole system was operated for 10 hours per day under temperature control. The rinse system was of a 4 tank, counter flow type (the content flowing from (4) to (1)).

The formulation of each processing composition is shown below.

| [Color developer] | [Tank liquid] |
|---|---|
| Water | 800 mL |
| Added compound listed in Table 1 | 2 mmole |
| Triisopropanolamine | 8.8 g |
| Polyethylene glycol (average molecular weight = 300) | 10.0 g |
| Ethylenediaminetetraacetic acid | 4.0 g |
| Sodium sulfite | 0.1 g |
| Potassium chloride | 10.0 g |
| Sodium 4,5-dihydroxybenzene-1,3-disulfonate | 0.5 g |
| Disodium-N,N-bis (sulfonato-ethyl) hydroxylamine | 8.5 g |
| 4-amino-3-methyl-N-ethyl-N- (β-methansulfonamidetheyl) aniline · 3/2sulfate · monohydrate | 4.8 g |
| Potassium carbonate | 26.3 g |
| Water to make | 1000 mL |
| PH (25° C., adjusted with sulfuric acid and KOH) | 10.15 |

A replenisher for the color developer was prepared by diluting the color developer composition (each differing in the added compound) prepared in (1) by 3.8 times with water.

| | [Tank liquid] | [Replenisher] |
|---|---|---|
| [Blix composition] | | |
| Water | 800 mL | 800 mL |
| Ammonium thiosulfate (750 g/mL) | 107 mL | 214 mL |
| m-carboxybenzenesulfinic acid | 8.3 g | 16.5 g |
| Fe (III) ammonium ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium meta-bisulfite | 23.1 g | 46.2 g |
| Water to make | 1000 mL | 1000 mL |
| pH (25° C., adjusted with nitric acid and aqueous ammonium) | 6.5 | 6.5 |
| [Rinse liquid] | | |
| Sodium chloro-isocyanulate | 0.02 g | 0.02 g |
| Deionized water (electro-conductivity not exceeding 5 μS/cm) | 1000 mL | 1000 mL |
| pH (25° C.) | 6.5 | 6.5 |

(4) Evaluation

1) Stability against precipitate deposition

Each of the prepared color developer compositions was kept in a glass bottle at −5° C. or at room temperature for 4 weeks. The stability of each composition was evaluated by visual inspection of each bottle content, giving "E" for a noticeable precipitate formation, "D" for a definite precipitate formation, "C" for a slight precipitate formation, "B" or a turbid state without precipitation, and "A" or a perfectly clear state with no turbidity nor precipitation.

2) Photographic performance in color print paper processing

A piece of unexposed color photographic print material was processed and then subjected to reflection spectral measurement with a spectrometer U-3500 manufactured by Hitachi Co., Ltd. equipped with a 150 mmø integral sphere. The absorbance at 450 nm is designated as $D_B$.

Then, each sample piece was washed with 40° C. distilled water for 5 minutes, and subjected to the same measurement. The absorbance at 450 nm is designated as $D_{BW}$.

$\Delta D_B$ was calculated by the equation below to evaluate the level of stain caused by the sensitizing dyes remaining in the material after processing.

$$\Delta D_B = D_B - D_{BW}$$

3) Results

TABLE 1

| Sample | Added compound | Added amount (mmole) | Precipitate deposition evaluation −5° C. | Precipitate deposition evaluation room temperature | Stain evaluation of ($\Delta D_B$) | Notes |
|---|---|---|---|---|---|---|
| 1 | None | — | A | A | 0.020 | Comparative example |
| 2 | III-1 | 15 | D | D | 0.003 | Comparative example |
| 3 | III-2 | 15 | D | D | 0.003 | Comparative example |
| 4 | III-3 | 15 | D | C | 0.004 | Comparative example |
| 5 | III-4 | 15 | D | C | 0.004 | Comparative example |
| 6 | III-5 | 15 | A | A | 0.022 | Comparative example |
| 7 | III-6 | 15 | A | A | 0.032 | Comparative example |
| 8 | I-1 | 6 | A | A | 0.003 | Present invention |
| 9 | I-1 | 15 | A | A | 0.002 | Present invention |
| 10 | I-9 | 15 | A | A | 0.003 | Present invention |
| 11 | I-20 | 15 | A | A | 0.002 | Present invention |
| 12 | I-45 | 15 | A | A | 0.003 | Present invention |
| 13 | I-46 | 15 | A | A | 0.003 | Present invention |
| 14 | II-1 | 15 | A | A | 0.004 | Present invention |
| 15 | II-3 | 15 | A | A | 0.004 | Present invention |
| 16 | II-5 | 15 | A | A | 0.004 | Present invention |
| 17 | II-8 | 15 | A | A | 0.004 | Present invention |
| 18 | II-10 | 15 | A | A | 0.002 | Present invention |

Comparative compound (III-1)

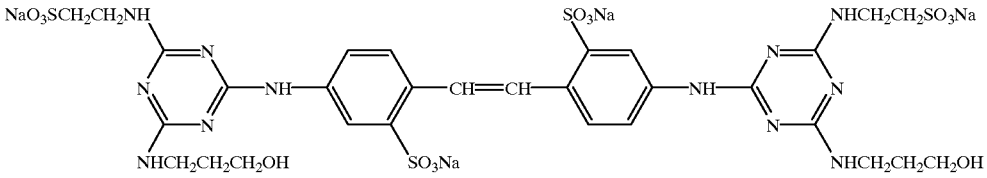

Comparative compound (III-2), disclosed in JP-A-6-332127.

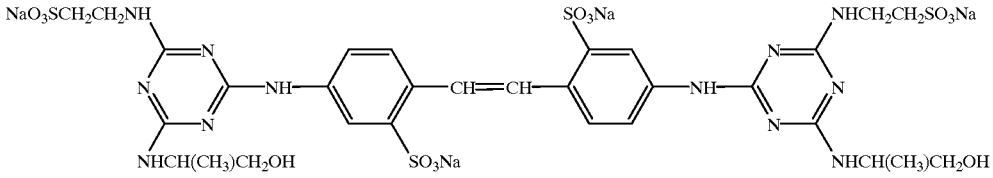

Comparative compound (III-3)

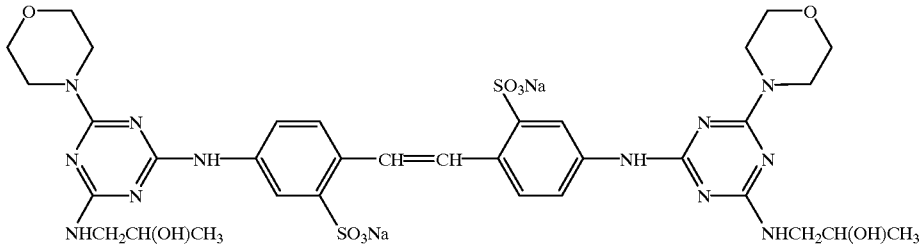

Comparative compound (III-4), disclosed in JP-A-6-35130.

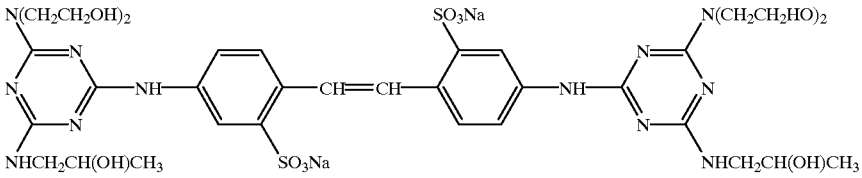

Comparative compound (III-5)

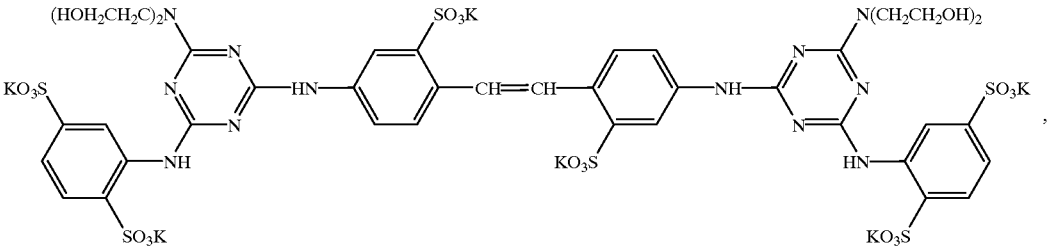

disclosed in JP-A-9-211821.

Comparative compound (III-6)

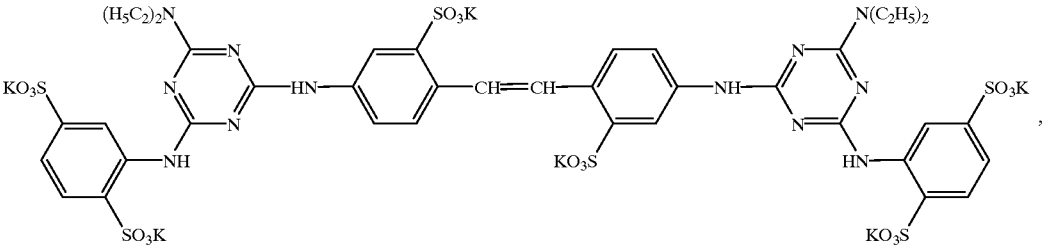

disclosed in JP-A-9-211821.

Samples 2 to 5 using known compounds III-1 to 111-4 are almost equivalent to samples of the present invention as for stain formation due to the residual spectral sensitizers, but they all gave rise to precipitate in 4 week storage. As sample 1 to which no compound was added did not form precipitation, the precipitate must have been due to the added compounds.

On the other hand, samples 6 and 7, added with known compound III-5 and III-6 respectively, were stable against precipitate formation, but their levels of stain were equivalent to or higher than that of the reference sample.

In contrast, the photographic material processed with the processing compositions of the present invention exhibited low levels of stain $\Delta D_B$ caused by residual spectral sensitizers, i.e., the background area of print was not substantially colored. Moreover, the compositions prepared according to the present invention did not form any precipitate in 4 week storage at room temperature and a low temperature condition (−5° C.). These results indicate that the compositions of the present invention not only have a remarkable effect on the reduction of stain associated with residual spectral sensitizers, but also on the prevention of precipitate deposition even under low temperature storage conditions.

Example 2

| | |
|---|---|
| A compound represented by general formula (I) or (II), or a comparative compound | See Table 2 |
| Triisopropanolamine | 40.0 g |
| Ethylenediaminetetraacetic acid | 15.0 g |
| Sodium sulfite | 0.8 g |
| Sodium p-Toluenesulfonate | 75.0 g |
| Sodium 4,5-dihydroxybenzene-1,3-disulfonate | 2.0 g |
| Disodium-N,N-bis (sulfonato-ethyl) hydroxylamine | 55.0 g |
| 4-Amino-3-methyl-N-ethyl-N-(β-methanesulfonamide ethyl) aniline·3/2 sulfate salt·monohydrate | 85.0 g |
| Potassium hydroxide | 34.5 g |
| Sodium hydroxide | 25.0 g |
| Potassium carbonate | 100.0 g |
| Water to make | 1000 mL |
| pH | 13.2 |

(2) Preparation of photographic material

The same material as in Example 1 was prepared.

(3) Photographic processing

The photographic material described above was fabricated to rolls with 127 mm width, exposed to a negative film image by using an experimental apparatus made by modifying Minilab Printer/Processer PP350 of Fuji Photo Film Co., Ltd., which can change the processing periods and temperatures at will, and the machine was operated continuously (running test) carrying out the following procedures until the volume of the replenisher for the color developer became 0.5 time that of the color developer tank.

| Processing steps | Temperature | Time | Replenished volume |
|---|---|---|---|
| Color development | 45.0° C. | 15 seconds | 45 mL |
| Blix | 40.0° C. | 15 seconds | 35 mL |
| Rinse 1 | 40.0° C. | 8 seconds | — |

-continued

| Processing steps | Temperature | Time | Replenished volume |
|---|---|---|---|
| Rinse 2 | 40.0° C. | 8 seconds | — |
| Rinse 3 | 40.0° C. | 8 seconds | — |
| Rinse 4 | 38.0° C. | 8 seconds | 121 mL |
| Drying | 80° C. | 15 seconds | |

(Notes)

*Replenished volume is the value per 1 $m^2$ of the processed material.

**By connecting a rinse-cleaning system unit RC50D (a product of Fuji Photo Film Co., Ltd.) to Rinse (3) bath, the rinse liquid was sent to a reverse osmosis module (RC50D) by a pump. The liquid having passed through the module was supplied to Rinse (4) while the condensed part was returned to Rinse (3). The pump pressure was adjusted so as to keep the amount of water passing the module to be 50 to 300 ml/min, and the whole system was operated for 10 hours per day under temperature control. The rinse system was a 4 tank, counter flowing type (the rinse liquid flowing from (4) to (1)).

The formulation of each processing composition is shown below.

| [Color developer] | [Tank liquid] |
|---|---|
| Water | 800 mL |
| Added compound listed in Table 1 | 4 mmole |
| Triisopropanolamine | 8.8 g |
| Sodium p-toluenesulfonate | 20.0 g |
| Ethylenediamine tetraacetic acid | 4.0 g |
| Sodium sulfite | 0.1 g |
| Potassium chloride | 10.0 g |
| Sodium 4,5-dihydroxybenzene-1,3-disulfonate | 0.5 g |
| Disodium-N,N-bis(sulfonato-ethyl)hydroxylamine | 8.5 g |
| 4-amino-3-methyl-N-ethyl-N-(β-methansulfon-amidetheyl) aniline·3/2sulfate·monohydrate | 10.0 g |
| Potassium carbonate | 26.3 g |
| Water to make | 1000 mL |
| pH (25 ° C., adjusted with sulfuric acid and KOH) | 10.35 |

A replenisher for the color developer was prepared by diluting the color developer composition (each differing in the added compound) prepared in (1) by 3.8 times with water.

| | [Tank liquid] | [Replenisher] |
|---|---|---|
| [Blix composition] | | |
| Water | 800 mL | 800 mL |
| Ammonium thiosulfate (750 g/mL) | 107 mL | 214 mL |
| Succinic acid | 29.5 g | 59.0 g |
| Fe (III) ammonium ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium meta-bisulfite | 23.1 g | 46.2 g |
| Water to make | 1000 mL | 1000 mL |
| pH (25° C., adjusted with nitric acid and aqueous ammonium) | 6.00 | 6.00 |
| [Rinse liquid] | | |
| Sodium chloro-isocyanurate | 0.02 g | 0.02 g |
| Deionized water (electro-conductivity not exceeding 5 μS/cm) | 1000 mL | 1000 mL |
| pH (25° C.) | 6.5 | 6.5 |

(4) Evaluation

Similar evaluation tests to those in Example 1 were carried out for the processed material samples. The results are summarized in Table 2.

TABLE 2

| Sample | Added compound | Added amount (mmole) | Precipitate deposition evaluation −5° C. | Precipitate deposition evaluation room temperature | Stain evaluation of ($\Delta D_B$) | Notes |
|---|---|---|---|---|---|---|
| 19 | None | — | A | A | 0.030 | Comparative example |
| 20 | III-3 | 25 | E | D | 0.007 | Comparative example |
| 21 | III-4 | 25 | E | D | 0.008 | Comparative example |
| 22 | III-5 | 25 | B | A | 0.032 | Comparative example |
| 23 | I-1 | 25 | A | A | 0.005 | Present invention |
| 24 | I-20 | 25 | A | A | 0.004 | Present invention |
| 25 | I-45 | 25 | B | A | 0.005 | Present invention |
| 26 | I-46 | 25 | A | A | 0.006 | Present invention |
| 27 | II-5 | 25 | B | A | 0.007 | Present invention |
| 28 | II-10 | 25 | A | A | 0.006 | Present invention |

Even when color developer compositions with a higher concentration of the color developing agent were prepared, with which a rapid processing was possible, the compositions based on the present invention gave suppressed stain values $\Delta D_B$ due to residual spectral sensitizers. Further, they did not form any precipitate after 4 week storage at room temperature, and even at low temperature (−5° C.), but remained perfectly transparent, or in some cases turned turbid still forming no precipitate. These results prove that the condensed processing compositions of the present invention are suited for rapid processing of color photographic papers.

Example 3

(1) Preparation of fixing compositions

Samples 29 to 36 having the following formulae were prepared.

| | |
|---|---|
| Compound represented by general formula (I) or (II), or comparative compound | See Table 3 |
| Ammonium bisulfite 65% aqueous solution | 65.0 g |
| Ammonium thiosulfate aqueous solution | 840 mL |
| Imidazole | 40.0 g |
| Ethylenediaminetetraacetic acid | 10.0 g |
| Water to make | 1000 mL |
| pH | 7.00 |

(2) Photographic materials

The following color negative films were processed.

1) Fujicolor Super 100, a product of Fuji Photo Film Co., Ltd. Production number N26-106
2) Fujicolor Super 400, a product of Fuji Photo Film Co., Ltd. Production number V11-128
3) Fujicolor Super G Ace 800, a product of Fuji Photo Film Co., Ltd.
   Production number M70-111

(3) Development Processing

A Minilab Film Processor FP363SC, a product of Fuji Photo Film Co., Ltd., was operated continuously (running test mode) until the volume of the replenisher used for the following processing procedures became 0.5 time that of the developer tank. In the above running test, the amount ratio of the three types of film 1), 2) and 3) was 1:3:1, each exposed to light in 30% of the total area.

| Processing steps | Temperature | Time | Replenished volume | Tank volume |
|---|---|---|---|---|
| Color development | 38.0° C. | 3 minutes 5 seconds | 15 mL | 10.3 L |
| Blix | 38.0° C. | 50 seconds | 5 mL | 3.6 mL |
| Fix (1) | 38.0° C. | 50 seconds | — | 3.6 mL |
| Fix (2) | 38.0° C. | 50 seconds | 7.5 mL | 3.6 mL |
| Stabilization (1) | 38.0° C. | 20 seconds | — | 1.9 mL |
| Stabilization (2) | 38.0° C. | 20 seconds | — | 1.9 mL |
| Stabilization (3) | 38.0° C. | 20 seconds | 30 mL | 1.9 mL |
| Drying | 60° C. | 1 minutes 30 seconds | | |

* The replenished volume is per 1.1 m long 35 mm film, which is equivalent to a film roll for taking 24 pictures.

The stabilizing composition flew counterwise from (3) to (1), and the fixing liquid was also allowed to flow through counter flow pipes from (2) to (1). The tank liquid of stabilizer (2) was transferred into fix (2) by 15 mL, which was equal to the replenished volume. Further, the replenishment of the color developer is carried out with a total of 15 mL comprising 12 ml of the replenisher for the following developer (A) and 3 mL for the following developer (B). By the way, the carried-over volume of the developer to the blix step, the same volume of the blix liquid to the fixing step, and the same volume of the fixing liquid to the rinse step, each being 2.0 mL per 1.1 m long 35-mm film. The cross-over time was 6 seconds for these two steps, and this time was included in that of the preceding

| [Color developer A] | [Tank liquid] | [Replenisher] |
|---|---|---|
| Water | 800 mL | 800 mL |
| Ethylenediaminetetraacetic acid | 2.0 g | 4.0 g |
| Sodium 4,5-dihydroxybenzene-1, 3-disulfonate acid | 0.4 g | 0.5 g |
| Disodium-N, N-bis(sulfonato-ethyl)hydroxylamine | 10.0 g | 15.0 g |
| Sodium sulfite | 4.0 g | 9.0 g |
| Potassium bromide | 1.4 g | — |
| Ethylene glycol | 10.0 g | 17.0 g |
| Ethylene urea | 3.0 g | 5.5 g |
| 2-methyl-4-[N-ethyl-N-(β-hydroxyethyl)amino] aniline sulfate | 4.7 g | 11.0 g |
| Potassium carbonate | 39.0 g | 59.0 g |
| Water to make | 1000 mL | 1000 mL |
| pH (25° C., adjusted with sulfuric acid and KOH) | 10.05 | 10.50 |

The above tank liquid formulation corresponds to that of color developer A mixed with the following developer B.

| [Color developer B] | [Tank liquid] | [Replenisher] |
|---|---|---|
| Hydroxyalamine sulfate | 2.0 g | 4.0 g |
| Water to make | 1000 mL | 1000 mL |
| pH (25° C., adjusted with sulfuric acid and KOH) | 10.05 | 4.0 |

The above tank liquid formulation corresponds to that of color developer B mixed with developer A described above.

| [Blix liquid] | [Tank liquid] | [Replenisher] |
|---|---|---|
| Water | 800 mL | 800 mL |
| Fe (III), ammonium salt of 1,3-diaminopropaneteteraacetic acid monohydrate | 120 g | 180 g |
| Ammonium bromide | 50.0 g | 70.0 g |
| Succinic acid | 30.0 g | 50.0 g |
| Maleic acid | 40.0 g | 60.0 g |
| Imidazole | 20.0 g | 30.0 g |
| Water to make | 1000 mL | 1000 mL |
| pH (25° C., adjusted with nitric acid and aqueous ammonia) | 4.60 | 4.00 |

| [Fixing liquid] | [Tank liquid] |
|---|---|
| Added compound listed in Table 3 | 2 mmole |
| Ammonium thiosulfate (750 g/L) | 280 mL |
| Ammonium bisulfite 72% aqueous solution | 20.0 g |
| Imidazole | 35.0 g |
| Ethylenediaminetetraacetic acid | 8.0 g |
| Water to make | 1000 mL |
| pH (25° C., adjusted with nitric acid and aqueous ammonia) | 7.00 |

A replenisher for fixing liquid was prepared by diluting the fixing composition (corresponding to the added compound described above) prepared in (1) to 1.2 times volume with water.

| [Stabilizer] | [Common to the tank and replenishing liquids] |
|---|---|
| Water | 800 mL |
| Sodium p-toluenesulfonate | 0.03 g |
| p-Nonylphenyl polyglycidol (Average polymerization degree of glycidol = 10) | 0.40 g |
| Disodium ethylenediaminetetraacetate | 0.05 g |
| 1,2,4-Triazole | 1.3 g |
| 1,4-bis(1,2,4-Triazole-1-ylmethyl)piperazine | 0.75 g |
| 1,2-benzoisothiazoline-3-one | 0.10 g |
| Water to make | 1000 mL |
| pH (25° C., adjusted with nitric acid and aqueous ammonia) | 7.00 |

(4) Evaluation

1) Stability against precipitate deposition

The same evaluating operations were carried out as in Example 1.

2) Photographic performance in color negative film processing

A piece of unexposed Fujicolor Super 400 film of Fuji Photo Film Co., Ltd. that had been processed was subjected to transmission spectral measurement with a spectrometer U-3500 of Hitachi Co., Ltd. The absorbance at 540 nm is designated as $D_G$. Then, the no compound added, reference sample 29 was washed with 30° C. distilled water for 3 minutes, and then subjected to the same measurement. The obtained absorbance at 540 nm is designated as $D_{GO}$.

$\Delta D_G$ was calculated by the equation below to evaluate the level of stain caused by the sensitizing dyes remaining in the material after processing.

$$\Delta D_G = D_G - D_{GO}$$

3) Results

TABLE 3

| Sample | Added compound | Added amount (mmole) | Precipitate deposition evaluation −5° C. | Precipitate deposition evaluation room temperature | Stain evaluation ($\Delta D_B$) | Notes |
|---|---|---|---|---|---|---|
| 29 | None | — | A | A | 0.025 | Comparative example |
| 30 | III-3 | 5 | D | D | 0.004 | Comparative example |
| 31 | III-5 | 5 | D | D | −0.004 | Comparative example |
| 32 | I-1 | 5 | A | A | −0.002 | Present invention |
| 33 | I-20 | 5 | A | A | 0.001 | Present invention |
| 34 | I-46 | 5 | B | A | 0.004 | Present invention |
| 35 | II-5 | 5 | B | A | −0.003 | Present invention |
| 36 | II-10 | 5 | A | A | −0.001 | Present invention |

Samples 30 and 31 using the known compounds are almost equivalent to samples of the present invention as for stain formation due to the residual sensitizing dyes, but they all gave rise to precipitate in 4 week storage. As sample 29 to which no compound was added did not form precipitation, the precipitate must have been due to the added compounds.

On the other hand, the photographic materials processed with the processing compositions based on the present invention exhibited low levels of stain $\Delta D_G$ caused by the residual sensitizing dyes. (In other words, they exhibit low minimum green densities.) Moreover, the compositions prepared according to the present invention were perfectly transparent without forming any precipitate in 4 week storage at room temperature. Even after 4 week storage at −5° C., they were transparent or became turbid, but still did not form precipitate at all. These results indicate that the fixing compositions of the present invention not only have a remarkable effect on the reduction of stain associated with residual sensitizing dyes, but will not form precipitate even under low temperature storage conditions.

Example 4

(1) Preparation of color developer composition

Samples 37 to 44 having the following compositions were prepared.

| | |
|---|---|
| Water | 800 mL |
| A compound represented by general formula (II) or a comparative compound | See Table 4 |
| Diethylenetriaminetetraacetic acid | 9.0 g |
| Sodium 4,5-dihydroxybenzene-1,3-disulfonate | 8.0 g |
| Disodium-N,N-bis (sulfonato-ethyl) hydroxylamine | 12.0 g |
| Sodium sulfite | 14.0 g |
| Diethylene glycol | 22.5 g |
| Ethylene urea | 7.5 g |
| 2-Methyl-4-[N-ethyl-N-(β-hydroxyethyl)amino] aniline sulfate | 15.0 g |
| Potasium carbonate | 100 g |
| Water to make | 1000 mL |
| pH (25° C., adjusted with sulfuric acid and KOH) | 12.25 |

(2) Photographic materials

The following color negative films were processed.

1) Fujicolor Super 100, a product of Fuji Photo Film Co. Ltd. Production number N26-106
2) Fujicolor Super 400, a product of Fuji Photo Film Co. Ltd. Production number V11-128
3) Fujicolor Super G Ace 800, a product of Fuji Photo Film Co. Ltd. Production number M70-111

(3) Development Processing

A Minilab Film Processor FP363SC, a product of Fuji Photo Film Co., Ltd., was modified so that the processing periods and temperatures can be changed at will. The modified processor was operated continuously (running test mode), until the volume of the replenisher used for the following processing procedures became 0.5 time that of the developer tank. In the above running test, the amount ratio of the three types of film 1), 2) and 3) was 1:3:1, each exposed to light in 30% of the total area.

| Processing steps | Temperature | Time | Replenished volume | Tank volume |
|---|---|---|---|---|
| Color development | 41.0° C. | 2 minutes | 12 mL | 10.3 L |
| Blix | 41.0° C. | 20 seconds | 5 mL | 3.6 mL |
| Fix (1) | 41.0° C. | 20 seconds | — | 3.6 mL |
| Fix (2) | 41.0° C. | 20 seconds | 7.5 mL | 3.6 mL |
| Stabilization (1) | 41.0° C. | 130 seconds | — | 1.9 mL |
| Stabilization (2) | 41.0° C. | 13 seconds | — | 1.9 mL |
| Stabilization (3) | 41.0° C. | 14 seconds | 25 mL | 1.9 mL |
| Drying | 60° C. | 30 seconds | | |

* The replenished volume is per 1.1 m long 35 mm film, which is equivalent to a film roll for taking 24 pictures.

The stabilizing composition flew counterwise from (3) to (1), and the fixing liquid was also allowed to flow through counter flow pipes from (2) to (1). The tank liquid of stabilizer (2) was transferred into fix (2) by 15 mL, which is equal to the replenished volume. Further, the replenishment of the color developer is carried out with a total of 15 ml comprising 12 mL of the replenisher for the following developer (A) and 3 mL for the following developer (B) By the way, both the carried-over volume of the developer to the blix step, the same volume of the blix liquid to the fixing step, and the same volume of the fixing liquid to the rinse step, each was 2.0 mL per 1.1 m long 35 mm film. The cross-over time was 6 seconds for these two steps, and this time was included in that of the preceding step.

| [Color developer composition A] | [Tank liquid] |
|---|---|
| Water | 800 mL |
| Added compound listed in Table 4 | 4 mmole |
| Diethylenetriaminepentaacetic acid | 2.0 g |
| Sodium 4.5-dihydroxybenzene-1,3-disulfonate | 0.4 g |
| Disodium-N, N-bis(sulfonato ethyl)hydroxylamine | 10.0 g |
| Sodium sulfite | 4.0 g |
| Potassium bromide | 1.4 g |
| Diethylene glycol | 10.0 g |
| Ethylene urea | 3.0 g |
| 2-Methyl-4-[N-ethyl-N-(β-hydroxyethyl)amino] aniline sulfate | 5.7 g |
| Potassium carbonate | 39.0 g |
| Water to make | 1000 mL |
| pH (25° C., adjusted with sulfuric acid and KOH) | 10.10 |

The above tank liquid formulation corresponds to that of color developer A mixed with the following developer B.

A replenisher for the color developer A was prepared by diluting the color developer composition (each differing in the added compound) prepared in (1) by 2.1 times with water.

| | [Tank liquid] | [Replenisher] |
|---|---|---|
| [Color developer B] | | |
| Hydroxyalamine sulfate | 2.0 g | 4.0 g |
| Water to make | 1000 ml | 1000 ml |
| pH (25° C., adjusted with sulfuric acid and KOB) | 10.10 | 4.0 |
| [Bleaching solution] | | |
| Water | 800 ml | 800 ml |
| Fe (III), ammonium salt of 1,3-diaminopropanetetraacetic acid · monohydrate | 150 g | 200 g |
| Ammonium bromide | 50.0 g | 70.0 g |
| Succinic acid | 50.0 g | 80.0 g |
| Imidazole | 50.0 g | 80.0 g |
| Water to make | 1000 ml | 1000 ml |
| pH (25° C., adjusted with nitric acid and aqueous ammonia) | 4.20 | 3.80 |
| [Fixing solution] | | |
| Ammonium thiosulfate (750 g/l) | 280 ml | 745 ml |
| Ammonium bisulfite 72% aqueous solution | 20.0 g | 80.0 g |
| Imidazole | 12.0 g | 35.0 g |
| 1-Mercapto-2-(N,N-dimethylaminoethyl)tetrazole | 0.6 g | 1.8 g |
| Ethylenediaminetetraacetic acid | 3.0 g | 9.0 g |
| Water to make | 1000 ml | 1000 ml |
| pH (25° C., adjusted with nitric acid and aqueous ammonia) | 7.00 | 7.00 |

| | [Common to the tank and replenishing liquids] |
|---|---|
| [Stablizer] | |
| Water | 800 mL |
| Sodium p-toluenesulfinate | 0.03 g |
| p-nonylphenyl polyglycidol (average polymerization degree of glycidol = 10) | 0.40 g |
| Disodium ethylenediaminetetraacetate | 0.05 g |
| 1,2,4-triazole | 1.3 g |
| 1,4-bis(1,2,4-triazole-1-ylmethyl)piperazine | 0.75 g |
| 1,2-benzoisothiazoline-3-one | 0.10 g |
| Water to make | 1000 mL |
| pH (25° C., adjusted with nitric acid and aqueous ammonia) | 7.00 |

(4) Evaluation

1) Stability against precipitate deposition

The same evaluating operations were carried out as in Example 1.

2) Photographic performance in color negative film processing

A piece of unexposed Fujicolor Super 400 film of Fuji Photo Film Co., Ltd. that had been processed was subjected to transmission spectral measurement with a spectrometer U-3500 of Hitachi Co., Ltd. The absorbance at 540 nm is designated as $D_G$. Then, the no compound added, reference sample 29 was washed with 30° C. distilled water for 3 minutes, and then subjected to the same measurement. The obtained absorbance at 540 nm is designated as $D_{GO}$.

$\Delta D_G$ was calculated by the equation below to evaluate the level of stain caused by the spectral sensitizers remaining in the material after processing.

$$\Delta D_G = D_G - D_{GO}$$

Results

TABLE 4

| Sample | Added compound | Added amount (mmole) | Evaluation of precipitate deposition: −5° C. | Evaluation of precipitate deposition: room temperature | Stain evaluation ($\Delta D_G$) | Notes |
|---|---|---|---|---|---|---|
| 37 | None | — | A | A | 0.045 | Comparative example |
| 38 | III-3 | 15 | D | C | 0.003 | Comparative example |
| 39 | III-5 | 15 | D | C | −0.005 | This invention |
| 40 | I-1 | 15 | A | A | 0.000 | This invention |
| 41 | I-20 | 15 | A | A | 0.002 | This invention |
| 42 | I-46 | 15 | A | A | 0.004 | This invention |
| 43 | II-5 | 15 | B | A | −0.003 | This invention |
| 44 | II-10 | 15 | A | A | −0.001 | This invention |

Samples 38 and 39 using known compounds are almost equivalent to those based on the present invention as for stain formation due to the residual sensitizing dyes, but they all formed precipitate during a prolonged storage. As sample 37 to which no compound was added did not form precipitate, the precipitate must have been caused by the added compounds.

On the other hand, the photographic materials processed with the processing compositions based on the present invention exhibited low levels of stain $\Delta D_G$ caused by the residual sensitizing dyes. (In other words, they exhibit low minimum green densities.) Moreover, the compositions prepared according to the present invention were perfectly transparent without forming any precipitate in 4 week storage at room temperature. And even after 4 week storage at −5° C., they were transparent or became turbid, but still did not form precipitate at all. These results indicate that, when the color developer compositions of the present invention were used to process color negative films in a markedly shortened processing time, they have not only a remarkable effect on the reduction of stain associated with residual sensitizing dyes, but will not form precipitate even under low temperature storage conditions.

Example 5

(1) Preparation of photosensitive material

1. Support

The support used in the present example was prepared as follows.

1) First layer and undercoat layer

A polyethylene naphthalate (PEN) film with a thickness of 90 μm was subjected to glow discharge treatment on both surfaces with the conditions of 2.66×10 Pa atmospheric pressure, 75% $H_2O$ partial pressure in the atmospheric gas, 30 kHz discharge frequency, 2500 W output, and 0.5 kV•A•min/m$^2$ processing intensity. On the thus treated film, the coating mixture of the following composition was coated by the bar coating method disclosed in examined Japanese Patent Publication No. 58-4589 to give rise to a first layer. The coated amount was 5 mL/m$^2$.

| | |
|---|---|
| Dispersion of a finely divided electro-conductive material (a 10% aqueous dispersion of $SnO_2/Sb_2O_5$ particles having an average particle diameter of 0.05 μm for the secondary aggregate of primary particles of 0.005 μm diameter) | 50 part by weight |
| Gelatin | 0.5 part by weight |
| Water | 49 parts by weight |
| Polyglycerol polyglycidyl ether | 0.16 part by weight |
| Poly(oxyethylene sorbitan)monolaurate (degree of of polymerization = 20) | 0.1 part by weight |

After the coating of the first layer, the film was wound around a 20 cm diameter stainless steel pipe for annealing at 110° C. (Tg of PEN film=119° C.) for 48 hours. Then, on the surface opposite to the one having the first layer, the following mixture for undercoating was coated with a coating bar at a coating amount of 10 mL/m$^2$.

| | |
|---|---|
| Gelatin | 1.01 parts by weight |
| Salicylic acid | 0.30 part by weight |
| Resorcin | 0.40 part by weight |
| Poly(oxyethylene)nonylphenyl ether (degree of polymerization = 10) | 0.11 part by weight |
| Water | 3.53 parts by weight |
| Methanol | 84.57 parts by weight |
| n-Propanol | 10.08 parts by weight |

Second and third layers were superimposed on the above-described first layer, and finally color negative photographic layers were provided on the undercoat layer. Via these coating procedures, a transparent magnetic recording medium having silver halide photographic emulsion layers was prepared.

2) Second layer (a transparent magnetic recording layer)

① Dispersion of a magnetic material

The following ingredients were blended with an open kneader for 3 hours to obtain a crude dispersion.

| | |
|---|---|
| Cobalt-coated $\gamma$-$Fe_2O_3$ magnetic particles (average long axis length: 0.25 μm, $S_{BET}$: 39 m$^2$/g, $H_c$: 6.56 × 10$^4$ A/m, $\sigma_s$: 77.1 Am$^2$/kg and $\sigma_r$: 37.4 Am$^2$/kg | 1,100 parts by weight |
| Water | 220 parts by weight |
| Silane coupling agent (3-poly(oxyethynyl)oxy-propyltrimethoxysilane) (degree of polymerization = 10) | 165 parts by weight |

After dried overnight at 70° C. to remove water, the resulting viscous dispersion was heated at 110° C. for 1 hour to obtain surface treated magnetic particles, which were further blended together with the following ingredients with the open kneader for 4 hours.

| | |
|---|---|
| The surface-treated magnetic particles prepared above | 855 g |
| Diacetyl cellulose | 25.3 g |
| Methyl ethyl ketone | 136.3 g |
| Cyclohexanone | 136.3 g |

Another mixture, prepared by adding the ingredients shown below to the resulting dispersion, was dispersed with a 1/4 G sand mill at 2000 rpm for 4 hours. The dispersion media were 1 mmø glass beads.

| | |
|---|---|
| The dispersion prepared above | 45 g |
| Diacetyl cellulose | 23.7 g |
| Methyl ethyl ketone | 127.7 g |
| Cyclohexanone | 127.7 g |

Using the resulting magnetic fine dispersion, a magnetic preliminary mixture was prepared as follows.

② Preparation of a magnetic preliminary mixture

| | |
|---|---|
| Magnetic fine dispersion | 674 g |
| Diacetyl cellulose solution (solid content: 4.34%, solvent; 1/1 mixture of methyl ethyl ketone and cyclohexanone) | 24,280 g |
| Cyclohexanone | 46 g |

These ingredients were mixed together and then stirred with a Disper.

Separately, a dispersion of α-alumina abradant was prepared having the following formula.

(a) Preparation of Sumicorundum AA-1.5 (average primary particle diameter: 1.5 μm, specific surface area: 1.3 $m^2/g$)

| | |
|---|---|
| Sumicorundum AA-1.5 | 152 g |
| Silane coupling agent KBM903 (made by Shin-etsu Silicone Co., Ltd.) | 0.48 g |
| Diacetyl cellulose (solid content: 4.5%, solvent; 1/1 mixture of methyl ethyl ketone and cyclohexanone) | 227.52 g |

These ingredients were finely dispersed with a 1/4 G ceramic-coated sand mill at 800 rpm for 4 hr. The dispersion media were 1 mmø zirconia beads.

(b) Colloidal silica dispersion (Minute particles)

MEK-ST, a product of Nissan Chemical Co Ltd., was used, which consists of colloidal silica with an average primary particle diameter of 0.015 μm dispersed in methyl ethyl ketone at a solid content of 30%.

③ Preparation of a coating mixture for the second layer

| | |
|---|---|
| The magnetic preliminary mixture prepared above | 19,053 g |
| Diacetyl cellulose solution (solid content: 4.5%, solvent; 1/1 mixture of methyl ethyl ketone and cyclohexanone) | 264 g |
| Colloidal silica dispersion "MEK-ST" (Dispersion b) (solid content: 30%) | 128 g |
| AA-1.5 Dispersion (Dispersion a) | 12 g |
| Milionate MR-400 (a product of Nippon Polyurethane Co., Ltd.) diluted solution (solid content: 20%, diluting solvent: 1/1 mixture of methyl ethyl ketone and cyclohexanone) | 203 g |
| Methyl ethyl ketone | 170 g |
| Cyclohexanone | 170 g |

All these ingredients were mixed under stirring to give a coating mixture, which was coated with a wire bar in such a manner as to give a coating amount of 29.3 $mL/m^2$. After dried at 110° C., the coated magnetic layer had a thickness of 1.0 g m.

3) Third layer (a lubricant layer containing a higher fatty acid ester)

① Preparation of a primary lubricant dispersion

The following fluid a that had been melted at 100° C. was added to the following fluid. A primary lubricant dispersion was prepared by dispersing the resulting mixture in a high pressure homogenizer.

| | |
|---|---|
| Fluid a | |
| $C_6H_{13}CH(OH)(CH_2)_{10}COOC_{50}H_{101}$ | 399 parts by weight |
| $n\text{-}C_{50}H_{101}O(CH_2CH_2O)_{16}H$ | 171 parts by weight |
| Cyclohexanone | 830 parts by weight |
| Fluid b | |
| Cyclohexanone | 8600 parts by weight |

② Preparation of a particulate spherical inorganic material dispersion

A particulate spherical inorganic material dispersion (C1) consisting of the following ingredients was prepared.

| | |
|---|---|
| Isopropyl alcohol | 93.54 parts by weight |
| Silane coupling agent KBM903 (a product of Shin-etsu Silicone Co., Ltd.) | |
| Compound 1-1: $(CH_3O)_3Si—(CH_2)_3—NH_2$) | 5.53 parts by weight |
| Compound 1 | 2.93 parts by weight |

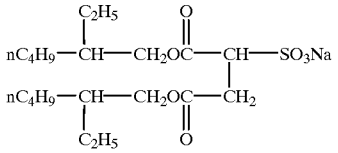

| | |
|---|---|
| SEAHOSTAR KE-P50 (amorphous spherical silica with an average particle size of 0.5 μm, made by Nippon Shokubai Co., Ltd.) | 88.00 parts by weight |
| These ingredients were stirred for 10 minutes followed by the addition of | |
| Diacetone alcohol | 252.93 parts by weight |

The resulting fluid was dispersed with an ultrasonic homogenizer, "SONIFIER 450", a product of BRANSON Ltd., for 3 hours to provide particulate spherical inorganic material dispersion C1.

③ Preparation of a particulate spherical organic polymer dispersion

A particulate spherical organic polymer dispersion (C2) consisting of the following ingredients was prepared. XC99-A8808 (a product of Toshiba Silicone Co., Ltd., spherical cross-linked polysiloxane particles with an average particle size of 0.9 μm)

| | |
|---|---|
| Methyl ethyl ketone | 120 parts by weight |
| Cyclohexanone | 120 parts by weight |
| (Solid content: 20%, solvent: 1/1 mixture of methyl ethyl ketone and cyclohexanone | |

These ingredients were mixed with an ultrasonic homogenizer, "SONIFIER 450", a product of BRANSON Ltd., for 2 hours to provide particulate spherical organic polymer dispersion C2.

④ Preparation of a coating mixture for the third layer

The following ingredients were added to 542 g of the primary lubricant dispersion to form a coating mixture for the third layer.

| | |
|---|---|
| Diacetone alcohol | 5,950 g |
| Cyclohexanone | 176 g |

-continued

| | |
|---|---|
| Ethyl acetate | 1700 g |
| Particulate spherical inorganic material dispersion Cl | 53.1 g |
| Particulate spherical organic polymer dispersion C2 | 300 g |
| FC 431 (a product of 3M Inc., solid content: 50%, solvent: ethyl acetate) | 2.65 g |
| BYK 310 (a product of BYK ChemiJapan Co., Ltd., solid contnet: 25%) | |

The thus prepared coating mixture for the third layer was coated on the second layer at a coating amount of 10.35 mL/m$^2$ and dried at 110° C., followed by a subsequent drying at 97° C. for 3 minutes.

2. Photographic layers

Next, on the opposite side of the back surface on which the three layers had been superimposed as described heretofore, 16 layers of the following formulations were provided to complete a color negative film.

(Formulations of photographic layers)

In the description which follows, the numeral for each ingredient means the coated amount in terms of g/m$^2$ except for silver containing ones. The numeral for silver containing ingredients indicates the coated amount expressed by that of silver.

(Chemical compounds are imparted signs and numbers, and their chemical structures will be shown later.

| | |
|---|---|
| First layer (a first anti-halation layer) | |
| Black colloidal silver | 0.070 (as silver) |
| Gelatin | 0.608 |
| ExM-1 | 0.035 |
| F-8 | 0.001 |
| HBS-1 | 0.050 |
| HBS-2 | 0.002 |
| Second layer (a first anti-halation layer) | |
| Black colloidal silver | 0.089 (as silver) |
| Gelatin | 0.632 |
| ExF-1 | 0.002 |
| F-8 | 0.001 |
| Third layer (an intermediate layer) | |
| Cpd-1 | 0.082 |
| HBS-1 | 0.043 |
| Gelatin | 0.422 |
| Forth layer (a low speed, red sensitive emulsion layer) | |
| Em-D | 0.577 (as silver) |
| Em-C | 0.347 (as silver) |
| ExC-1 | 0.263 |
| ExC-2 | 0.015 |
| ExC-3 | 0.155 |
| ExC-4 | 0.144 |
| ExC-5 | 0.035 |
| ExC-6 | 0.015 |
| Cpd-4 | 0.025 |
| UV-2 | 0.047 |
| UV-3 | 0.086 |
| UV-4 | 0.018 |
| HBS-1 | 0.245 |
| HBS-5 | 0.038 |
| Gelatin | 0.994 |
| Fifth layer (a medium speed, red sensitive emulsion layer) | |
| Em-B | 0.431 (as silver) |
| Em-C | 0.432 (as silver) |
| ExC-1 | 0.110 |
| ExC-2 | 0.027 |
| ExC-3 | 0.007 |
| ExC-4 | 0.075 |
| ExC-5 | 0.007 |

-continued

| | |
|---|---|
| ExC-6 | 0.021 |
| ExC-8 | 0.010 |
| ExC-9 | 0.005 |
| Cpd-2 | 0.032 |
| Cpd-4 | 0.020 |
| HBS-1 | 0.098 |
| Gelatin | 0.802 |
| Sixth layer (a high speed, red sensitive emulsion layer) | |
| Em-A | 1.214 (as silver) |
| ExC-1 | 0.070 |
| ExC-3 | 0.005 |
| ExC-6 | 0.026 |
| ExC-8 | 0.109 |
| ExC-9 | 0.020 |
| Cpd-2 | 0.068 |
| Cpd-4 | 0.020 |
| BBS-1 | 0.231 |
| Gelatin | 1.174 |
| Seventh layer (an intermediate layer) | |
| Cpd-1 | 0.073 |
| Cpd-6 | 0.002 |
| HBS-1 | 0.037 |
| Poly(ethyl acrylate) latex | 0.088 |
| Gelatin | 0.683 |
| Eight layer (a layer exerting an interlayer inter-image effect on the red sensitive layers) | |
| Em-J | 0.153 (as silver) |
| Em-K | 0.153 (as silver) |
| ExM-2 | 0.086 |
| ExM-3 | 0.002 |
| ExM-4 | 0.025 |
| ExY-4 | 0.041 |
| ExC-7 | 0.026 |
| HBS-1 | 0.218 |
| HBS-3 | 0.003 |
| Gelatin | 0.649 |
| Ninth layer (a low speed, green sensitive emulsion layer) | |
| Em-H | 0.329 (as silver) |
| Em-G | 0.333 (as silver) |
| Em-I | 0.088 (as silver) |
| ExM-2 | 0.360 |
| ExM-3 | 0.055 |
| ExY-3 | 0.012 |
| ExC-7 | 0.008 |
| HBS-1 | 0.362 |
| HBS-3 | 0.010 |
| HBS-4 | 0.200 |
| Gelatin | 1.403 |
| Tenth layer (a medium speed, green sensitive emulsion layer) | |
| Em-F | 0.394 (as silver) |
| ExM-2 | 0.049 |
| ExM-3 | 0.034 |
| ExY-3 | 0.007 |
| ExC-7 | 0.012 |
| ExC-8 | 0.010 |
| HBS-1 | 0.060 |
| HBS-3 | 0.002 |
| HBS-4 | 0.020 |
| Gelatin | 0.474 |
| Eleventh layer (a high speed, green sensitive emulsion layer) | |
| Em-E | 0.883 (as silver) |
| ExC-6 | 0.007 |
| ExC-8 | 0.011 |
| ExM-1 | 0.021 |
| ExM-2 | 0.092 |
| ExM-3 | 0.015 |
| Cpd-3 | 0.005 |
| Cpd-5 | 0.010 |
| HBS-1 | 0.176 |
| HBS-3 | 0.003 |
| HBS-4 | 0.070 |

-continued

| | |
|---|---|
| Poly(ethyl acrylate) latex | 0.099 |
| Gelatin | 0.916 |
| Twelfth layer (a yellow filter layer) | |
| Cpd-1 | 0.092 |
| Solid dispersion dye ExF-2 | 0.088 |
| HBS-1 | 0.049 |
| Gelatin | 0.603 |
| Thirteenth layer (a low speed, blue sensitive emulsion layer) | |
| Em-O | 0.112 |
| Em-M | 0.320 |
| Em-N | 0.240 |
| ExC-1 | 0.049 |
| ExC-7 | 0.013 |
| ExY-1 | 0.002 |
| ExY-2 | 0.693 |
| ExY-4 | 0.058 |
| HBS-1 | 0.231 |
| Gelatin | 1.553 |
| Fourteenth layer (a high speed, blue sensitive emulsion layer) | |
| Em-L | 0.858 (as silver) |
| ExY-2 | 0.357 |
| ExY-4 | 0.068 |
| HBS-1 | 0.124 |
| Gelatin | 0.949 |
| Fifteenth layer (a first protecting layer) | |
| Silver iodo-bromide emulsion of 0.07 μm grain size | 0.245 |
| UV-1 | 0.313 |
| UV-2 | 0.156 |
| UV-3 | 0.222 |
| UV-4 | 0.022 |
| F-11 | 0.009 |
| S-1 | 0.068 |
| HBS-1 | 0.175 |
| HBS-4 | 0.020 |
| Gelatin | 1.950 |
| Sixteenth layer (a second protecting layer) | |
| H-1 | 0.356 |
| B-1 (Diameter 1.7 μm) | 0.050 |
| B-2 (Diameter 1.7 μm) | 0.150 |
| B-3 | 0.050 |
| S-1 | 0.200 |
| Gelatin | 0.675 |

Further, W-1 to W-6, B-4 to B-6, F-1 to F-17, and lead salt, platinum salt, iridium salt and/or rhodium salt are appropriately incorporated in each layer in order to secure a sufficiently high level of storage stability, processibility, pressure resistance, anti-septic and antibiotic nature, anti-static property and coating behavior.

Preparation of a dispersion of an organic solid dispersion dye

ExF-2 used in the twelfth layer was prepared as follows.

| | |
|---|---|
| Wet cake of ExF-2 containing 17.6% by weight of water | 2.800 kg |
| Sodium octylphenyldiethoxymethanesulfonate (a 31% by weight aqueous solution) | 0.376 kg |
| F-15 (a 7% by weight aqueous solution) | 0.011 kg |
| Water | 4.020 kg |
| Total (adjusted to pH = 7.2 with NaOH) | 7.210 kg |

After roughly dispersed in a dissolver under stirring, the slurry consisting of the ingredients shown above was finely dispersed with an agitator mill LMK-4 charged with zirconia beads having 0.3 mm diameter at a charging ratio of 80% under the conditions of a peripheral speed of 10 m/s and an ejecting rate of 0.6 kg/min until the absorption ratio of the mixture became 0.29. The average particle diameter of the dispersed dye was 0.29 μm.

TABLE 5

| Name of Emulsion | Average iodine content (mole %) | Sphere equivalent diameter (μm) | Aspect ratio | Circle equivalent diameter (μm) | Grain thickness (μm) | Grain shape |
|---|---|---|---|---|---|---|
| Em-A | 4 | 0.92 | 14 | 2 | 0.14 | tabular |
| Em-B | 5 | 0.8 | 12 | 1.6 | 0.13 | tabular |
| Em-C | 4.7 | 0.51 | 7 | 0.85 | 0.12 | tabular |
| Em-D | 3.9 | 0.37 | 2.7 | 0.4 | 0.15 | tabular |
| Em-E | 5 | 0.92 | 14 | 2 | 0.14 | tabular |
| Em-F | 5.5 | 0.8 | 12 | 1.6 | 0.13 | tabular |
| Em-G | 4.7 | 0.51 | 7 | 0.85 | 0.12 | tabular |
| Em-H | 3.7 | 0.49 | 3.2 | 0.58 | 0.18 | tabular |
| Em-I | 2.8 | 0.29 | 1.2 | 0.27 | 0.23 | tabular |
| Em-J | 5 | 0.8 | 12 | 1.6 | 0.13 | tabular |
| Em-K | 3.7 | 0.47 | 3 | 0.53 | 0.18 | tabular |
| Em-L | 5.5 | 1.4 | 9.8 | 2.6 | 0.27 | tabular |
| Em-M | 8.8 | 0.64 | 5.2 | 0.85 | 0.16 | tabular |
| Em-N | 3.7 | 0.37 | 4.6 | 0.55 | 0.12 | tabular |
| Em-O | 1.8 | 0.19 | — | — | — | cubic |

In Table 5, emulsions A to C are spectrally sensitized with optimal amounts of spectral sensitizers 1 to 3, and further optimally sensitized with gold, sulfur and selenium compounds. Emulsions E to G are spectrally sensitized with optimal amounts of spectral sensitizers 4 to 6, and further optimally sensitized with gold, sulfur and selenium compounds. Emulsion J is spectrally sensitized with optimal amounts of spectral sensitizers 7 and 8, and further optimally sensitized with gold, sulfur and selenium compounds. Emulsion L is spectrally sensitized with optimal amounts of spectral sensitizers 9 to 11, and further optimally sensitized with gold, sulfur and selenium compounds. Emulsion O is spectrally sensitized with optimal amounts of spectral sensitizers 10 to 12, and further optimally sensitized with gold and sulfur compounds. Emulsions D, H, I, K, M and N are spectrally sensitized with optimal amounts of the spectral sensitizers shown in Table 6, and further optimally sensitized with gold, sulfur and selenium compounds.

TABLE 6

| Name of emulsion | Spectral sensitizer | Added amount (mole/mole Ag) |
|---|---|---|
| Em-D | Spectral sensitizer 1 | $5.44 \times 10^{-4}$ |
| | Spectral sensitizer 2 | $2.35 \times 10^{-4}$ |
| | Spectral sensitizer 3 | $7.26 \times 10^{-6}$ |
| Em-H | Spectral sensitizer 8 | $6.52 \times 10^{-4}$ |
| | Spectral sensitizer 13 | $1.35 \times 10^{-4}$ |
| | Spectral sensitizer 6 | $2.48 \times 10^{-5}$ |
| Em-I | Spectral sensitizer 8 | $6.09 \times 10^{-4}$ |
| | Spectral sensitizer 13 | $1.26 \times 10^{-4}$ |
| | Spectral sensitizer 6 | $2.32 \times 10^{-4}$ |
| Em-K | Spectral sensitizer 7 | $6.27 \times 10^{-4}$ |
| | Spectral sensitizer 8 | $2.24 \times 10^{-4}$ |
| Em-M | Spectral sensitizer 9 | $2.43 \times 10^{-4}$ |
| | Spectral sensitizer 10 | $2.43 \times 10^{-4}$ |
| | Spectral sensitizer 11 | $2.43 \times 10^{-4}$ |
| Em-N | Spectral sensitizer 9 | $3.28 \times 10^{-4}$ |
| | Spectral sensitizer 10 | $3.28 \times 10^{-4}$ |
| | Spectral sensitizer 11 | $3.28 \times 10^{-4}$ |

The spectral sensitizers shown in Table 6 have the following molecular structures.

Spectral sensitizer 1

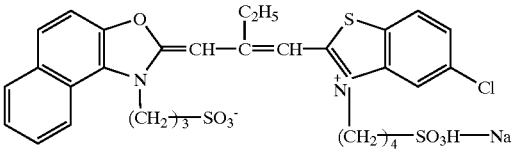

Spectral sensitizer 2

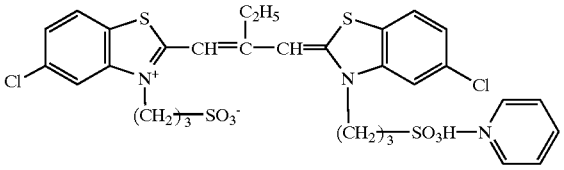

Spectral sensitizer 3

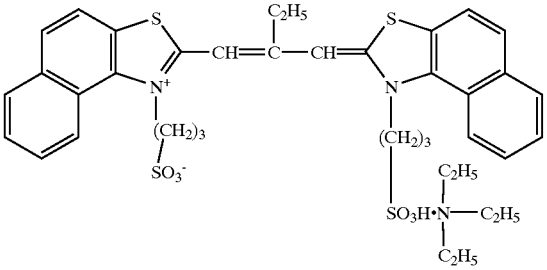

Spectral sensitizer 4

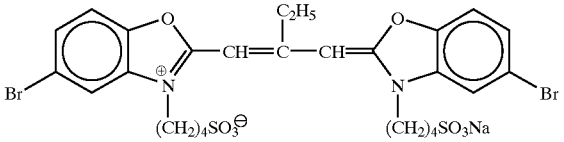

Spectral sensitizer 5

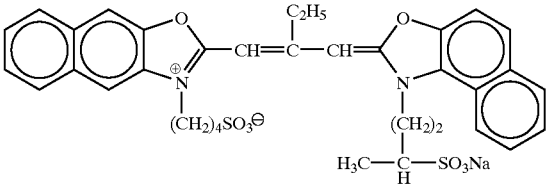

Spectral sensitizer 6

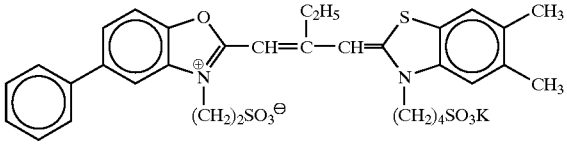

Spectral sensitizer 7

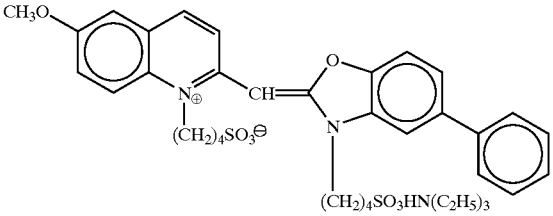

Spectral sensitizer 8

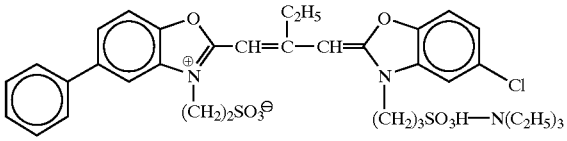

Spectral sensitizer 9

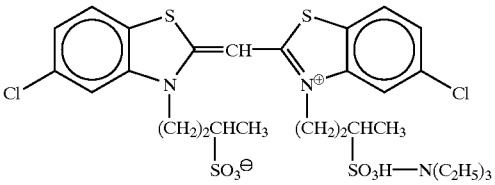

Spectral sensitizer 10

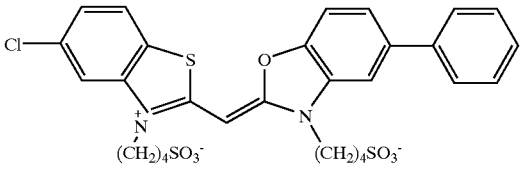

$Et_3NH^+$

Spectral sensitizer 11

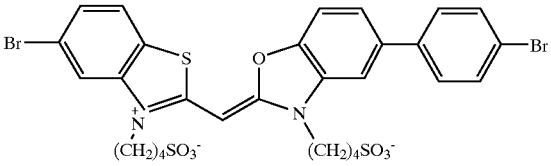

$Et_3NH^+$

Spectral sensitizer 12

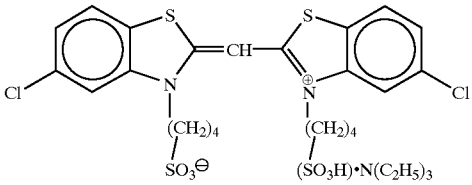

-continued

Spectral sensitizer 13

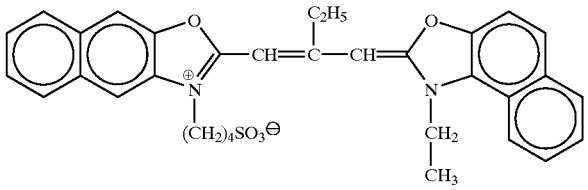

In the preparation of the tabular grain, a low molecular weight gelatin was used following the examples described in JP-A-1-158426.

Emulsions A to K include optimal amounts of Ir and Fe.

Emulsions L to O were subjected to reduction sensitization.

In the tabular grains, dislocation lines like those described in JP-A-3237450 are observed with an electron microscope.

In Emulsions A to C and Emulsion J, dislocations were introduced with the aid of an-iodide ion releasing agent according to the examples in JP-A-6-11782.

In Emulsion E, dislocations were introduced by the addition of silver iodide fine grains that had been prepared just before the addition in an independent chamber equipped with a magnetically coupled induction type stirrer described in JP-A-10-43570.

The molecular structures of the compounds used in all the photographic layers follow.

ExC-1

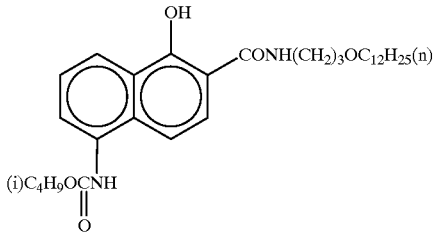

ExC-2

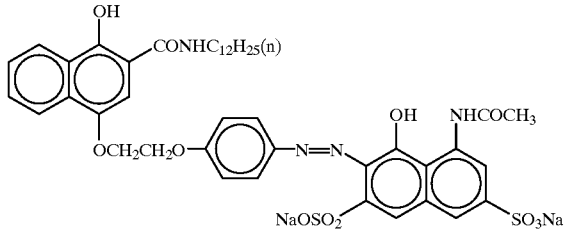

ExC-3

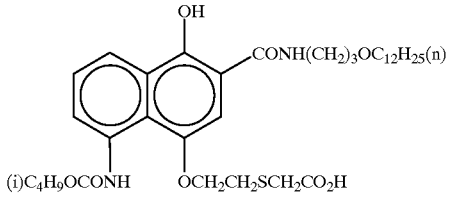

ExC-4

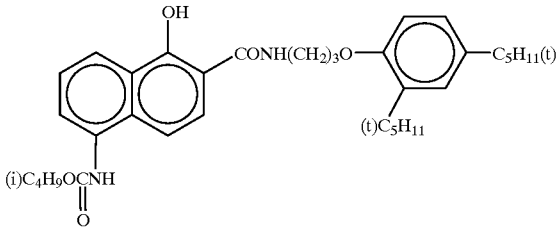

ExC-5

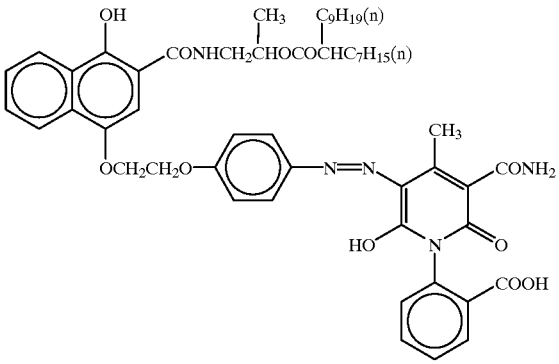

ExC-6

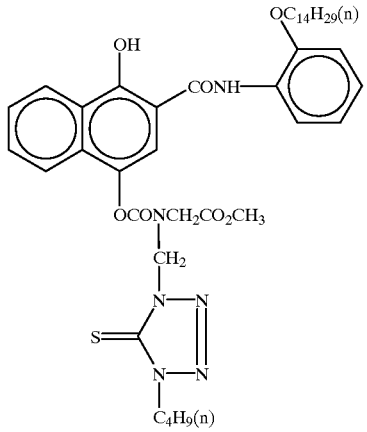

-continued
ExC-7
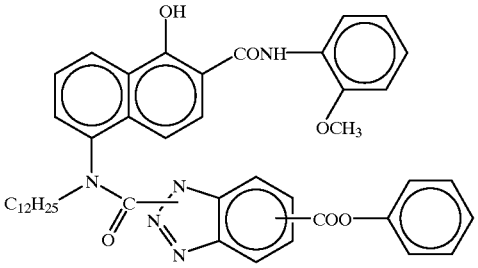
ExC-8
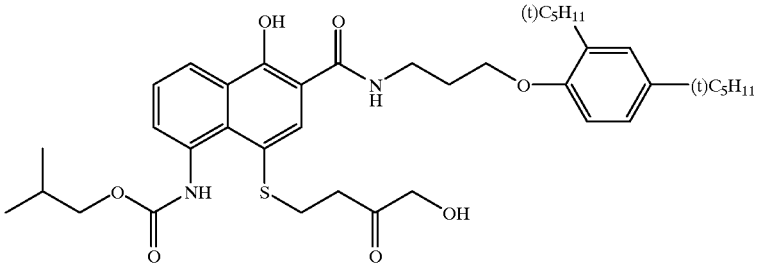
ExC-9
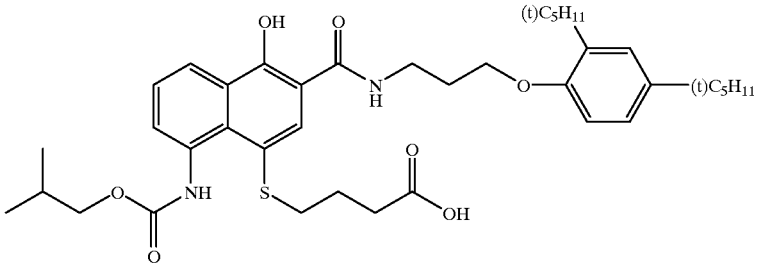
ExM-1
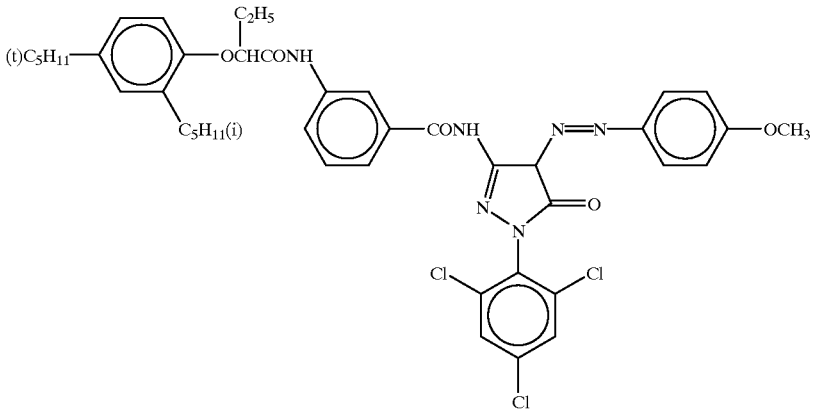

-continued
ExM-2
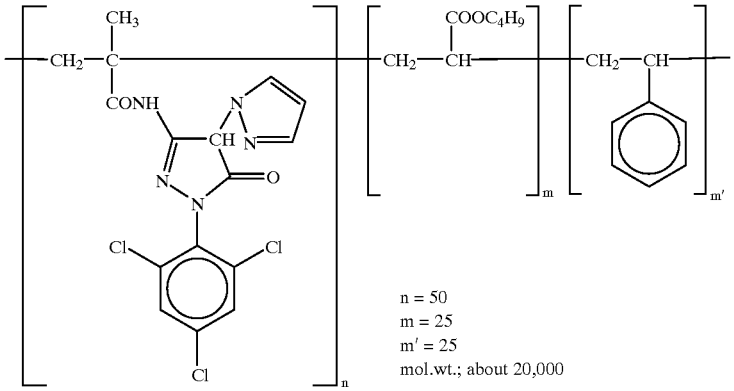
n = 50
m = 25
m' = 25
mol.wt.; about 20,000
ExM-3
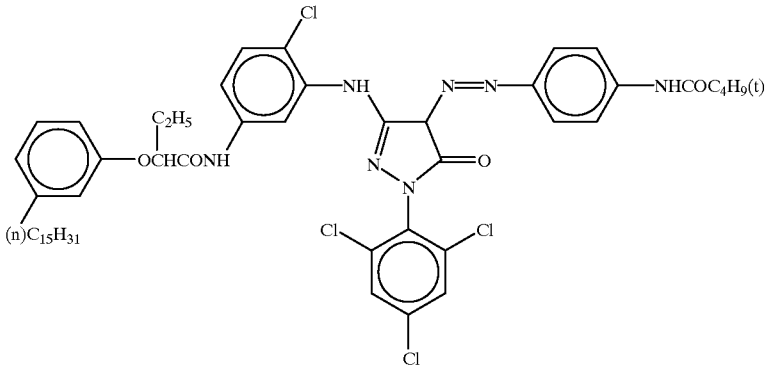
ExM-4
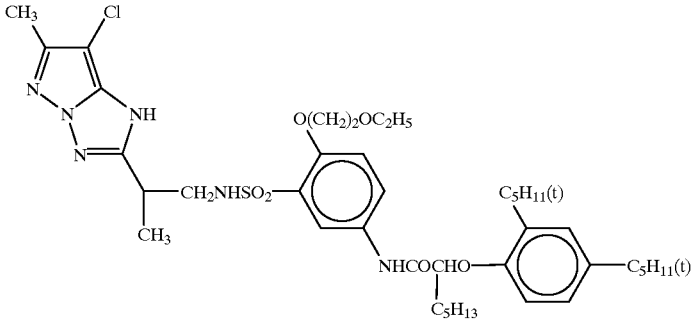
ExY-1
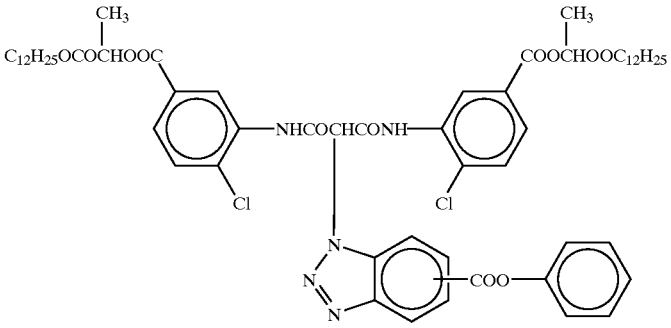

-continued
ExY-2
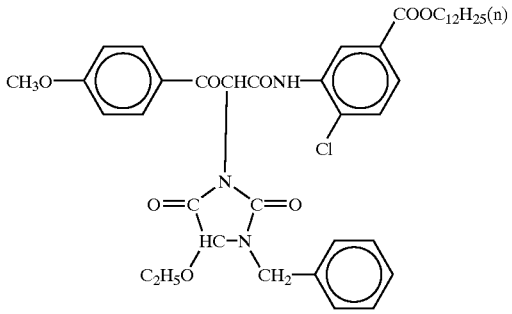
ExY-3
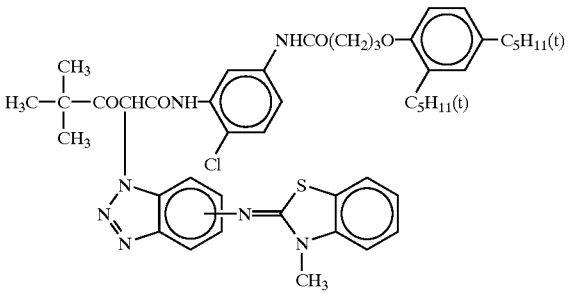
ExY-4
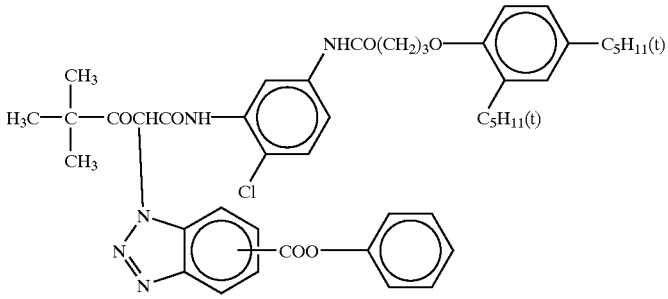
Cpd-1
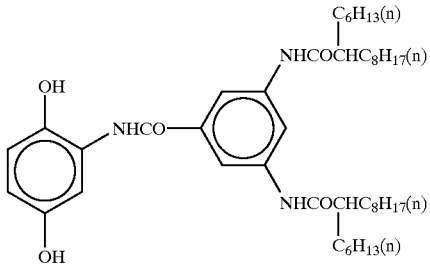
Cpd-2
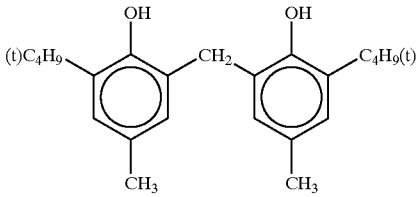
Cpd-3
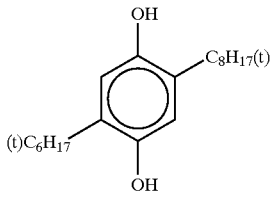
Cpd-4
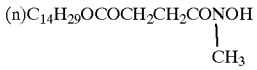
Cpd-5
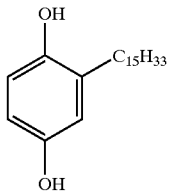
Cpd-6
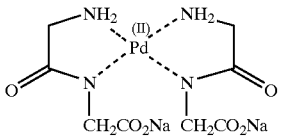
UV-1
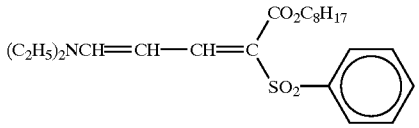
UV-2
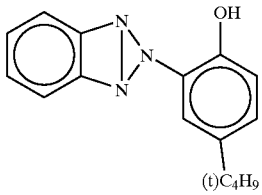

-continued
UV-3
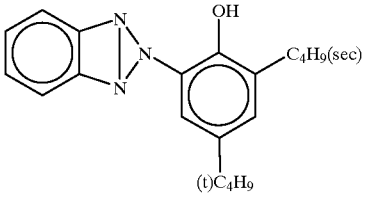
UV-4
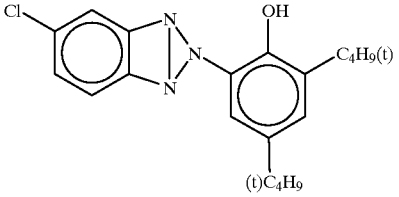
B-1
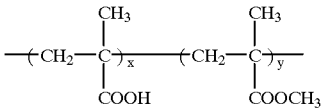
*x/y* = 10/90 (by weight)
Average molecular weight: about 35,000
B-2
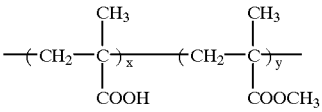
*x/y* = 40/60 (by weight)
Average molecular weight: about 20,000
B-3
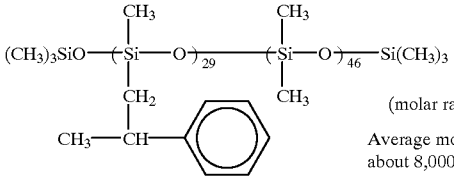
(molar ratio)
Average molecular weight: about 8,000
H-1
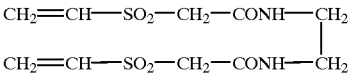
HBS-1
Tricresyl phosphate
HBS-2
Di-n-butyl phthalate
HBS-3
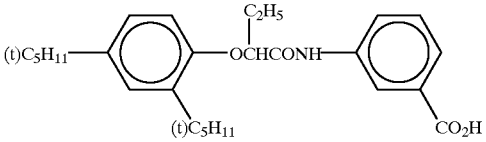
HBS-4
Tri (2-ethylhexyl) phosphate
HBS-5
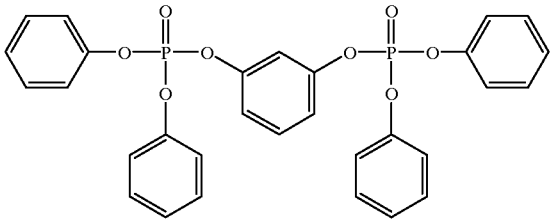
S-1
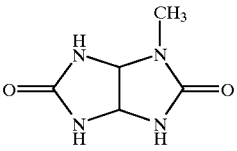
F-1
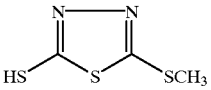
F-2
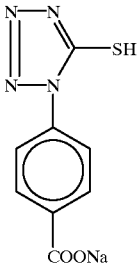
F-3
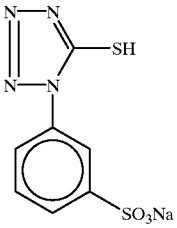
F-4
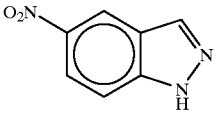

-continued
F-5
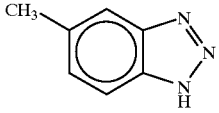
F-6
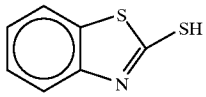
F-7
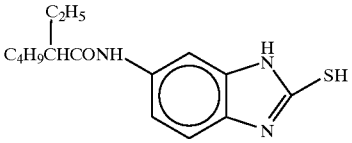
F-8
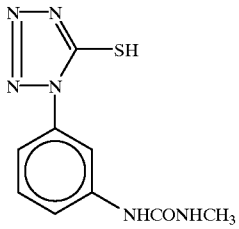
F-9
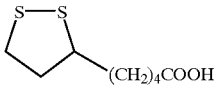
F-10
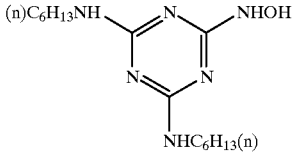
F-11
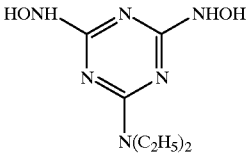
F-12
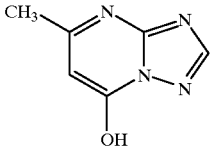
F-13
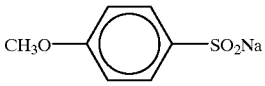
F-14
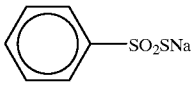
F-15
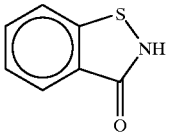
F-16
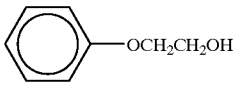
F-17
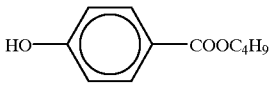
W-1
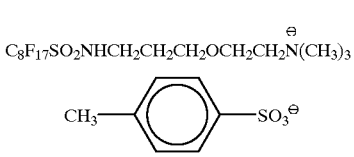
W-2
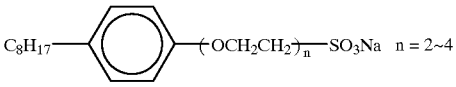
W-3
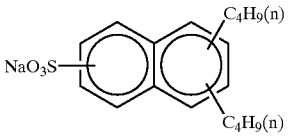
W-4
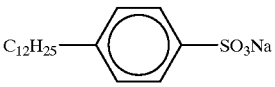
W-5
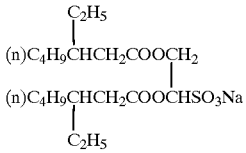

-continued

W-6

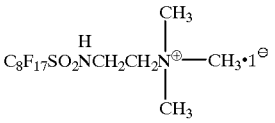

B-4

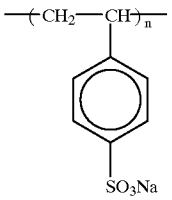

Average molecular weight: about 750,000

B-5

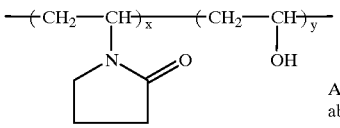

x/y = 70/30 (by weight)

Average molecular weight: about 17,000

B-6

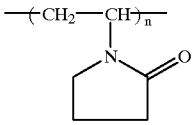

Average molecular weight: about 10,000

ExF-1

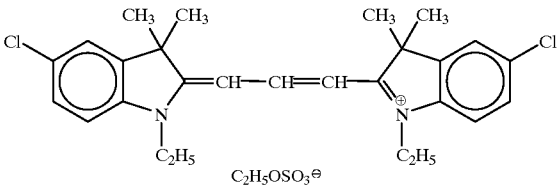

ExF-2

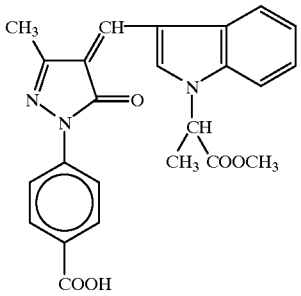

By using the silver halide photographic color material thus prepared, the photographic characteristics were evaluated as in Example 2 with fixing composition samples 29 and 33. Then, the photographic characteristics were evaluated as in Example 3 with fixing composition samples 37 and 41. The results confirmed that the compositions of the invention can effectively suppress stain formation due to residual spectral sensitizers.

By using the processing compositions of the present invention, stain caused by residual sensitizing dyes can be suppressed. Moreover, they will not form precipitate under low temperature storage conditions, and thus can keep a deposit-free state even when the concentration of the chemical contents is raised for rapid processing.

The image formation of the present invention can suppress stain caused by sensitizing dyes remaining in the photographic element after processing, and is suited for rapid processing.

While the invention has been described in detail and with reference to specific embodiments thereof, it will be apparent to one skilled in the art that various changes and modifications can be made therein without departing from the spirit and scope thereof.

What is claimed is:

1. A processing composition for a silver halide photographic material, which comprises at least one compound selected from the group consisting of compounds represented by the following general formulae (I) and (II):

(I)

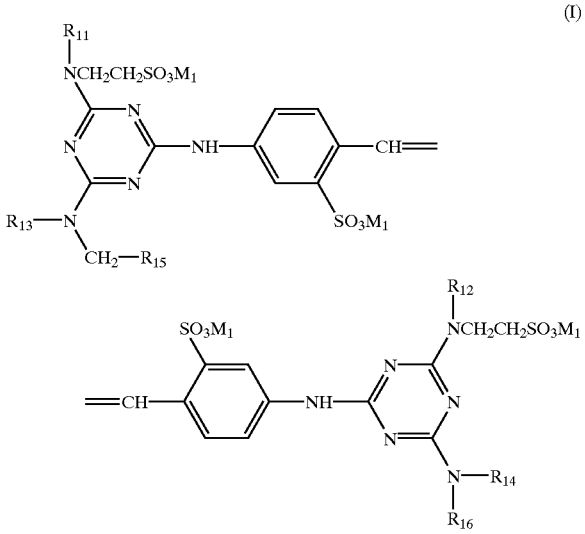

wherein $R_{11}$ and $R_{12}$ each independently represents a hydrogen atom or an alkyl group; $R_{13}$ and $R_{14}$ each independently represents a hydrogen atom, an alkyl group or an aryl group; $R_{15}$ represents an alkyl group having at least one asymmetric carbon atom or a group represented by the following general formula (I-a):

$$—CH_2O(CH_2CH_2O)n_{11}H \quad \text{(I-a)}$$

wherein $n_{11}$ represents an integer of from 1 to 3;

$R_{16}$ represents an alkyl group having at least one asymmetric carbon atom or a group represented by the following general formula (I-b):

$$—(CH_2CH_2O)n_{12}H \quad \text{(I-b)}$$

wherein $n_{12}$ represents an integer of from 2 to 4;

and $M_1$ represents a hydrogen atom, an alkali metal atom, an alkaline earth metal atom, an ammonium group or a pyridinium group, $R_{13}$ may complete a ring together with $R_{15}$, and $R_{14}$ may complete a ring together with $R_{16}$, respectively:

(II)

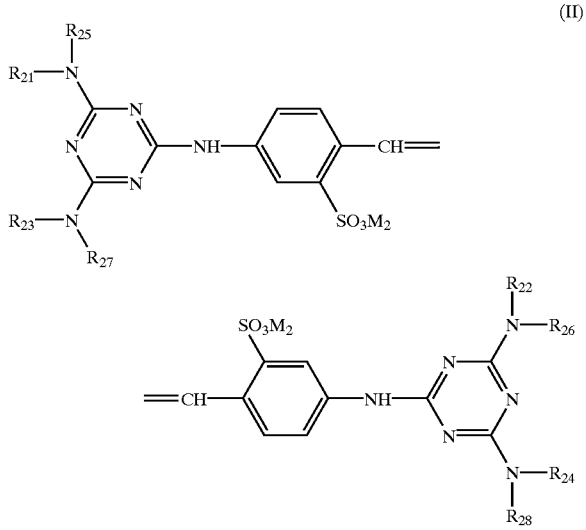

wherein $R_{21}$, $R_{22}$, $R_{23}$ and $R_{24}$ each independently represents a hydrogen atom, an alkyl group or an aryl group; $R_{25}$ and $R_{26}$ each independently represents an alkyl group having at least one asymmetric carbon atom or a group represented by the following general formula (II-a):

$$—(CH_2CH_2O)n_{21}H \qquad \text{(II-a)}$$

wherein $n_{21}$ represents an integer of from 2 to 4;

$R_{27}$, and $R_{28}$ each independently represents an alkyl group having at least one asymmetric carbon; $M_2$ represents a hydrogen atom, an alkali metal atom, an alkaline earth metal atom, an ammonium group or a pyridinium group; $R_{21}$ and $R_{25}$, $R_{22}$ and $R_{26}$, $R_{23}$ and $R_{27}$, and $R_{24}$ and $R_{28}$, each pair may be bonded together to form a ring; and at least one of $R_{25}$, $R_{26}$, $R_{27}$ and $R_{28}$ has at least one asymmetric carbon atom and at least one substituent selected from the group consisting of a hydroxyl group, an amino group and a carboxyl group.

2. The processing composition as claimed in claim 1, wherein the composition contains at least one of the compound represented by general formula (I) in which $R_{15}$ and/or $R_{16}$ contains at least one hydroxyl group and the compound represented by general formula (II) in which at least one group chosen from $R_{25}$, $R_{26}$, $R_{27}$ and $R_{28}$ contains at least one hydroxyl group.

3. The processing composition as claimed in claim 2, wherein the at least one of the compound represented by general formula (I) and the compound represented by general formula (II) has 2 to 8 hydroxyl groups.

4. The processing composition as claimed in claim 3, wherein $R_{11}$, $R_{12}$, $R_{13}$ and $R_{14}$ in general formula (I) and/or $R_{21}$, $R_{22}$, $R_{23}$ and $R_{24}$ in general formula (II) each is a hydrogen atom.

5. The processing composition as claimed in claim 1, wherein the compound represented by general formula (I) is selected from the group consisting of the following compounds:

and the compound represented by general formula (II) is selected from the group consisting of the following compounds:

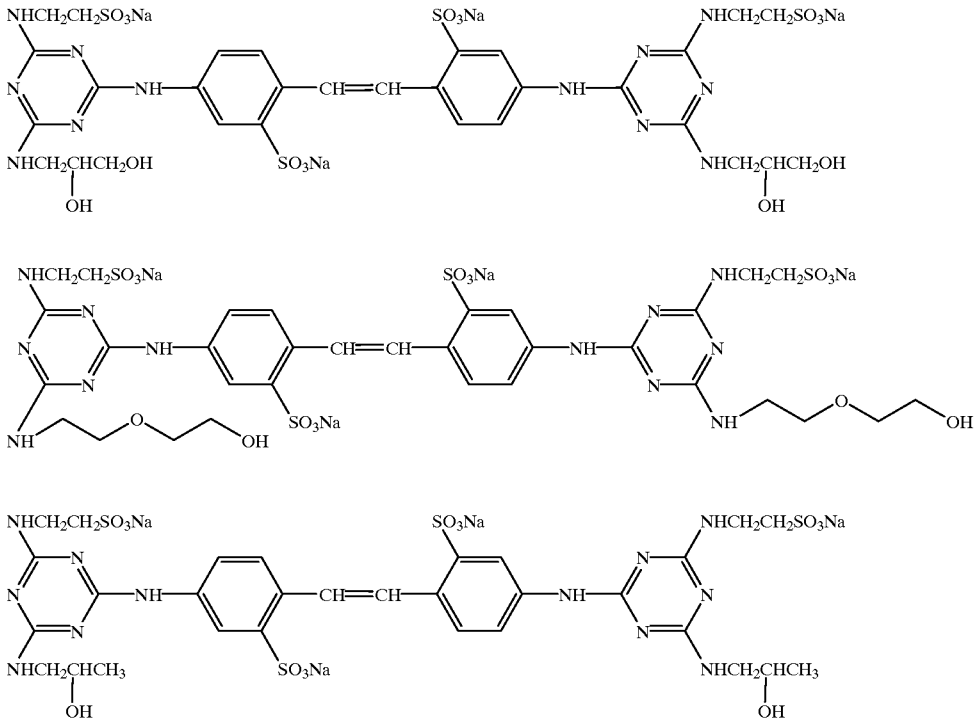

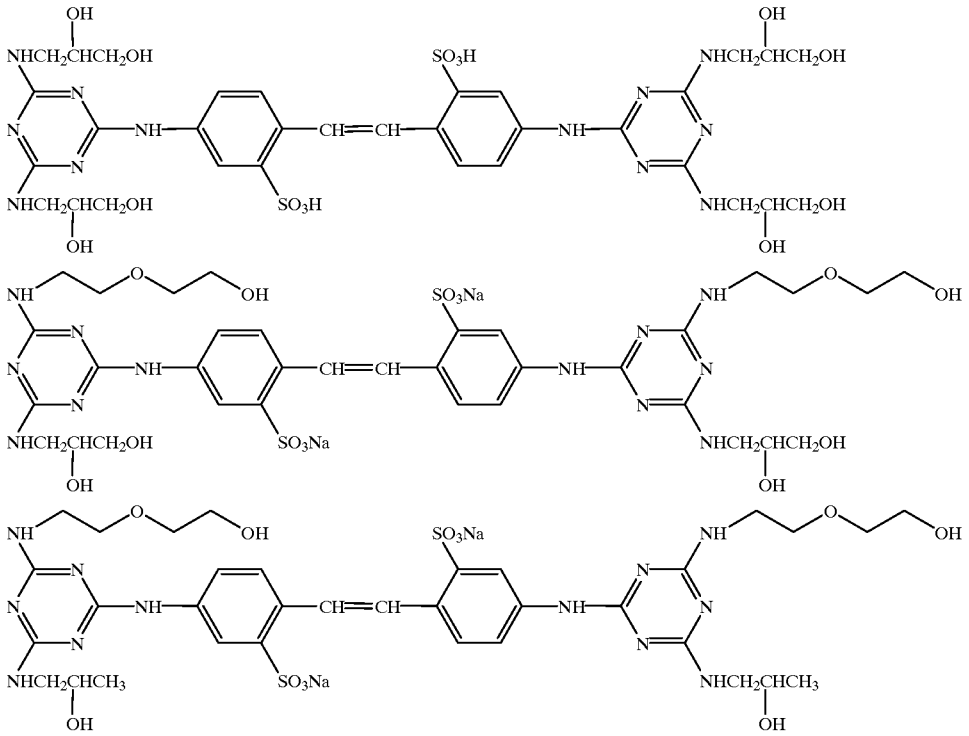

6. The processing composition as claimed in claim 1, that is a color developer composition.

7. The processing composition as claimed in claim 1, that has a pH of from 12 to 13.5.

8. The processing composition as claimed in claim 1, that is a one-part color developer composition.

9. An image forming method comprising using the processing composition as claimed in claim 1.

10. A method for reducing stain caused by residual sensitizing dyes in silver halide photographic materials, which comprises using the processing composition as claimed in claim 1.

* * * * *